US011278067B2

(12) United States Patent
Brown, II et al.

(10) Patent No.: US 11,278,067 B2
(45) Date of Patent: Mar. 22, 2022

(54) BRIM MOUNTED FACE SHIELDS AND METHODS OF USING SAME

(71) Applicants: Daniel Patrick Brown, II, Evanston, IL (US); Daniel Patrick Brown, III, Kildeer, IL (US)

(72) Inventors: Daniel Patrick Brown, II, Evanston, IL (US); Daniel Patrick Brown, III, Kildeer, IL (US)

( * ) Notice: Subject to any disclaimer, the term of this patent is extended or adjusted under 35 U.S.C. 154(b) by 0 days.

(21) Appl. No.: 16/935,160

(22) Filed: Jul. 21, 2020

(65) Prior Publication Data

US 2021/0298380 A1 Sep. 30, 2021

Related U.S. Application Data

(60) Provisional application No. 63/024,399, filed on May 13, 2020, provisional application No. 63/006,632,
(Continued)

(51) Int. Cl.
*A61F 11/00* (2006.01)
*A41D 13/11* (2006.01)

(52) U.S. Cl.
CPC ..... *A41D 13/1161* (2013.01)

(58) Field of Classification Search
CPC ..... A41D 13/11; A41D 13/1161; A41D 13/1107; A41D 13/1184; A41D 13/1192; A61K 8/0212; A42B 1/247; A42B 1/24; A42B 1/061; A42B 1/062; A42B 3/18; A42B 3/20; A42B 3/225; A42B 1/06;
(Continued)

(56) References Cited

U.S. PATENT DOCUMENTS 2,248,331 A * 7/1941 Blodjer ..... A42B 1/0182 2/10
2,883,669 A 4/1959 Rafowitz et al.
(Continued)

FOREIGN PATENT DOCUMENTS

CN 2756188 Y 2/2006
CN 203538464 U 4/2014
(Continued)

OTHER PUBLICATIONS

International Search Report filed in PCT/US2021/023732, dated Jul. 7, 2021, 3 pages.

*Primary Examiner* — Victoria J Hicks
(74) *Attorney, Agent, or Firm* — Vedder Price P.C.

(57) ABSTRACT

A face protector for reducing the transmission of pathogens (including but not limited to viruses such as COVID-19) between individuals, along with methods of making and using the same, are generally provided herein. More specifically embodiments of face protectors that are configured to be supported by the bill of a hat, visor, or other headgear are disclosed, wherein the face protector provides a physical barrier separating the wearer's face from the environment. Embodiments include side panels to provide additional protection and/or wings to provide additional support. Fasteners may be used with embodiments to secure the face protector to the brim or headgear. Radiation (such as ultraviolet light) may be used to sanitize air as it moves past the edge of the face protector. An embodiment includes a projection configured to cover the bill of the headgear.

2 Claims, 34 Drawing Sheets

Related U.S. Application Data filed on Apr. 7, 2020, provisional application No. 62/994,053, filed on Mar. 24, 2020.

(58) Field of Classification Search

CPC .. A42B 1/04; A42B 3/22; A42B 1/018; A42B 1/0181; A42B 1/01822; A42B 1/0184; A42B 1/208; A42B 1/201; A42B 1/18; A61F 9/06; A61F 9/04; A61F 9/045

USPC ..... 128/857; 2/424, 410, 427, 429, 9, 206, 2/173, 10, 209.13; 428/542.8; D29/108

See application file for complete search history.

(56) References Cited

U.S. PATENT DOCUMENTS

| | | | | |
|---|---|---|---|---|
| 3,035,270 | A | 5/1962 | Boemer | |
| 4,965,887 | A | 10/1990 | Paoluccio et al. | |
| 5,450,629 | A * | 9/1995 | Gilstrap | A61F 9/045 2/209.11 |
| 5,544,361 | A | 8/1996 | Fine et al. | |
| 5,933,871 | A | 8/1999 | Kraft | |
| 5,950,241 | A | 9/1999 | Gomez | |
| 6,041,435 | A | 3/2000 | Paulson et al. | |
| 6,584,614 | B2 | 7/2003 | Hogg | |
| 7,103,920 | B1 | 9/2006 | Otterson | |
| D541,991 | S | 5/2007 | Lawrence | |
| D638,205 | S | 5/2011 | Castillo | |
| 9,078,483 | B1 | 7/2015 | Snyder | |
| 9,894,952 | B2 | 2/2018 | Hayes | |
| D835,890 | S | 12/2018 | Swank | |
| 2005/0251890 | A1 | 11/2005 | Landis | |
| 2008/0066214 | A1 | 3/2008 | O'Hare | |
| 2009/0151049 | A1 | 6/2009 | Conrardy et al. | |
| 2010/0146679 | A1 | 6/2010 | Heil | |
| 2010/0257659 | A1 | 10/2010 | Hitch | |
| 2013/0125292 | A1* | 5/2013 | Weaver | A42B 1/0184 2/209.13 |
| 2013/0145525 | A1 | 6/2013 | Arenson et al. | |
| 2016/0050990 | A1 | 2/2016 | Hayes | |
| 2019/0037948 | A1 | 2/2019 | Romanski et al. | |

FOREIGN PATENT DOCUMENTS

| | | | |
|---|---|---|---|
| CN | 104783344 | A | 7/2015 |
| DE | 3635019 | A1 | 4/1988 |
| DE | 202020101562 | U1 | 5/2020 |
| EP | 1344466 | B1 | 3/2007 |
| EP | 2323509 | B1 | 9/2012 |
| EP | 2713789 | B1 | 2/2019 |
| GB | 2515122 | A | 12/2014 |
| JP | 2005-287561 | A | 10/2005 |
| JP | 05952752 | B2 | 7/2016 |
| JP | 2017025426 | A | 2/2017 |
| KR | 10-1245940 | B1 | 3/2013 |
| KR | 2064687 | B1 | 1/2020 |
| WO | 2020044020 | A1 | 3/2020 |

* cited by examiner

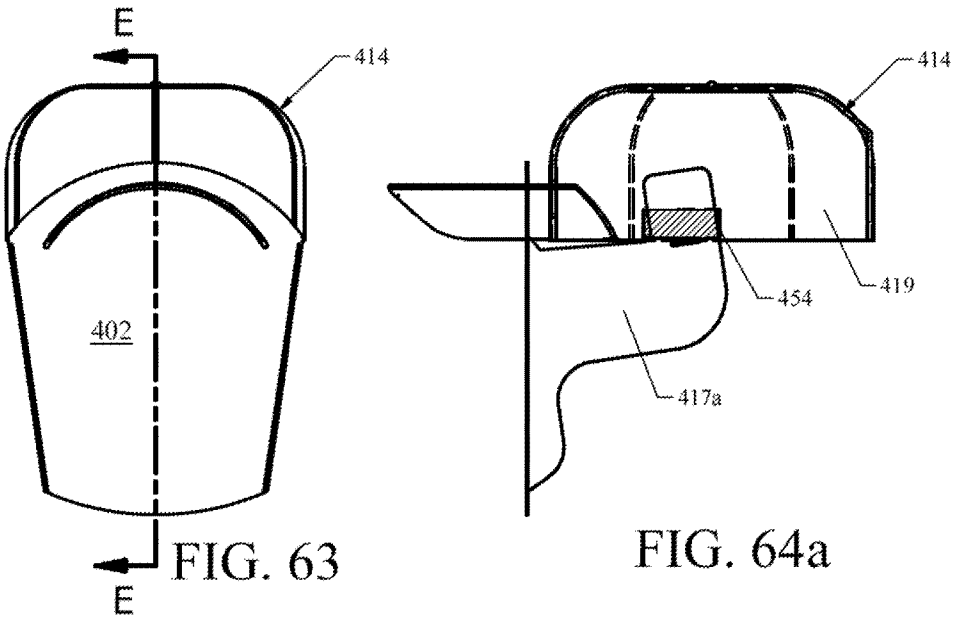
FIG. 63
FIG. 64a
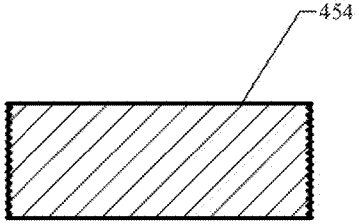
FIG. 64b
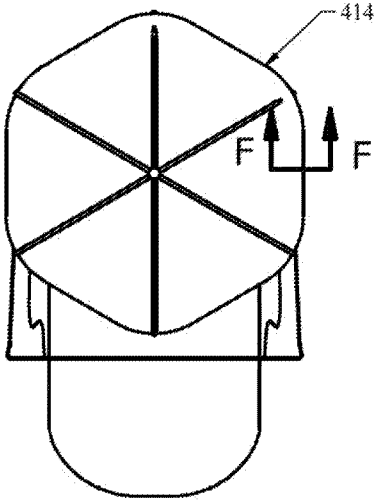
FIG. 65a
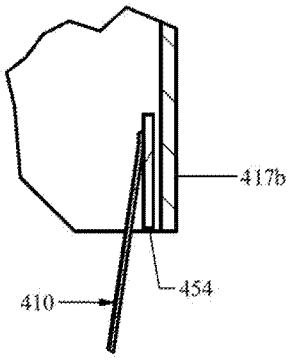
FIG. 65b

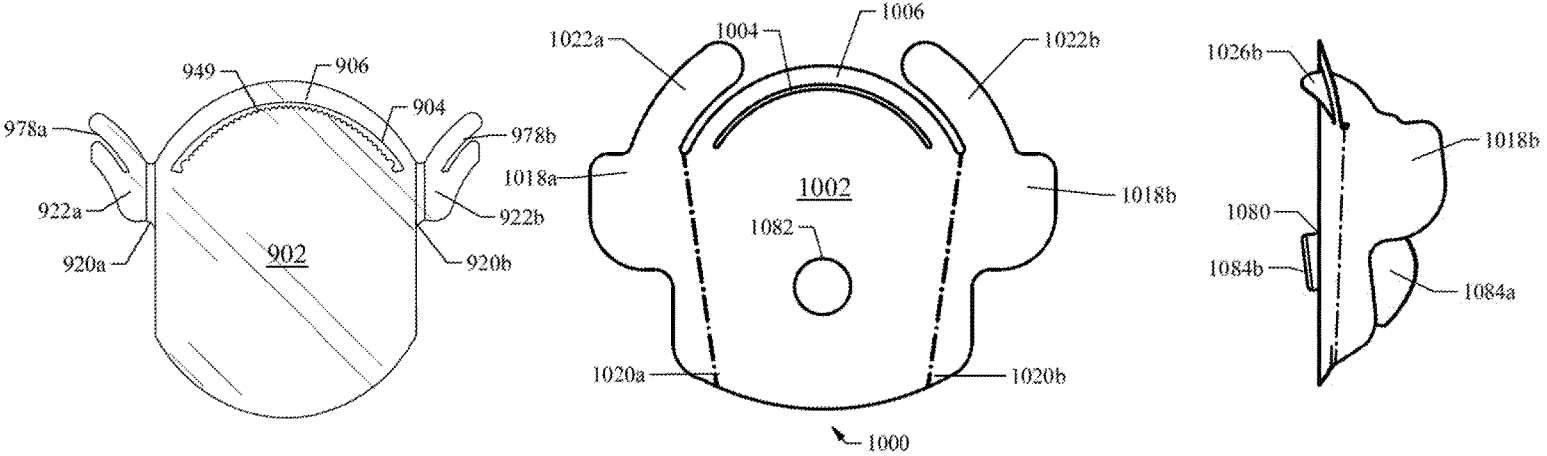
FIG. 106
FIG. 107
FIG. 108
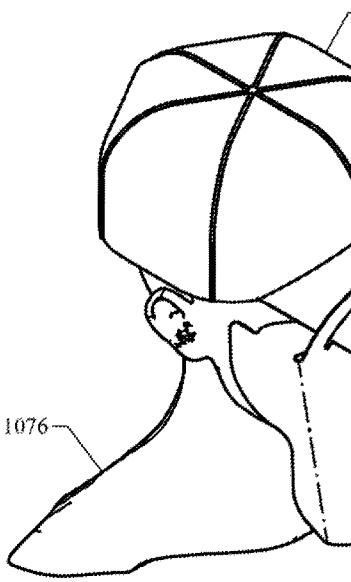
FIG. 109
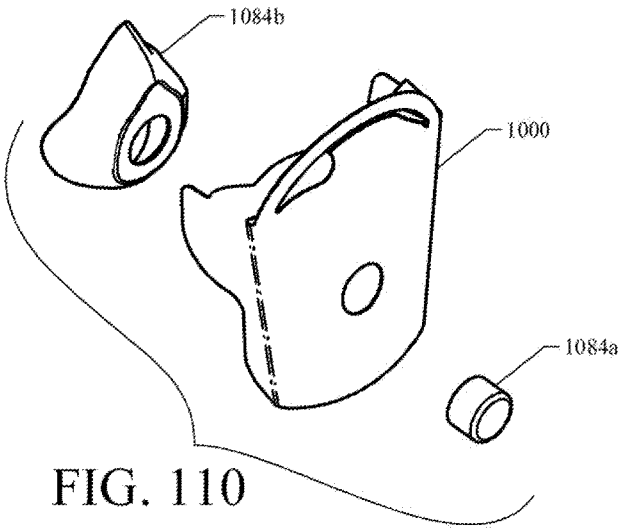
FIG. 110

BRIM MOUNTED FACE SHIELDS AND METHODS OF USING SAME

CROSS-REFERENCE TO RELATED APPLICATIONS

This application claims the benefit of and priority from U.S. Provisional Application Ser. No. 62/994,053, filed on Mar. 24, 2020, U.S. Provisional Application Ser. No. 63/006,632, filed on Apr. 7, 2020, and U.S. Provisional Application Ser. No. 63/024,399, filed on May 13, 2020, the contents of each of which are hereby fully incorporated herein by reference in their entireties.

FIELD OF THE INVENTION

The present disclosure relates generally to the field of face shields, and more particularly to a face protector for reducing the transmission of pathogens (including but not limited to viruses such as COVID-19) between individuals, wherein the face protector can be attached to the bill or brim of a cap, hat, visor or other headgear having a bill or brim.

BACKGROUND

Conventional face protectors of various types are on the market today. Existing products generally include either face shields built or integrated into helmet type designs or held directly on a person's head by straps (that may be of fixed length, elastic, or adjustable). Such conventional face protectors are used when a person is seeking protection from the environment.

Face protectors are needed in a wide variety of fields, including in medical settings (to shield the wearer from another person's coughing, sneezing, etc.), in construction environments (shielding the wearer from debris in the work environment), in indoor and outdoor work environments that require protecting the wearer from sunlight, wind, or other environmental dangers, and in laboratory environments that require shielding the wearer from spills, splatters, or other airborne materials, or working in an environment where there are potential projectile hazards, for which safety glasses are typically worn. Currently face shields are being used by non-specialized personnel in the context of their daily lives because of an epidemic.

Often face shields are designed to work with or are integrated into specialized headgear that adjustably adapts to a user's head size while also providing mounting means and stability for the face shield during use. However, this specialized headgear increases the cost of the unit and adds significant weight and bulk leading to discomfort.

At times, especially during emergencies such as pandemics like the 2020 coronavirus (COVID-19), there exists a rapidly increasing need for face coverings for use by medical, public service, and military personnel as well as by citizens to prevent the airborne spread of viral or bacterial disease. Existing masks can cover the nose and mouth but leaves the eyes unprotected from exposure. Existing face shield solutions are insufficient, as they are either too costly or too difficult to produce quickly in large quantities and transport such as shipping or storage for emergencies in the necessary mass quantities (such as designs requiring specialized structure to support the shield proximate the wearer's head) during the rapid spread of an infectious disease.

In addition, face coverings provide significant utility in protecting wearers from items other than viruses and bacteria. By way of example, face coverings protect the wearer from being struck by larger particles or debris, such as could be encountered on a construction site or workshop or while painting a ceiling. Face coverings may also protect the wearer from radiation or intense light (such as while welding), chemical contamination (such as acids used in laboratories and manufacturing), particulate, or animals (such as the protective face coverings worn by beekeepers).

Therefore, there exists a need for an improved lower cost face covering, as a readily available and mass producible shield that provides protection against the transmission of pathogens as well as providing other facial protections. There further exists a need for such a face shield that may be quickly and readily mass produced, stored, and transported. A particular need exists for such a face shield that can be easily manufactured in large quantities and ships flat so as to minimize shipping costs and maximize the number of such face shields that can be transported or stored in volume for use in an emergency in a minimum footprint in a given container or volume, while being conveniently assembled by the user without tools and applicable to a wide variety of readily available billed head coverings. A further need exists for a face shield that permits a user's face to be visible, so as to enable more productive and meaningful personal communications between wearers.

SUMMARY

Billed headgear (such as baseball caps, visors, and helmets) have existed for many years, with the bills or brims used to shade the user's eyes from the sun. Recently, the bill portion of baseball caps has become somewhat standardized as many (if not all) commonly available hats of this style have similar sizing and/or proportions used for the bill or visor. These caps have become standard wearables and are recognized for their comfort and convenience. Many individuals already own baseball caps and, because of their comfort and convenience, wear them in a variety of settings in which face coverings such as shields are also desirable. Accordingly, embodiments provide a face shield that does not increase the discomfort of a user significantly beyond the minimal discomfort already caused by wearing a hat, thereby improving compliance with restrictions mandating the use of face shields or coverings. Similarly, embodiments of transparent or translucent face shields supported by hats facilitate the ability to personalize and normalize use of face shields in everyday life, increasing both empathy and compliance during interpersonal interactions.

Embodiments of face shields support by headgear are fully compatible with other articles a user may wish to wear on his or her face, such as glasses, cloth masks, respirators, microphones, headphones, earpieces, or other items. Embodiments are adjustable in distance from a wearer's face and may be used with a wide variety of facial sizes, shapes, and configurations. Further, such embodiments can be readily used regardless of a user's facial hair (in contrast to other face masks that cannot be readily worn with beards or facial hair). In addition, embodiments allow sound to travel freely around the shield and do not muffle or otherwise impact a wearer's ability to speak clearly to others, hear others clearly, or to be perceived by recording devices such as microphones used in lectures or video conferences. Embodiments do not impair any of a wearer's senses or ability to perceive or be perceived by the word around them.

With the mass proliferation of brimmed headgear such as baseball caps, a low cost but reliable face covering that does not sacrifice protection from contaminants and pathogens such as a shield (embodiments of which are disclosed herein) configured to attach to a brim can provide protection while remaining low cost and allowing for easy manufacture, storage, and shipping in bulk.

In addition, there exists a need and desire for a face shield further adapted to cover the brim with a surface that can be cleaned and disinfected, which is desirable in conditions where the headgear and face shield are worn for extended times, are used in high risk of exposure environments, or when multiple interactions with people occur in succession.

There are also times where the headgear brim and the face shield need to be constructed of a material that will both seal and withstand repeated disinfecting cycles. There is a particular need for a face shield that will protect the brim from being contaminated, so as to avoid the need to repeatedly disinfect or sanitize the brim after it is used with a face shield. This is accomplished by embodiments disclosed herein comprising a brim cover incorporated into or attached to face shields, such that part or all of the brim is covered by the brim shield.

In addition, there are times when the face shield mounted to the brim or visor of headgear must endure a higher than normal physical environment and there is a need to reinforce the installation with fasteners on the brim or visor or the hat or independent visor with headgear. Embodiments provide for face shields that may be mounted without fasteners or with fasteners (including adhering methods). Embodiments contemplate the use of all known fasteners and adhering methods, enabling a user to employ whatever style of fastener or adhering methods is readily available rather than requiring the use of specialized fastener components.

Embodiments provide face shields that are highly adaptable and customizable by users, including but not limited to by removing portions of the face shield to allow for specialized uses (such as for access to an instrument), customization of the face shield decoratively or informationally (such as to include pleasing aesthetic designs, logos, or important information on the shield). Embodiments provide for customization using embossing, engraving, screen printing, and other known methods of marking a surface.

Although various devices are currently available that attach to the brim by clips or over-molded mechanical attachments, there is no face protector available that protects the entire face that can be easily attached to a conventional baseball cap as a unitary unit completely supported by the hat bill. In addition, existing face protectors are not adapted to work with the bill of headgear (such as a baseball cap) that provides a surface and means adapted to be readily cleaned and disinfected.

In addition, a face shield discourages autoinoculation (i.e., the touching of one's face) and transferring pathogens and contaminants such as bacterial, viral, and other potentially harmful contaminants from one's hands to one's face, while at the same time shielding the face of the wearer from airborne contaminants expelled by the sneezing of others as well as protecting others from pathogens and contaminants that are airborne (such as those projected by the sneezing, coughing, or speaking of the wearer).

Embodiments of the present disclosure provide a face shield manufactured from a single sheet of material that can be installed on the brim of headgear (such as a hat or visor) either during manufacturing or after manufacture (i.e., by a user). Embodiments provide for a face shield installed over a bill without the need for additional tools, supports or components. Other embodiments provide for protecting the bill by enclosing the bill of the hat in protective material, thereby preventing the bill of from becoming contaminated when the face shield is worn.

Another object of embodiments of the present disclosure is to provide a face protector that is easily manufactured with various shapes of cutouts that allow the shield to slip over a bill and engage the bill to provide location and support. The cutouts or slots may be designed to work with specific headgear (such as childrens' or adults' sized hats, construction helmets, and visors) or designed to work generally with a variety of flat or curved bills.

Another object of embodiments of the present disclosure is to provide a face shield that has additional support-members that, when in position, can be directed under, above or both about the brim or on or under the front or side panels of the hat or visor to further support the face shield.

A further object of embodiments of the present disclosure is to provide a face protector that is pre-formed into shape and also has a formed sleeve integral to the face shield to slip over and engage bill to provide location, support and a cleanable surface.

Another object of embodiments of the present disclosure is to provide a face protector that has engageable projections designed to penetrate the bill of the headgear in order to further support the face shield.

Another object of embodiments of the present disclosure is to provide a face shield with a plurality of cutout shapes or score lines to allow for usage of one face shield on multiple bill profiles that are in the marketplace. A user may select the particular cutout or score line to remove in order to customize the shield to use with the particular headgear that the user has available. The design has the ability to offer the opportunity for simply adapting to a wide range of bill profiles and widths. As such, a standardize face shield may be stored until needed and readily adapted for whatever headgear a user may have on hand.

Another object of embodiments of the present disclosure is to provide engaging teeth-like protrusions on the inner engaging area of the face shield cut out in order to allow for different thicknesses of bills while maintaining supporting engagement with the hat or visor bill.

Another object of embodiments of the present disclosure is to provide serrated areas along each side of the shield cut out to allow for easy field widening of the cut out if the width of the bill is wider.

Another object of embodiments of the present disclosure is to produce the face shield with scores or perforations along the area of the shield that would facilitate bending and folding about the face of the user.

Another object of embodiments of the present disclosure is to provide a face shield that can be easily repositioned forward and rearward adjustably on the brim to accommodate the space needed in front of the user's face.

Another object of embodiments of the present disclosure is to provide a cover for the bill of headgear and bill combination that are made of materials that can facilitate sealing of the shield on the bill. Embodiments prevent the bill from becoming contaminated when the face protector is worn.

Another object of embodiments of the present disclosure is to provide a headgear and/or bill combination integral or in separate pieces that is constructed of a material that can be repeatedly cleaned and disinfected. Embodiments provide face shields that may be easily discarded and recycled without disassembly or specialized recycling processes. Further, embodiments provide face shields that may be manufactured without requiring separate disinfecting processes, as the manufacturing process itself involves sufficient temperature to provide sanitization of the shield.

Another object of embodiments of the present disclosure is to provide a face shield and brim shield combination protector that can provide a protective barrier to both the face and the brim of the hat, that can be either disposable or disinfected to avoid the spread of contagious diseases.

Another object of embodiments of the present disclosure is to provide holes, cuts, or other penetrating shapes into the face shield that can locate a multitude of types of fasteners to physically fasten the shield to corresponding openings or extrusions (such as male/female interlocking members or tabs with corresponding receptacles) in the headgear brim for enhanced locking and stability of the face shield.

Another object of embodiments of the present disclosure is providing a face shield that can be shipped and stored substantially flat in large quantities (e.g., in flat packs).

Another object of embodiments of the present disclosure is to provide a face shield adaptable to a wide variety of billed headgear such as hard hats, bike hats, visors, or any other head covering incorporating a bill or brim projecting from the front of the headgear.

Another object of the invention is to provide a face shield that both engages the brim, but also engages other areas of headgear (such as front or side panels), visor, or construction or similar helmet.

In an embodiment, a face shield comprises a central panel with a slot formed therein and an upper portion located above the slot. A brim is inserted through the slot such that the face shield is supported by the brim. In embodiments, fasteners are used to secure the face shield to the brim. In embodiments, the face shield is transparent across the visible light spectrum. In embodiments, the face shield is translucent to visible light.

In an embodiment, a face shield has a folded or three-dimensional configuration in which one or more panels are angled away from a central panel to provide additional coverage around the sides, top, or bottom of the volume between the central panel and a wearer's face. In an embodiment, the face shield may be folded or flexed between an unfolded or planar configuration and the folded or three-dimensional configuration.

In an embodiment, one or more support members contact a brim to further secure the face shield to the brim. In embodiments, support members are folded above the brim of a headgear. In embodiments, support members are folded below the brim of a headgear. In embodiments, support members are folded behind a central panel of a face shield and inserted through a slot therein. In an embodiment, one or more support members contact headgear to secure the face shield to the headgear. In embodiments slits in the brim and/or headgear receive the support members. In embodiments, the support members are secured together to retain the face shield in a folded or three-dimensional configuration. In embodiments, the support members comprise one or more tabs formed thereon. In embodiments, one support member comprises a tab while another support member comprises a corresponding slit. In embodiments, a plurality of support members each comprise one or more corresponding notches that may be interlocked to connect the support members. In embodiments, each of a plurality of support members comprises one or more tabs, slits, and/or notches configured to secure support members together. In embodiments, slits are located above a slot and are configured to receive and retain one or more tabs on a support member when the support member is folded over the brim of a headgear. In embodiments, slits are located below a slot and are configured to receive and retain one or more tabs on a support member when the support member is folded under the brim of a headgear.

In embodiments, fasteners are used to secure support members to the brim, other support members, central panel of the face shield, and/or headgear (e.g., the front and/or side panels thereof). In embodiments, support members of a face shield are specifically adapted to be secured to particular headgear having corresponding attachment points, such as a hard hat.

In an embodiment, a face shield comprises a brim cover that at least partially surrounds a brim of a headgear, protecting such portion of the brim from contamination and further securing the face shield to the brim. In an embodiment, the brim cover is removable from a central panel of the face shield, such that the entire face shield may be provided in an unfolded or planar configuration before being assembled in a folded or three-dimensional configuration.

In an embodiment, one or more tabs on a central panel may be secured to corresponding slits on support members to hold a face shield in a folded or three-dimensional configuration.

In an embodiment, a central panel of a face shield may be folded up to permit access to the lower portion of a wearer's face. In an embodiment, the central panel comprises one or more fold lines to permit folding of the central panel. In an embodiment, the central panel is made of a flexible material. In embodiments, the central panel covers an upper portion of a wearer's face while leaving the lower portion of the face exposed.

In embodiments, a support member comprises an upper portion, a slit, and a lower portion with the slit configured to receive a portion of a brim. The support member is folded such that it is substantially parallel to a central panel having a slot and the brim is inserted through the slit in the support member and the slot in the central panel.

In embodiments, a face shield is configured for use with a respirator having a respirator cartridge that extends through the face shield. An opening in the face shield receives the respirator cartridge and the face shield is sealed thereto. In embodiments, the face shield is sealed between a portion of the respirator and a portion of the respirator cartridge.

In embodiments, a face shield is configured with one or more decontamination emitters placed so as to decontaminate an area around the face shield. In an embodiment, the one or more emitters are LEDs that emit ultraviolet light, such as far ultraviolet light having a wavelength of 222 nm or other light that is safe for use proximate humans. In embodiments, the one or more emitters release radiation (including electromagnetic radiation or sonic waves) that removes contamination. In embodiments, the emitters release chemical decontaminants.

Other features and advantages of the present disclosure will become more readily apparent to those of ordinary skill in the art after reviewing the following detailed description and accompanying drawings, in which like references indicate similar elements.

BRIEF DESCRIPTION OF THE DRAWINGS

Certain embodiments are shown in the drawings. However, it is understood that the present disclosure is not limited to the arrangements and instrumentality shown in the attached drawings.

FIG. 63 depicts a front view of the embodiment of FIG. 60 without the slits on the support members, the support members folded inside the hat, and double-sided tape securing the support members to the hat.

FIG. 64*a* depicts a cross-sectional view along line E-E of FIG. 63.

FIG. 64*b* depicts the double-sided tape of FIG. 63.

FIG. 65*a* depicts a top view of the embodiment of FIG. 60 in a folded configuration with tape between the support members and the hat.

FIG. 65*b* depicts a cross-sectional view taken along line F-F of FIG. 65*a*.

Figure 96:
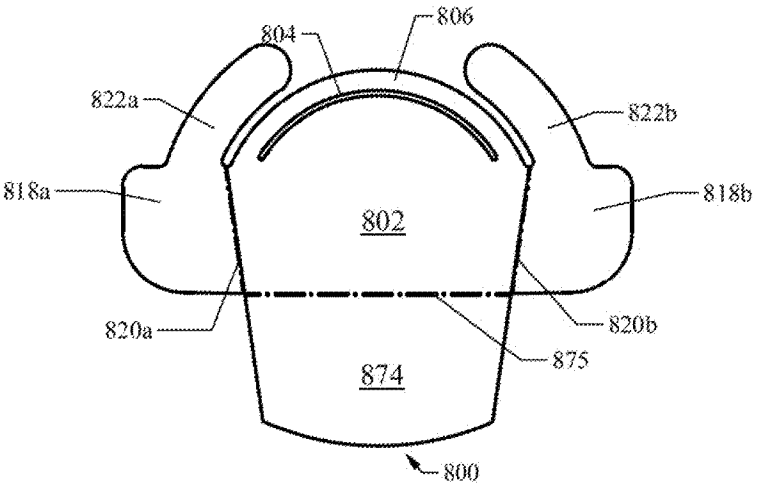
FIG. 96 depicts a front view of an embodiment of an eighth style of face shield in an unfolded configuration in accordance with the present disclosure, with a fold line separating a lower portion from the central panel.
Figure 97C:
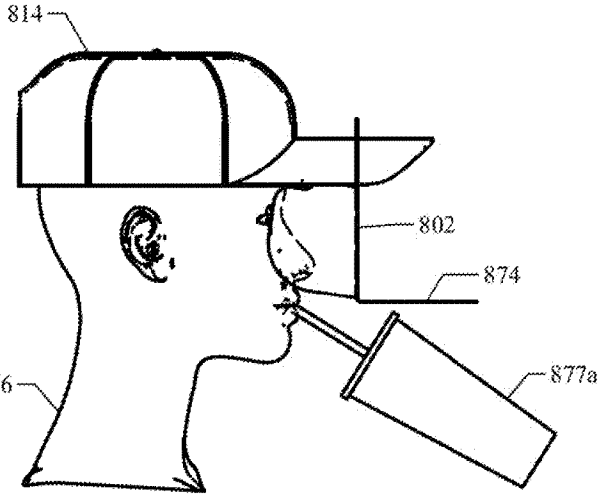
Figure 97B:
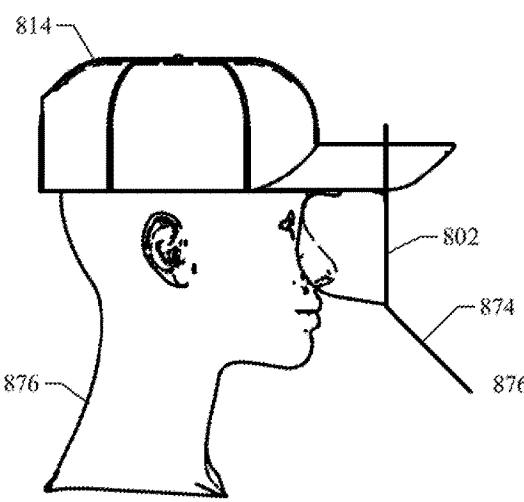
Figure 97A:
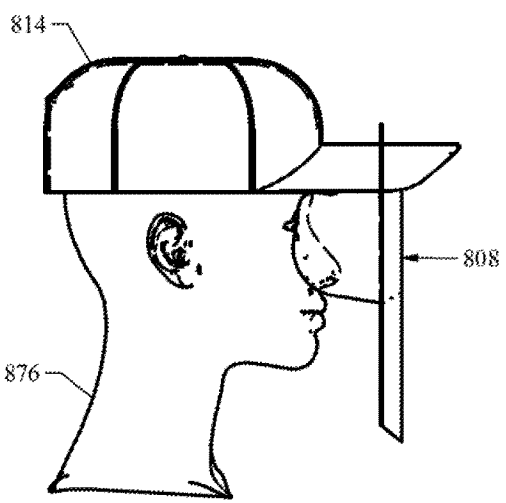

FIG. 97*a* depicts a side view of the embodiment of FIG. 96 in a folded configuration supported by the brim of a hat worn by an individual.

FIG. 97*b* depicts a side view of the configuration shown in FIG. 97*a* with the lower portion raised 45 degrees towards the environment side.

FIG. 97*c* depicts a side view of the configuration shown in FIG. 97*a* with the lower portion raised 90 degrees towards the environment side and the individual drinking from a straw.

Figure 98:
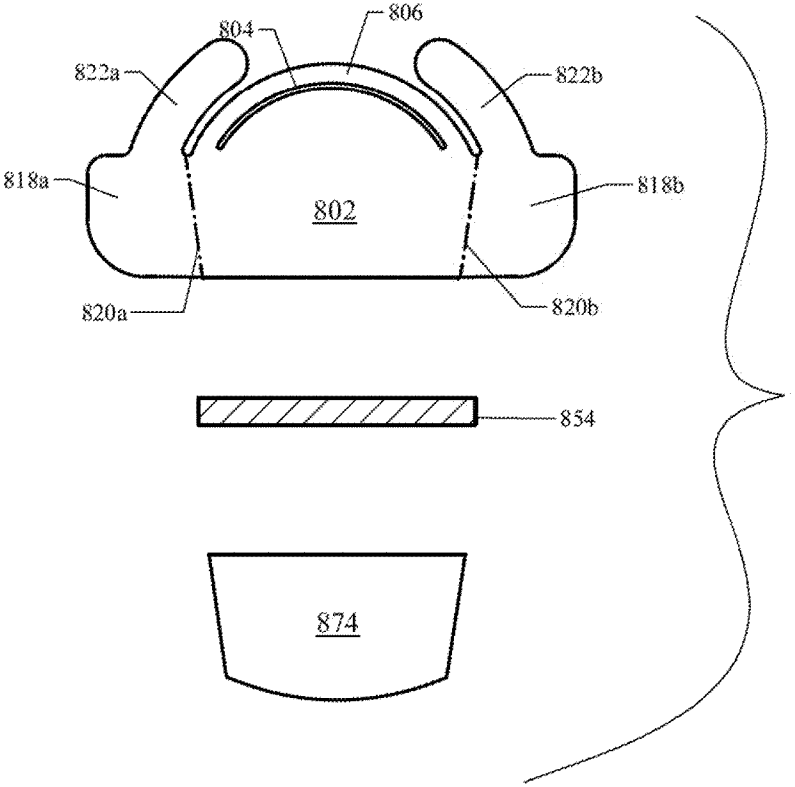

FIG. 98 depicts an exploded view of a second embodiment of the eighth style of face shield in an unfolded configuration in accordance with the present disclosure with tape connecting the lower portion to the central panel.

Figure 99:
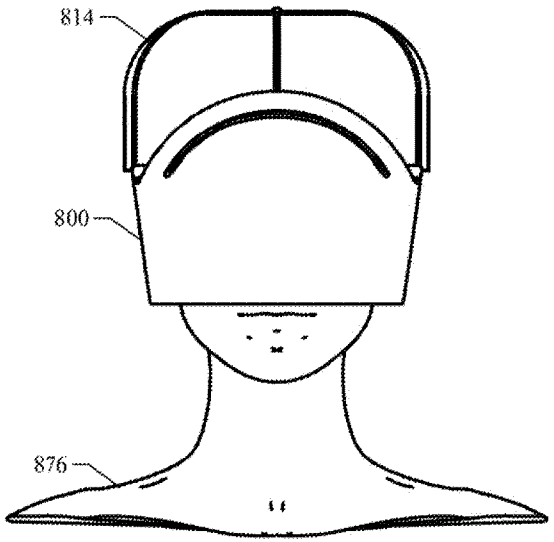

FIG. 99 depicts a front view of a third embodiment of the eighth style of face shield in a folded configuration in accordance with the present disclosure supported by a brim of a hat worn by an individual, with the central panel only covering the upper half of the individual's face.

Figure 100:
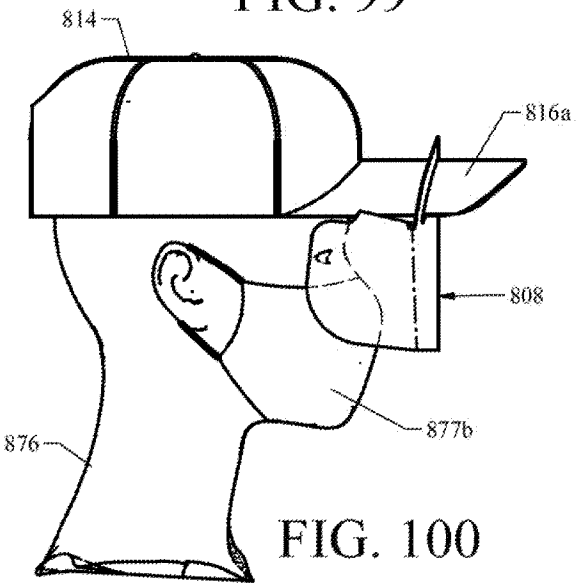

FIG. 100 depicts a side view of the configuration of FIG. 99, with the individual wearing a face mask under the face shield.

Figure 101:
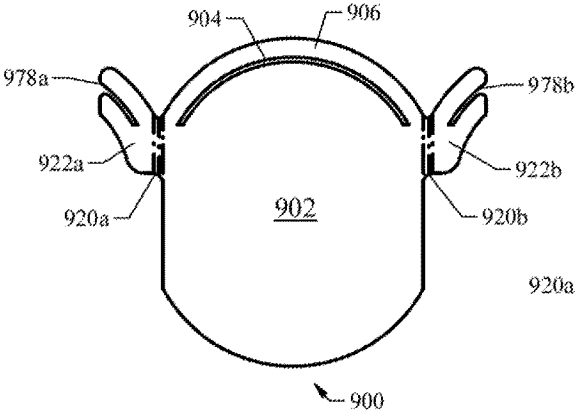

FIG. 101 depicts a front view of an embodiment of a ninth style of face shield in an unfolded configuration in accordance with the present disclosure, with each support member having a top portion separated from a bottom portion by a slit and the support members joined to the central panel by fold lines.

Figure 102:
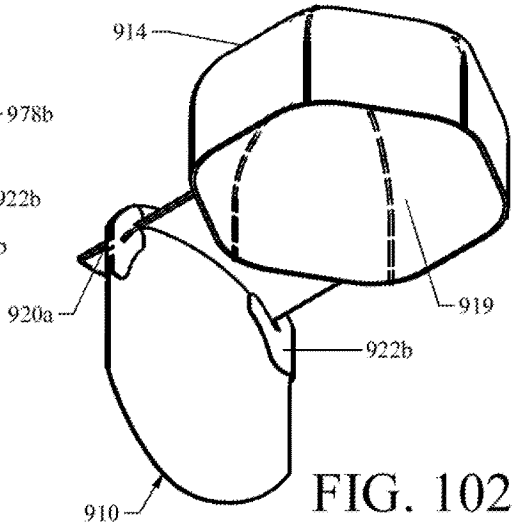

FIG. 102 depicts a lower perspective view of the embodiment of FIG. 101 in a folded configuration supported by the brim of a hat with the support members folded against the wearer side of the central panel and the brim inserted through the slits in the support members and the slot.

Figure 103:
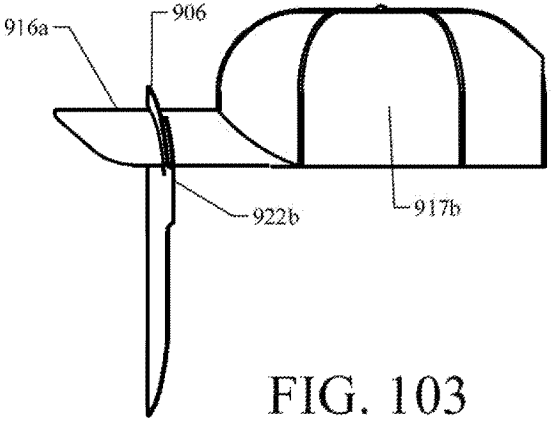

FIG. 103 depicts a side view of the configuration of FIG. 102.

Figure 104:
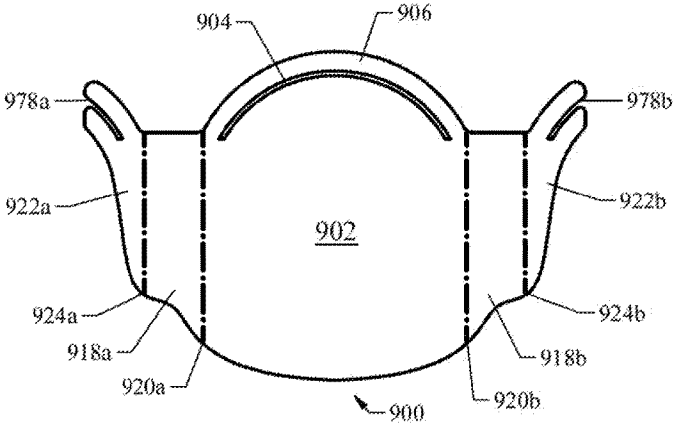

FIG. 104 depicts a front view of a second embodiment of the ninth style of face shield in an unfolded configuration in accordance with the present disclosure with side panels separating the support members from the central panel.

Figure 105:
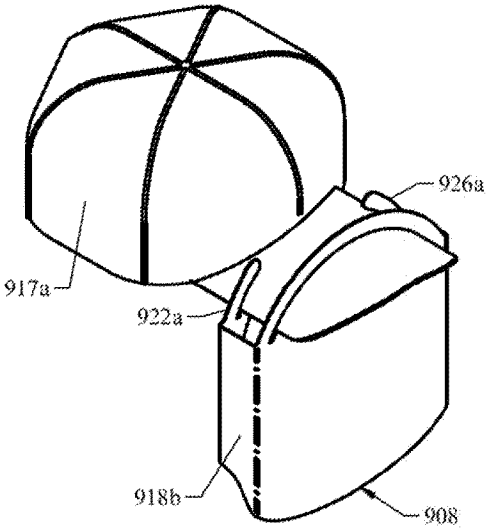

FIG. 105 depicts a lower perspective view of the embodiment of FIG. 104 in a folded configuration supported by the brim of a hat with the support members folded toward the wearer side of the central panel and the brim inserted through the slits in the support members and the slot.

FIG. 106 depicts a front view of a third embodiment of the ninth style of face shield in an unfolded configuration in accordance with the present disclosure, with each support member having a top portion separated from a bottom portion by a slit and the support members joined to the central panel by fold lines and a plurality of teeth extending into the slot from the central panel.

FIG. 107 depicts a front view of an embodiment of a tenth style of face shield in in an unfolded configuration accordance with the present disclosure with an opening formed in the central panel.

FIG. 108 depicts a side view of the embodiment of FIG. 107 in a folded configuration with a respirator cartridge inserted through the opening in the central panel.

FIG. 109 depicts a perspective view of the embodiment of FIG. 107 in a folded configuration supported by the brim of a hat worn by an individual with a respirator cartridge inserted through the opening in the face shield.

FIG. 110 depicts an exploded view of the configuration of FIG. 108.

Figure 111:
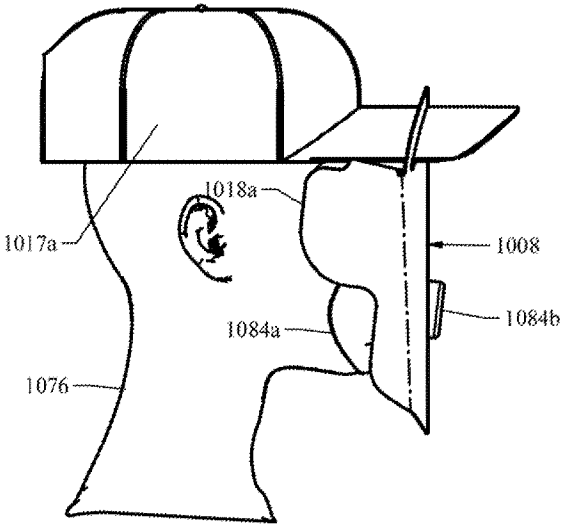

FIG. 111 depicts a side view of the configuration of FIG. 109.

Figure 112:
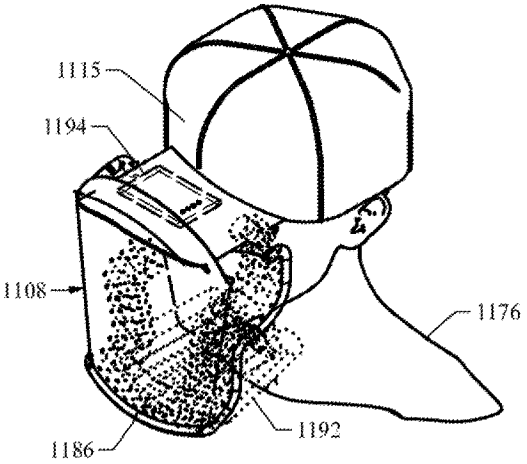

FIG. 112 depicts a perspective view of an embodiment of a eleventh style of face shield in a folded configuration in accordance with the present disclosure, with an emitter array secured to the face shield by a housing, the face shield supported by a hat bearing an emitter source, and a decontamination curtain surrounding the face of a wearer of the hat.

Figure 113:
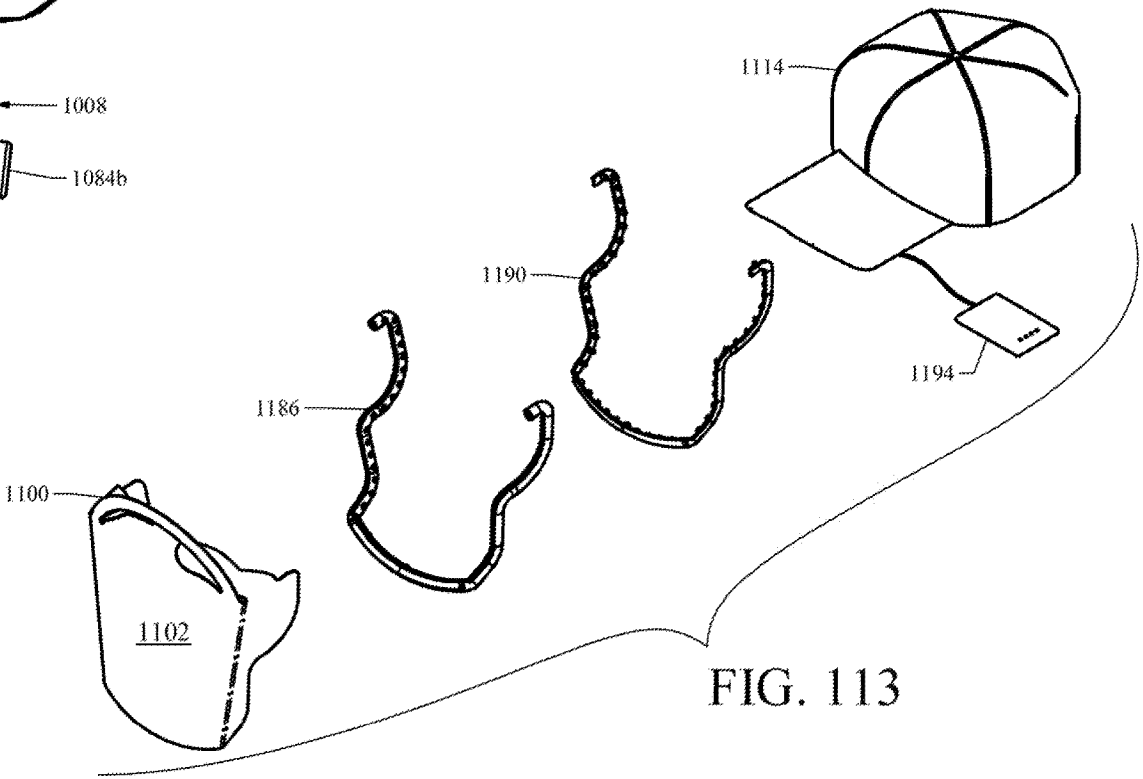

FIG. 113 depicts an exploded view of the configuration of FIG. 112 without the wearer.

Figure 114:
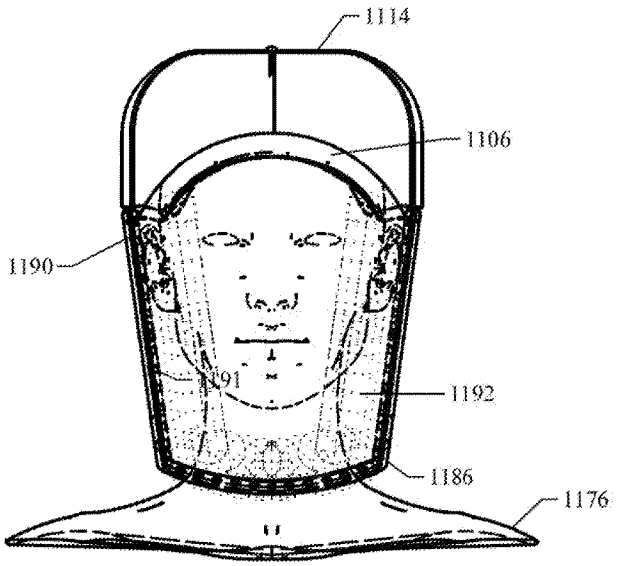

FIG. 114 depicts a front view of the configuration of FIG. 113.

Figure 115:
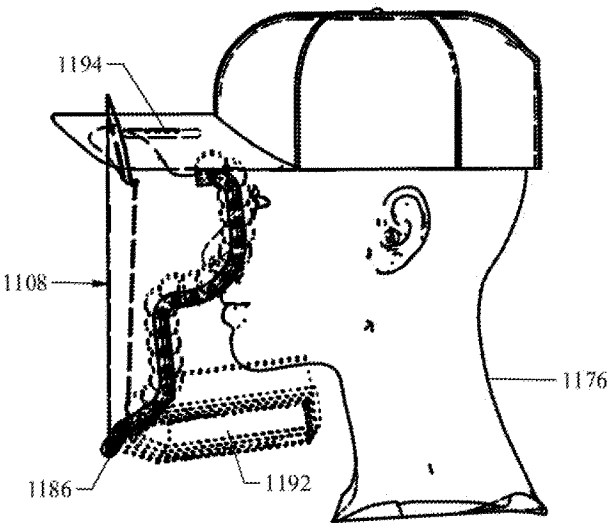

FIG. 115 depicts a side view of the configuration of FIG. 113.

Figure 116:
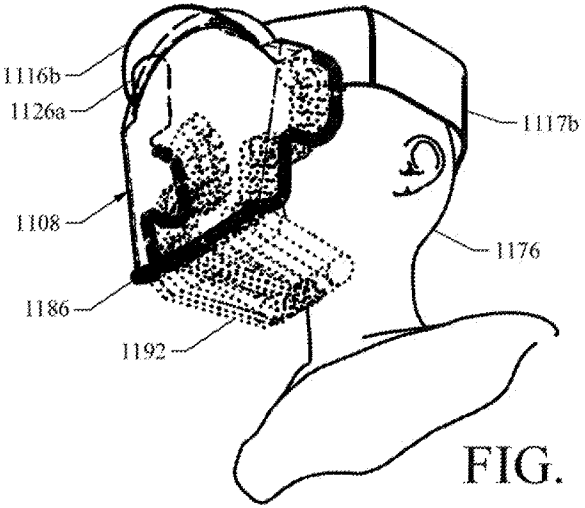

FIG. 116 depicts a lower perspective view of the configuration of FIG. 113.

Figure 117:
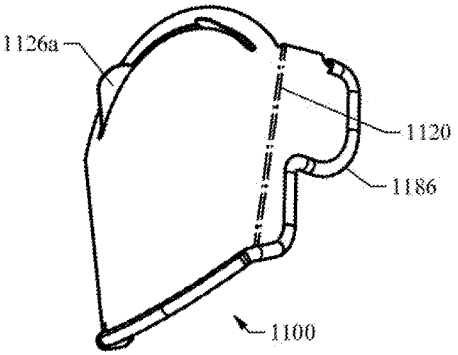

FIG. 117 depicts a lower perspective view of the embodiment of FIG. 113 in a folded configuration without the hat and wearer.

Figure 118:
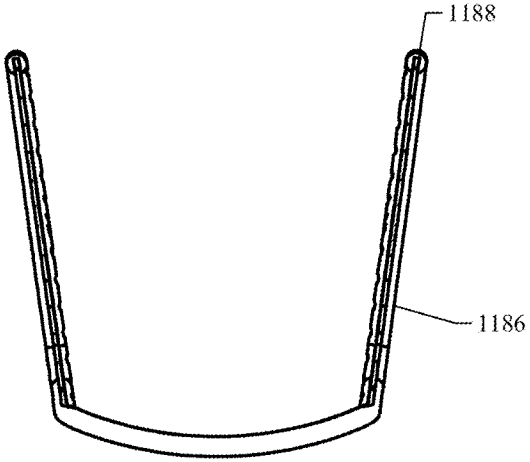

FIG. 118 depicts a front view of the housing of FIG. 113.

Figure 119B:
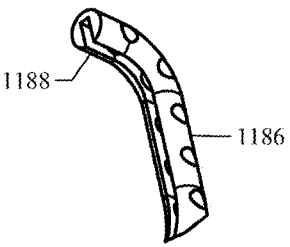
Figure 119A:
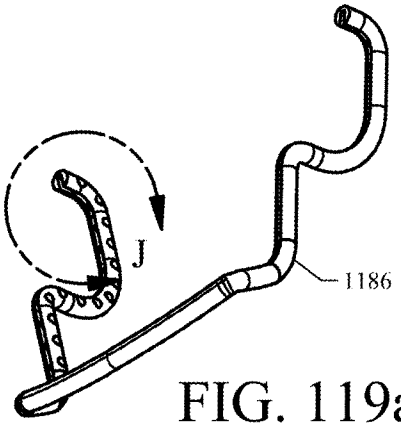

FIG. 119*a* depicts a lower perspective view of the housing of FIG. 113.

FIG. 119*b* depicts an enlarged perspective view of area J of FIG. 119*a*.

Figure 120B:
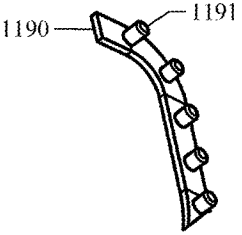
Figure 120A:
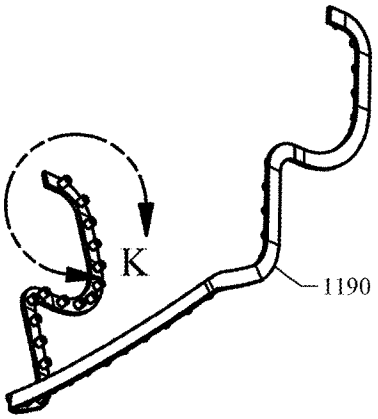

FIG. 120*a* depicts a lower perspective view of the emitter array of FIG. 113.

FIG. 120*b* depicts an enlarged perspective view of area K of FIG. 120*a*.

Figure 121:
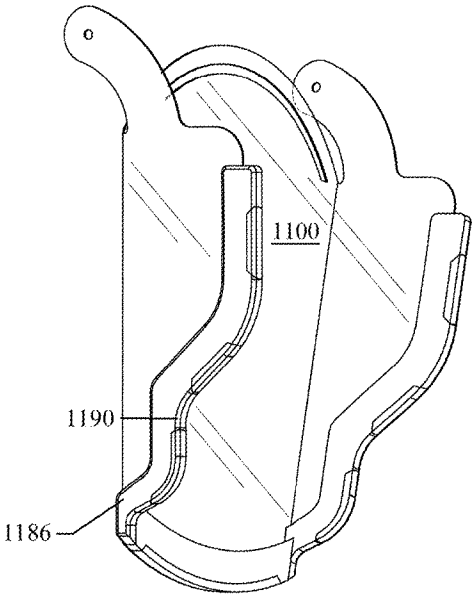

FIG. 121 depicts a side perspective view of a second embodiment of the eleventh style of face shield in a folded configuration in accordance with the present disclosure, with an emitter array and a housing integrally formed with the face shield.

Figure 122:
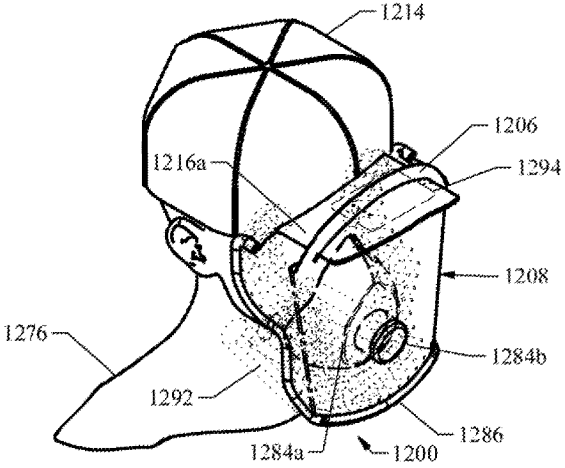

FIG. 122 depicts a perspective view of an embodiment of a twelfth style of face shield in a folded configuration in accordance with the present disclosure, with an emitter array secured to the face shield by a housing, the face shield supported by a hat bearing an emitter source, a decontamination curtain surrounding the face of a wearer of the hat, and a respirator cartridge inserted through an opening in the central panel.

Figure 123:
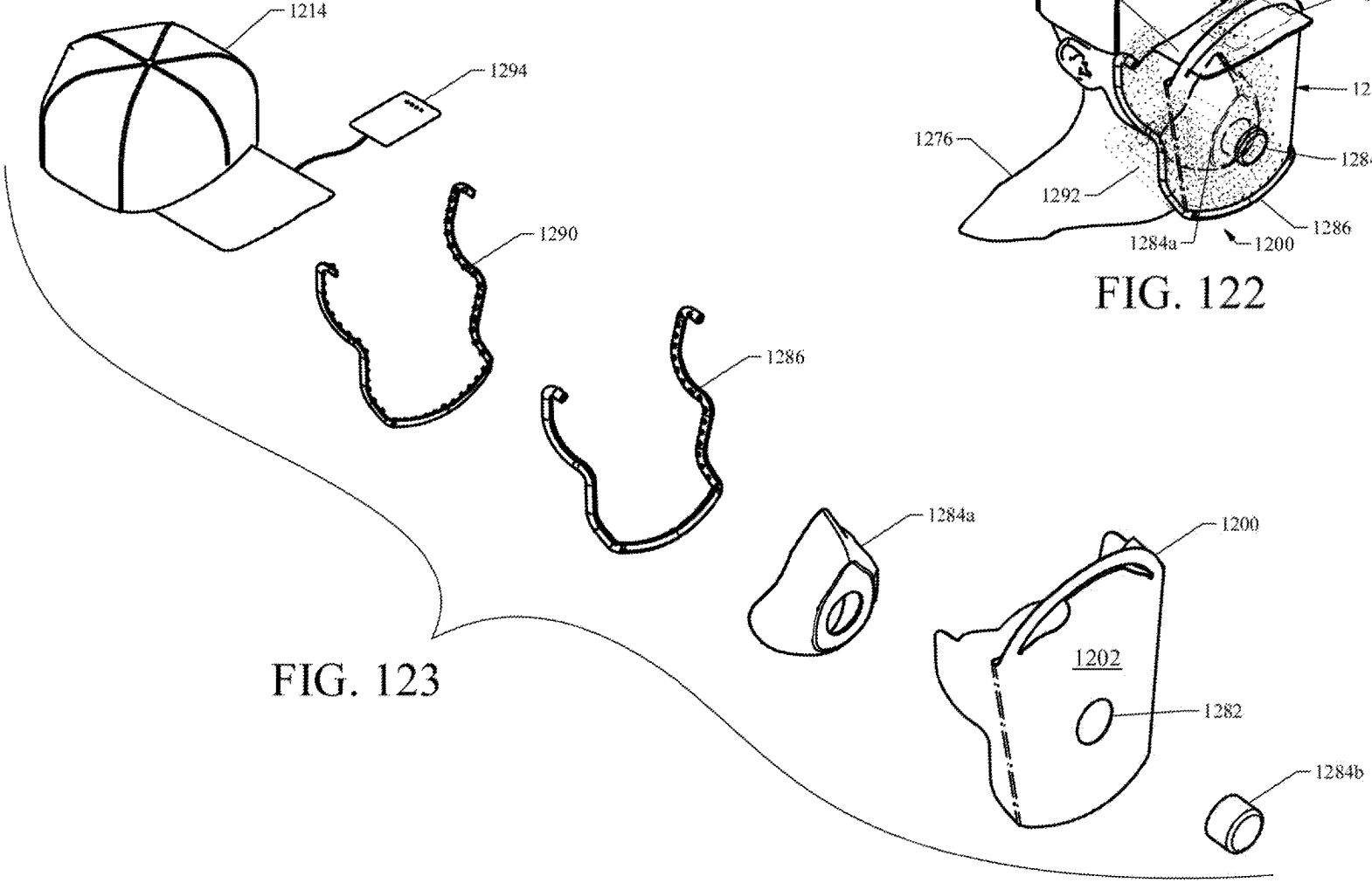

FIG. 123 depicts an exploded view of the configuration of FIG. 122 without the wearer.

Figure 124:
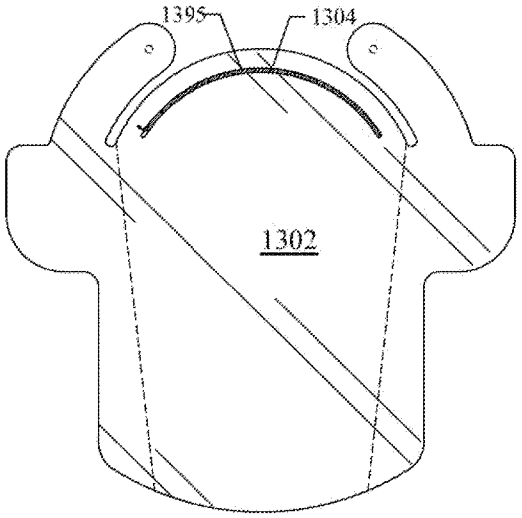

FIG. 124 depicts a front view of an embodiment of a face shield in a flat or unfolded configuration with a strip of material partially removed from the slot.

Figure 125A:
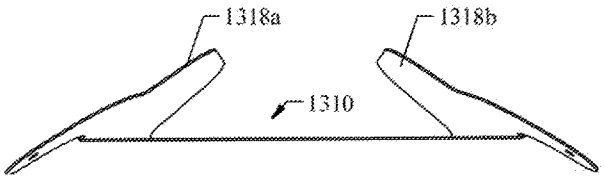

FIG. 125*a* depicts an embodiment of a face shield with the side panels of a face shield folded back to form a 45 degree angle with the wearer side.

Figure 125B:
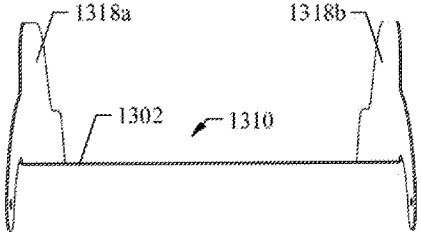

FIG. 125*b* depicts an embodiment of a face shield with the side panels folded back to form a 90 degree angle with the wearer side.

Figure 125C:
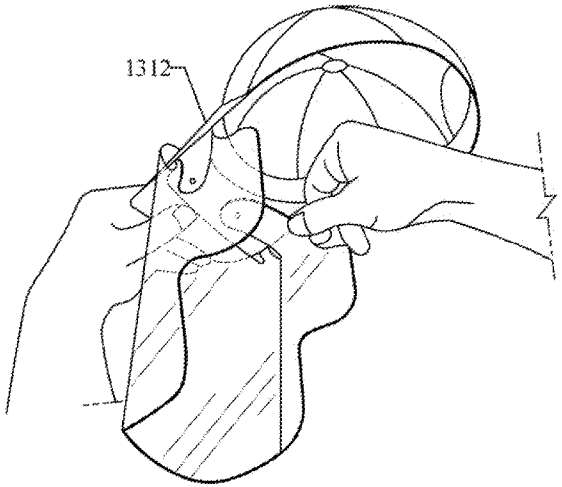

FIG. 125*c* depicts an embodiment of a face shield supported by the brim of a hat with the support members being folded under the brim.

Figure 126:
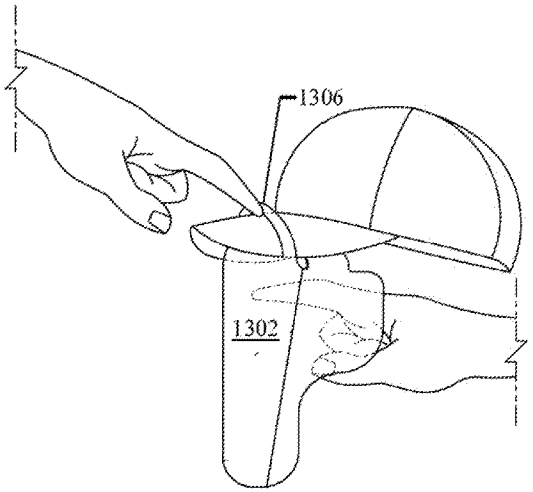

FIG. 126 depicts an individual adjusting the positioning of an embodiment of a face shield supported by the brim of a hat.

FIG. 127*a* through 127*i* depict examples of brimmed headgear with which face shields in accordance with the present disclosure may be used.

DETAILED DESCRIPTION

For the purposes of promoting and understanding the principles disclosed herein, reference is now made to the preferred embodiments illustrated in the drawings, and specific language is used to describe the same. It is nevertheless understood that no limitation of the scope of the invention is hereby intended. Such alterations and further modifications in the illustrated devices and such further applications of the principles disclosed and illustrated herein are contemplated as would normally occur to one of ordinary skill in the art to which this disclosure relates.

As used herein the term "headgear" is used to refer generally to hats, visors, and other articles that may be worn on or about the head that feature a portion (referred to herein as a "brim") which extends over at least a portion of the wearer's face.

In the interest of aiding the understanding of the present disclosure, various embodiments are discussed herein in the context of "styles." Such grouping is not intended to limit the disclosure, and elements or aspects discussed in the context of one "style" may be (and are intended to be) combined with those discussed in the context of another "style" so to realize the advantages thereof.

First Style (Panel)

Figure 1:
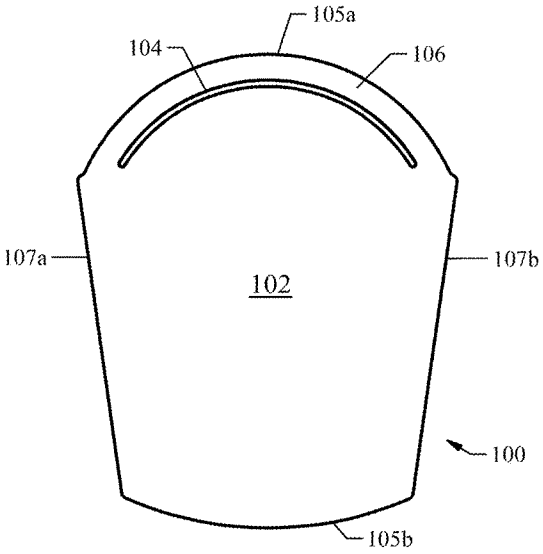
FIG. 1 depicts a front view of an embodiment of a first style of face shield in accordance with the present disclosure.
Figure 2:
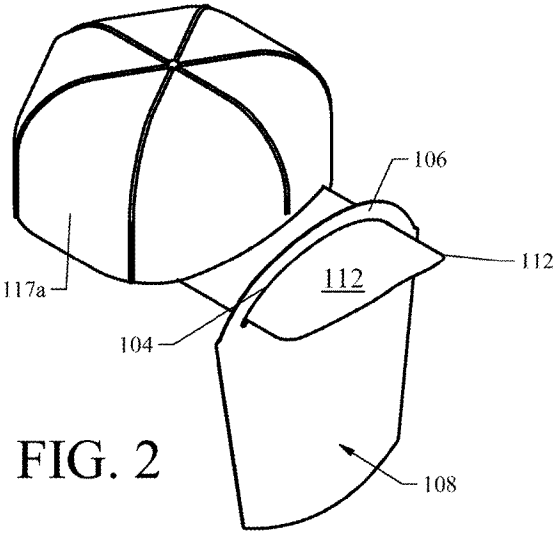
FIG. 2 depicts a perspective view of the embodiment of FIG. 1 supported by the brim of a hat.
Figure 3:
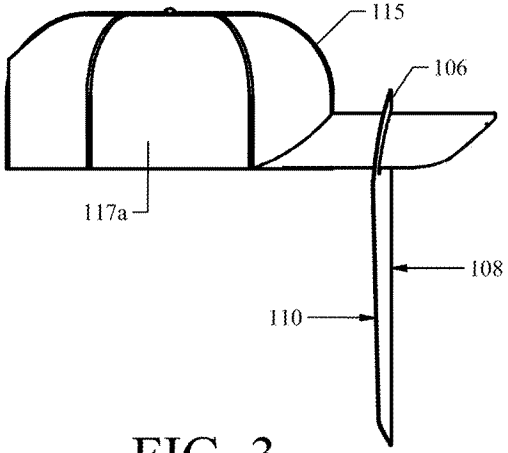
FIG. 3 depicts a side view of the embodiment of FIG. 1 supported by the brim of a hat.

FIGS. 1 through 3 depict an embodiment of a first style of face shield 100 in accordance with the present disclosure. As shown, the face shield 100 comprises a panel 102 with a slot 104 and an upper portion 106 located above the slot 104.

The slot 104 is configured to receive the brim 112 of an article of headgear (here, a hat, headgear 114). As shown, the slot 104 is arcuate and extends proximate the top edge 105*a* of the panel 102. The arcuate shape is desirable for use with headgear such as headgear 114 having a brim 112 with an arcuate profile. For headgear having a resilient or flexible brim 112, the brim 112 may be bent to match the profile of slot 104. The orientation of the brim 112 and slot 104 cause pressure or force to be exerted on interface between the slot 104 and the brim 112 as the brim 112 attempts to return to its resting state serves to hold the face shield 100 in place on the brim 112. In other embodiments, the slot 104 may be straight, curved, angled, or a combination thereof. In embodiments, the shape of slot 104 is selected to match or accommodate the profile of a particular brim. In other embodiments, the shape of slot 104 is selected to allow for use with a wide variety of brims having different profiles.

With the brim 112 inserted through the slot 104, the face shield 100 is supported such that a back (or wearer) face 110 is proximate a user's face while a front (or environment) face 108 is proximate the environment. As will be clear to one of ordinary skill in the art and discussed in greater detail below, the face shield may be used with a wide variety of headgear constrained only by the requirement that the headgear feature a brim 112 of sufficient size and strength to be received within slot 104 and support face shield 100.

The panel 102 may be constructed from any material that obstructs the passage of contaminants therethrough while allowing at least a portion of light in the visible spectrum to pass through a least a portion of the panel 102 to reach a user's eyes. In the embodiment shown, the entire face shield 100 is made from a single material, specifically, a transparent plastic. In other embodiments, other materials that are transparent or translucent may be used for the face shield. In the embodiment shown, the material used to construct the face shield 100 is also lightweight to ensure compatibility with a wide variety of headgear and avoid fatiguing a wearer while in use. In an embodiment, the face shield is composed of polyethylene terephthalate (PET). In embodiments, the face shield is composed of other thermoplastic polymer resins or other inorganic materials (such as glass).

In embodiments, the face shield 100 is made from two or more materials in combination, such that different portions of the face shield 100 are made from different materials or combinations of materials. In an embodiment, a portion of the panel 102 in combination is transparent or translucent to light in the visible spectrum while the remainder of the panel 102 is substantially opaque. In an embodiment, at least a portion of the panel is constructed from a material that is permeable to air but which obstructs the movement of larger contaminants through the panel 102, such as a filter material that blocks at least 95 percent of particles that are 0.3 microns in size or larger. In an embodiment, the panel 102 comprises a frame extending along at least a portion of the perimeter of the panel 102, with the frame supporting a flexible filter material that is substantially opaque and extends across the panel along with a transparent or translucent portion located below the slot 104. Other constructions and compositions are contemplated and will be apparent to one of skill of the art in view of the instant disclosure. In the embodiment shown in FIGS. 1 and 2, face shield 100 is integrally formed. In other embodiments, portions of the face shield 100 (such as upper portion 106 and the remainder of panel 102) are formed separately from side panels 318 before being attached or joined together.

In use, the face shield 100 is entirely supported by the brim 112, such that no additional structure or attachment to the wearer (such as bands or straps about the wearer's head) are needed. This increases comfort for the wearer while using the face shield 100 by avoiding fatigue (such as could be caused by the pressure exerted by straps against the wearer's head or ears when existing cloth masks are used). The position of the face shield 100 may be adjusted by moving the face shield 100 along the brim, such that a user can place the face shield a desired distance from the user's face (limited only by the geometry of the brim 112).

As shown, the panel 102 is generally shaped as a quadrilateral with no parallel edges, including a rounded top edge 105*a*, a rounded bottom edge 105*b* and straight side edges 107*a*, 107*b*. Side edges 107*a*, 107*b* diverge such that the width of the panel 102 is less where its lower edge 105*b* meets side edges 107*a*, 107*b* than where its upper edge 105*a* meets side edges 107*a*, 107*b*. Other shapes are also contemplated for the front panel, including but not limited to circles, polygons, and three-dimensional shapes. In an embodiment, the panel 102 comprises straight vertical side edges 107*a*, 107*b* (such that the width of the panel 102 is substantially equal where lower edge 105*b* meets side edges 107*a*, 107*b* and where upper edge 105*a* meets side edges 107*a*, 107*b*). In an embodiment, the panel 102 comprises straight horizontal top and bottom edges 105*a*, 105*b*. In an embodiment, the panel comprises curved side edges 107*a*, 107*b*. Other variations and combinations of curved and straight edges are also contemplated hereby.

As shown, the face shield 100 may be easily cleaned or sanitized using soap, hand sanitizer, disinfecting chemicals, or radiation (such as ultraviolet light or sonic waves) allowing for the face shield 100 to be reused indefinitely. The face shield 100 provides a physical barrier that prevents a wearer from touching his or her face and protects against contamination (such as viruses or bacteria) from reaching a wearer's face portals (particularly a wearer's nose, mouth, eyes, and/or ears), significantly reducing the contamination that enters the body of the wearer or which leaves the body of a wearer. The face shield also provides physical protection and prevents other articles (such as debris) from reaching the wearer's face. Advantageously, in the embodiment shown wherein the face shield 100 is constructed from a transparent material, a wearer may readily communicate with others, as his or her facial expressions are readily visible through the face shield 100 and voices are not muffled or impeded by the face shield 100.

As shown in FIG. 1, the face shield 100 is substantially planar prior to being affixed to a brim 112. As such, the face shield 100 is easily stacked for storage and shipment. Further, the face shield 100 may be manufactured from a single flat sheet of material by cutting away excess material (which may be subsequently reused or recycled). The slot 104 may be created by fully cutting away a portion of the panel 102 to define the slot. In alternative embodiments, the slot may be partially formed (e.g., by scoring the panel 102 to define the slot 104 without removing the material or by outlining the slot 104 to create cut lines for a user to subsequently use to remove the material in the slot) or formed by another forming process (such as being molded or thermoformed) during manufacture, with the end user ultimately completing the creation of the slot. In an embodiment, a user may select from a plurality of partially formed slots 104 so as to customize the face shield 100 for compatibility with a particular headgear 114 based on the geometry of the hat's brim 112.

As shown in FIG. 3, the face shield 100 is formed from a resilient, flexible material. The face shield 100 may assume a three-dimensional or folded configuration once affixed to the brim 112, for example such that the panel 102 curves about the wearer's face. The three-dimensional configuration can be customized by repositioning the brim 112 in the slot 104. For example, to increase the curvature of the panel 102, the central portion of the slot 104 may be positioned further down the brim 112 (i.e., further away from the wearer's face) while the peripheral portions of the slot 104 may be positioned further up the brim 112 (i.e., closer to the wearer's face). In other embodiments, the face shield 100 is constructed from a rigid or semi-rigid material. In embodiments such as that shown in FIG. 2, the face shield 100 maintains a planar shape both alone and while affixed to a brim 112. In embodiments, the face shield 100 is substantially rigid and the panel 102 is curved (for example, such that the panel 102 forms a U-shape when viewed from above), with the peripheral portions of the panel 102 curving about a wearer's face while in use.

As discussed in greater detail below, in embodiments, one or more fasteners or fastening elements are used to secure the face shield 100 to the brim 112. In embodiments, one or more fasteners are used on the brim 112 in front of the panel 102 and/or behind the panel 102. As used herein, the term "fastener" refers generally to one or more of an adhesive (including but not limited to glue and/or epoxy), tape, ultrasonic welding, thermal welding, hook and loop fasteners, physical fasteners (including but not limited to staples, push pins, split pins, clips, and combinations of bolts and nuts), and fastening elements (such as integrally formed fastening elements). Such fasteners may include clips that attach to and project from the brim or penetrating fasteners that pierce the brim and extend from the brim. In an embodiment, one or more fasteners are inserted through the brim 112 in front of the face shield 100 such that the one or more fasteners extend above and/or below the brim 112, thereby preventing the face shield 100 from being removed from the brim 112 or moving down the brim 112 so long as the fasteners are in place. In an embodiment, the upper portion 106 is folded against the brim 112 and one or more fasteners are inserted through both the upper portion 106 and the brim 112. The upper portion 106 may be folded either down (i.e., such that it extends along the brim away from the wearer) or up (i.e., such that it extends along the brim towards the wearer). In embodiments, one or more holes, slits, or other attachment points are pre-formed on the upper portion 106 to permit a fastener to be inserted therethrough. As used herein, the term "attachment point" refers to a physical structure or marking that enables a fastener to more easily be placed at that location. In an embodiment, the upper portion is secured to the brim 112 using a clip, in an embodiment, adhesive is used to secure the upper portion 106 to the brim 112.

Second Style (Side Panel)

FIGS. 4 through 7 depict embodiments of a second style of face shield 200 in accordance with the present disclosure that are generally similar to the first style of face shield 100 except as otherwise noted herein. As shown, face shield 200 comprises a central panel 202, a slot 204, and an upper portion 206. Central panel 202 and slot 204 are shown as having the same general shape as panel 102 and slot 104, respectively. As discussed above in relation to panel 102 and slot 104, in other embodiments (not shown) central panel 202 and/or slot 204 may take other shapes. Except as otherwise noted, when used herein the term "central panel" is intended to refer to a panel that is located in front of a wearer's face when the face shield is supported by a brim of headgear placed on the wearer's head.

Figure 4:
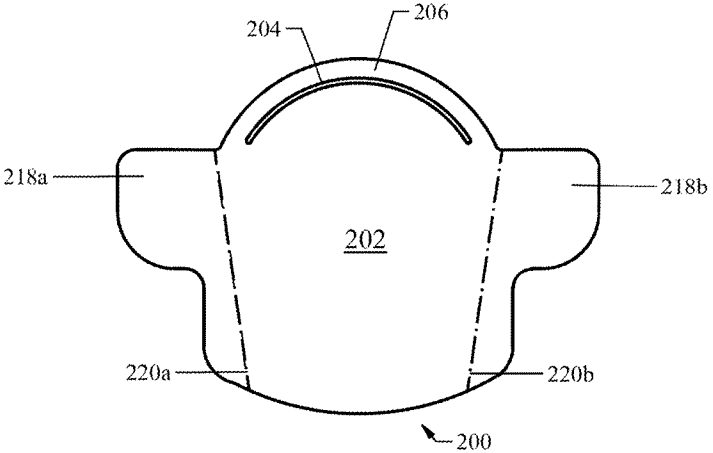
FIG. 4 depicts a front view of an embodiment of a second style of face shield in accordance with the present disclosure in an unfolded configuration.
Figure 5:
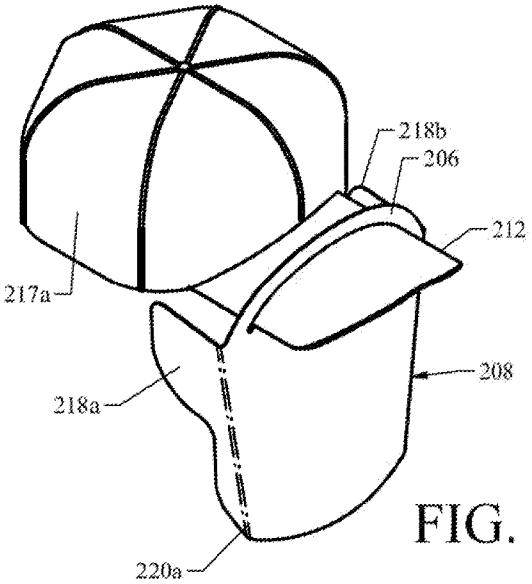
FIG. 5 depicts a perspective view of the embodiment of FIG. 4 in a folded configuration supported by the brim of a hat.

FIGS. 4 and 5 depict a first embodiment of the second style of face shield 200. The face shield 200 comprises side panels 218*a*, 218*b* which are each separated from the central panel 202 by a respective one of fold lines 220*a*, 220*b*. Except as otherwise noted, when used herein the term "fold line" is intended to generally refer to an area that may be bent or folded. A "fold line" may comprise one or more discrete creases or score lines and/or a flexible area. A "fold line" may be integral to a surface (such as when a crease or score line are formed thereon) or may be a separate structure (such as an external hinge or a living hinge that connect two portions to permit them to be bent or folded relative to one another). Except as otherwise noted, when used herein the term "score line" is intended to refer to one or more perforations, indentations, or creases formed in a surface to enable the surface to more easily be bent or folded about the score line. Except as otherwise noted, when used herein the term "side panel" is intended to refer to a panel that is operatively connected to central panel 202 either directly or indirectly.

As shown, fold lines 22*a*, 220*b* each comprise a single fold line. In an embodiment, fold lines 22*a*, 220*b* each comprise a plurality of discrete fold lines separated by one or more substantially areas that, in comparison to the fold lines, are at least relatively rigid.

When viewing the front face 208 (i.e., the environment face) of the face shield 200, a left side panel 218*a* is separated from the left edge 207*a* of the central panel 202 by left fold line 220*a* and a right side panel 218*b* is separated from the right edge 207*b* of the central panel by right fold line 220*b*. Alternative embodiments feature a single side panel (i.e., extending from a single edge of central panel 202), a third side panel that is separated from bottom edge 205*b* by a bottom fold line or top edge 205*a* by a top fold line, or multiple side panels (e.g., such that two or more side panels extend from a single edge of central panel 202). For embodiments featuring a central panel 202 with curved or irregular edges, the fold lines and side panels may be shaped so as to align with the respective edge of the central panel 202 at which they are located. In embodiments, fold lines 220 are located on the side panels 218, allowing the side panels 218 to gradually fold around a wearer's face using one or more angled bends.

In the embodiments shown, side panels 218 are integrally formed with the central panels 202. In other embodiments, side panels 218 are formed separately from central panel 202 before being attached or joined to side panels 218, such as by using a fastener. In embodiments, side panels 218 may be indirectly attached to central panel 202 with other material or structure interposed therebetween. In embodiments, side panels 218 are indirectly joined to central panel 202 by a flexible material that is interposed between the side panels 218 and the central panel 202 to permit the side panels 218 to be angled relative to and/or spaced apart from the central panel 202.

In an embodiment, fold lines 220*a*, 220*b* are formed by scoring the front face 208 or the back face 210 of the face shield, so as to more easily enable the face shield 200 to be bent or folded at the fold lines 220*a*, 220*b*. As shown, fold lines 220*a*, 220*b* thereby comprise a living hinge and are formed from the same material as the portions of the central panel 202 and the side panels 218*a*, 218*b* proximate the fold lines 220. Other techniques may be used to form the fold lines 220*a*, 220*b* as a living hinge, including stamping or molding the face shield such that the thickness of the face shield is less proximate the fold lines 220*a*, 220*b* or forming the entire area from a material of sufficient flexibility to permit folding at the fold lines 220*a*, 220*b*. Alternatively, the area of the fold lines 220*a*, 220*b* may be formed form a different material than the central panel 202 and/or the side panels 218*a*, 218*b* to form a discrete hinged area. Visual indicators may be provided to identify the location of the fold lines 220*a*, 220*b*, including visible markings on the face shield 200 itself or instructions provided with the face shield 200 identifying the location of the fold lines 220*a*, 220*b*. Such visual indicia may be advantageous for embodiments in which the locations of the fold lines 220*a*, 220*b* are not otherwise apparent.

As shown in FIG. 4, in an embodiment the face shield 200 has a first configuration in which it is substantially planar. Such configuration may be advantageous for shipping and manufacturing the face shield 200, as discussed above in relation to the first style of face shield 100. As shown in FIG. 5, the face shield 200 features a second "folded" configuration in which the side panels 218*a*, 218*b* are folded or bent towards the back side 210 (or face side) of the face shield 200, thereby providing lateral protection to a wearer's face. Once folded, the side panels 218*a*, 218*b* may each form a reflex angle with the front face 208 of the central panel 202. The precise angle may be adjusted by bending the side panels 218 towards or away from a wearer's face.

In another embodiment, the face shield 200 is formed in a three-dimensional or "folded" configuration (such as that shown in FIG. 5) such that the wearer does not need to fold the face shield 200 prior to use. In an embodiment, the fold lines 220*a*, 220*b* are substantially rigid. Such an embodiment may be created, for example, by molding or forming the face shield 200 with the side panels 218*a*, 218*b* in the folded configuration.

As shown in FIGS. 4 and 5, side panels 218*a*, 218*b* extend the length of side edges 207*a*, 207*b*. The side panels 218*a*, 218*b* as shown have variable widths and curved profiles, such that the portions of the side panels 218*a*, 218*b* proximate the top edge 205*a* extends further from one another than the portions of the side panels 218*a*, 218*b* proximate the bottom edge 205*b*. Other profiles and widths are also contemplated. In the embodiment shown in FIG. 6, side panels 218*a*, 218*b* extend a uniform distance from the central panel 202. In the embodiment shown in FIG. 7, side panels 218*a*, 218*b* extend from only a portion of the central panel 202.

Figure 6:
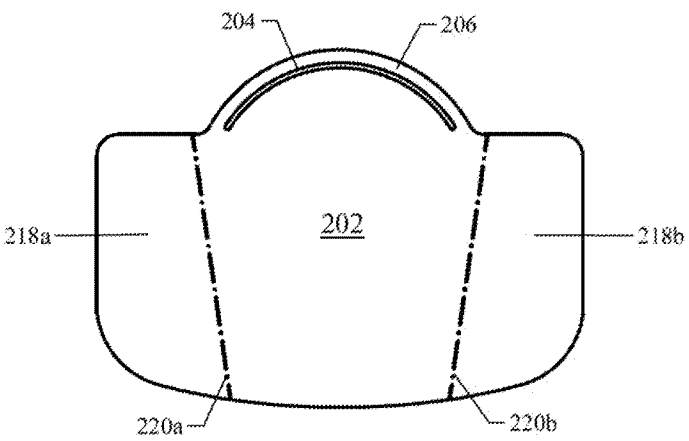
FIG. 6 depicts a front view of a second embodiment of the second style of face shield in a folded configuration supported by the brim of a hat.

As shown in FIG. 6, in an embodiment side panels 218*a*, 218*b* extend the length of side edges 207*a*, 207*b* and have straight edges and a constant width along at least a portion thereof, such that the portion of the side panels 218*a*, 218*b* proximate the top edge 205*a* extends the same distance from one another as the portion of the side panels 218*a*, 218*b* proximate the bottom edge 205*b*.

Figure 7:
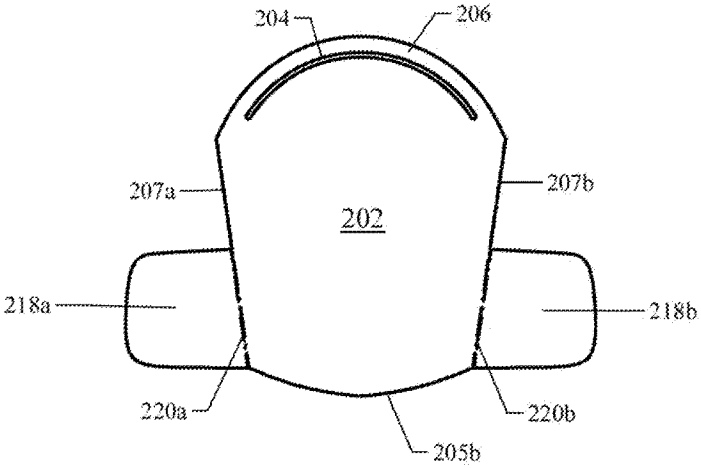
FIG. 7 depicts a front view of a third embodiment of the second style of face shield in an unfolded configuration.

As shown in FIG. 7, in an embodiment side panels 218*a*, 218*b* extend the length of side edges 207*a*, 207*b* extend only from a portion of side edges 207*a*, 207*b* proximate the bottom edge 205*b* of the central panel 202.

Third Style (Support Member)

FIGS. 8 through 54 depict embodiments of a third style of face shield 300 in accordance with the present disclosure that are generally similar to the second style of face shield 200 except as otherwise noted herein. As shown, the face shield 300 comprises a central panel 302, a slot 304, an upper portion 306, and side panels 318*a*, 318*b* separated from central panel 302 by fold lines 320*a*, 320*b*.

Figure 8:
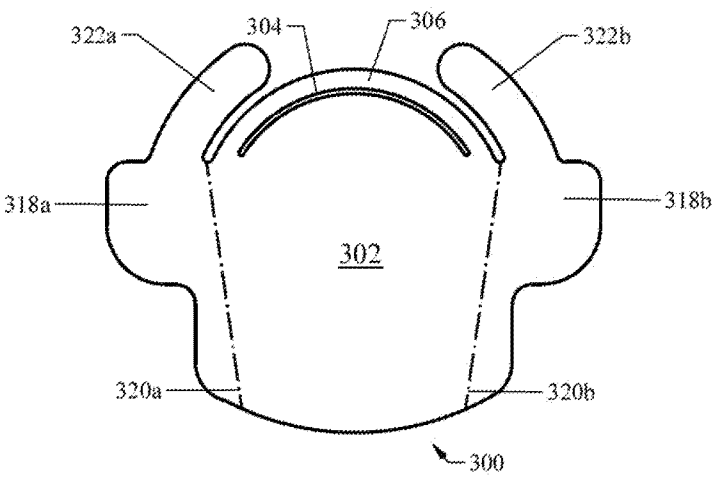
FIG. 8 depicts a front view of an embodiment of a third style of face shield in accordance with the present disclosure in an unfolded configuration.
Figure 10:
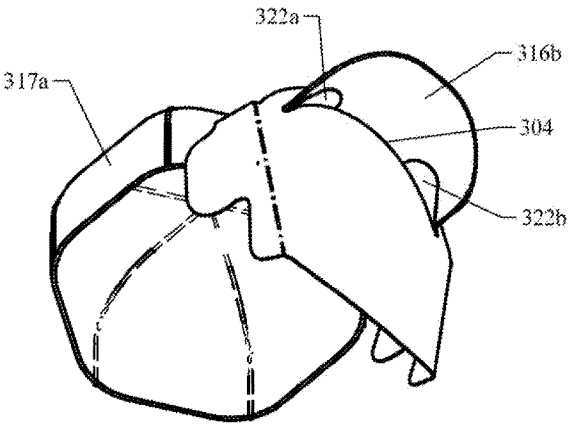
FIG. 10 depicts a lower perspective view of the embodiment of FIG. 8 in a folded configuration supported by the brim of a hat with the support members folded under the brim and inserted through the slot.
Figure 9:
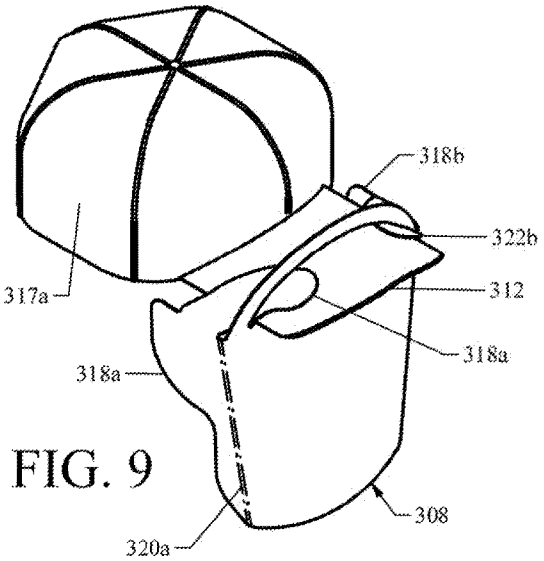
FIG. 9 depicts an upper perspective view of the embodiment of FIG. 8 in a folded configuration supported by the brim of a hat and the support members folded over the brim and inserted through the slot.

Face shield 300 further comprises one or more support members 322. In the embodiment of FIGS. 8 through 10, support member 322*a* is attached to side panel 318*a* and support member 322 is attached to side panel 318*b*. As shown, support members 322*a*, 322*b* are integrally formed with the side panels 318*a*, 318*b*. In alternative embodiments, support members 322 may be formed separately from side panels 318 before being attached or joined to side panels 318.

In the embodiment shown in FIGS. 8 through 10, the support members 322*a*, 322*b* are curved and generally follow the arc of the top edge 305*a* of the central panel 302 when the face shield is in the planar configuration (discussed below). The support members 322*a*, 322*b* are spaced apart from the central panel 302, permitting the support members 322*a*, 322*b* to be moved independently of the central panel 302.

In the embodiment shown in FIGS. 8 through 10, support members 322*a*, 322*b* are formed from a flexible, resilient material such that when the face shield 300 is in the worn configuration, the support members 322*a*, 322*b* may be bent or flexed such that the support members 322*a*, 322*b* proximate the brim 312 of headgear 314.

As shown in FIG. 8, the face shield 300 has a first configuration in which it is substantially planar. Such configuration may be advantageous for shipping and manufacturing the face shield 200, as discussed above in relation to the first and second styles of face shield 100, 200. As shown in FIGS. 9 and 10, the face shield 300 has a second configuration in which the side panels 318*a*, 318*b* are folded or bent towards the back side 310 (or face side) of the face shield 300 and the support members 322*a*, 322*b* are flexed proximate the brim 312 and passed through the slot 304, such that the ends of the support members 322*a*, 322*b* extend through the slot 304 forward of the central panel 302. The side panels 318*a*, 318*b* are thus restrained in a folded or bent configuration and the face shield 300 is secured to the brim 312. As shown in FIG. 9, the support members 322*a*, 322*b* may be flexed over the brim 312 in the folded configuration. Alternatively, as shown in FIG. 10, the support members 322*a*, 322*b* may be flexed under the brim 312 in the folded configuration. Further, one of the support members 322*a*, 322*b* may be flexed over the brim 312 while the other support member 322*a*, 322*b* is flexed under the brim. In addition, the support members 322*a*, 322*b* may be flexed through the slot 304 before the brim 312 is inserted through the slot 304. In this manner, the face shield 300 may be placed in a folded configuration prior to being attached to a hat, allowing the wearer to insert the brim 312 through the slot such that the brim 312 is positioned over both of the support members 322*a*, 322*b*, under both of the support members 322*a*, 322*b*, or over one and under one of the support members 322*a*, 322*b*. As discussed in greater detail below, other configurations and positioning of the support members 322*a*, 322*b* are also contemplated.

In other embodiments, the face shield 300 is formed in a three-dimensional or "folded" configuration (such as that shown in FIGS. 9 and 10) such that the wearer does not need to fold the face shield 300 prior to use. In such embodiment, the face shield 300 may be created by molding or forming the face shield 300 in the three-dimensional configuration.

As discussed below, other configurations of the support members 322*a*, 322*b* are also contemplated. In an alternative embodiment, one or more fold lines (not shown) may be located on the support members 322*a*, 322*b* and/or the side panels 318*a*, 318*b* to enable the support members 322*a*, 322*b* to more readily be bent or folded. Such fold lines may be generally similar in structure to fold lines 320*a*, 320*b* and 220*a*, 220*b* (discussed above).

As discussed in greater detail below, in embodiments, one or more fasteners are used to secure the face shield 300 to the brim 312 and/or the headgear 314. In addition to those configurations discussed above in relation to the first style of face shield 100, embodiments feature one or more fasteners used to secure the support members 322*a*, 322*b* to the brim 312 and/or the headgear 314. Such fasteners may include clips that hold the support members 322*a*, 322*b* against the brim 312 and/or the headgear 314, penetrating fasteners that pierce the support members 322*a*, 322*b* and the brim 312 and/or the headgear 314, and adhesives that hold the support members 322*a*, 322*b* against the brim 312 and/or the headgear 314. Fasteners may be used with any of the configurations of the support members 322 discussed herein.

Figure 12:
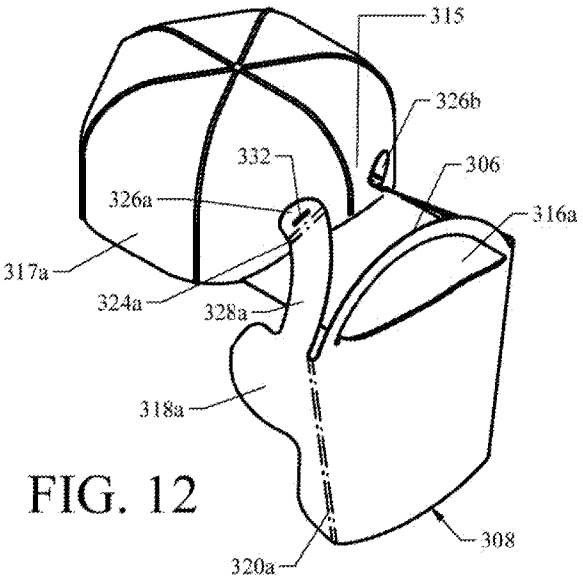
FIG. 12 depicts an upper perspective view of the embodiment of FIG. 11 in a folded configuration supported by the brim of a hat and the support members folded over the brim and against the hat with fasteners through the support members and hat.
Figure 11:
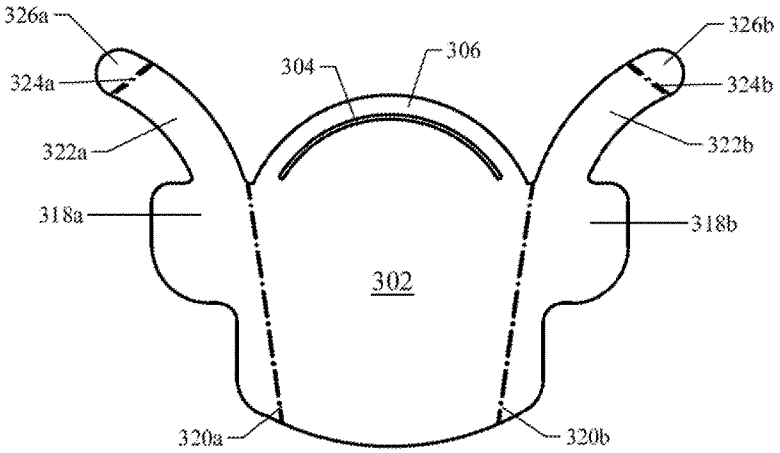
FIG. 11 depicts a front view of a second embodiment of the third style of face shield in accordance with the present disclosure in an unfolded configuration.

FIGS. 11 and 12 depict an embodiment of the third style of face shield 300 comprising support members 322*a*, 322*b* that curve away from central panel 302. As shown, the support members 322*a*, 322*b* are of sufficient length to permit them to be flexed proximate to the brim 312 while overlapping a portion of the headgear 314. Fold lines 324*a*, 324*b* separate the ends 326*a*, 326*b* of the support members 322*a*, 322*b* from the bodies 328*a*, 328*b* of the support members 322*a*, 322*b*. As shown in FIG. 12, the bodies 328*a*, 328*b* may be located proximate the brim 312 while the ends 326*a*, 326*b* are folded up to be proximate the headgear 314.

In embodiments, one or more fasteners are used to secure the support members 322*a*, 322*b* to the brim 312, the headgear 314, or both. As shown in FIG. 12, a staple 332 is inserted through each of the ends 326*a*, 326*b* and the headgear 314, thereby holding the ends 326*a*, 326*b* in place. In another embodiment, additional staples 332 may be inserted through the bodies 328*a*, 328*b* and the brim 312.

Other fasteners may be used in place of or in addition to staples 332, as discussed herein. In an embodiment, one or more fasteners are inserted through the ends of the support members 322*a*, 322*b* and the headgear 314. In embodiments, adhesive is placed between the support members 322*a*, 322*b* and at least a portion of the headgear 314 overlapped by the support members 322*a*, 322*b*. In embodiments, clips are used to secure support members 322*a*, 322*b* to the headgear 314.

Figure 13:
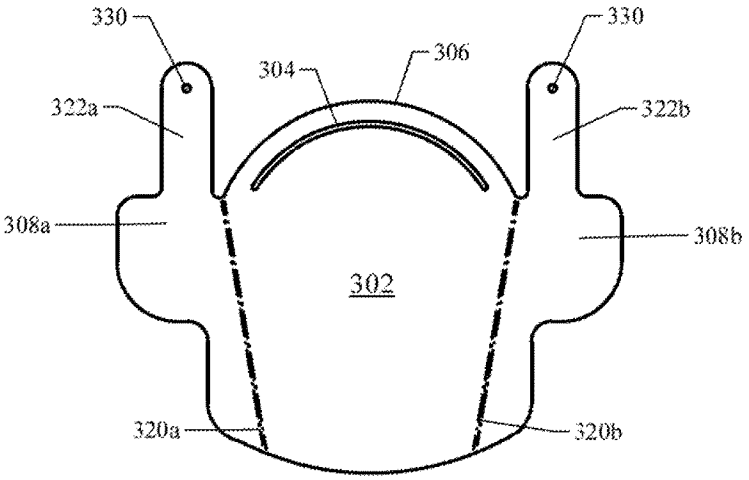
FIG. 13 depicts a front view of a third embodiment of the third style of face shield in accordance with the present disclosure in an unfolded configuration.
Figure 14:
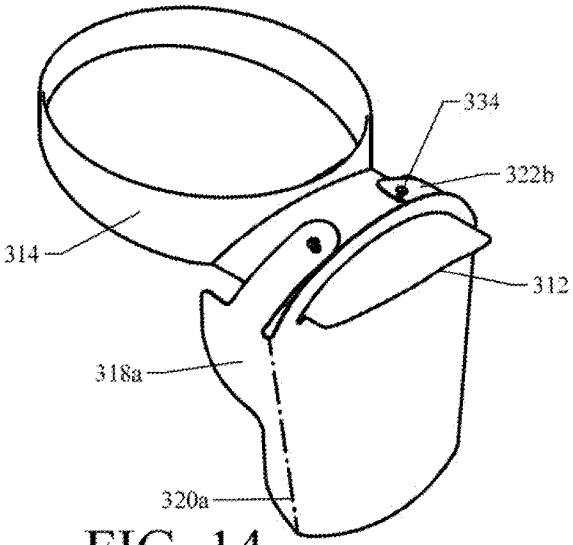
FIG. 14 depicts an upper perspective view of the embodiment of FIG. 13 in a folded configuration supported by the brim of a visor with the support members folded over the brim with fasteners through the brim and support members.
Figure 15:
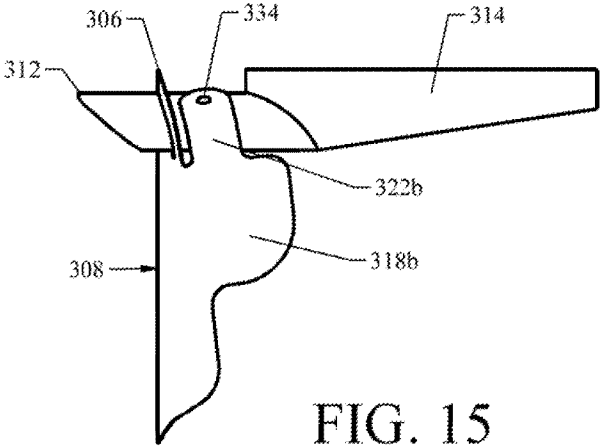
FIG. 15 depicts a side view of the embodiment of FIG. 13 in a folded configuration supported by the brim of a visor with fasteners through the support members and brim.

FIGS. 13 through 15 depict an embodiment of the third style of face shield 300 comprising support members 322*a*, 322*b* that are substantially straight in the planar configuration. As shown in FIGS. 14 and 15, the face shield 300 may be attached to the brim of a visor 314*b* or other headgear 314. Support members 322*a*, 322*b* are secured to the brim using a split pin fastener 334. The leaves 334*b* of the split pin fastener 334 are inserted through the holes 330 in the support members and through the brim 312. Once inserted, the leaves 334*b* are pressed against brim 312 while the head 334*a* of the split pin fastener 334 is pressed against the support members 322*a*, 322*b*. The reverse configuration may also be used, such that the split pin fastener 334 is inserted through the brim 312 first and when fastened, the head 334*a* presses against the brim 312 while the leaves 334*b* press against the support members 322*a*, 322*b*.

Figure 16D:
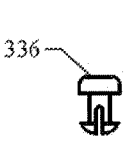
FIG. 16*d* depicts a side view of a push rivet fastener.
Figure 16E:
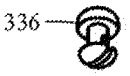
FIG. 16*e* depicts a lower perspective view of the push rivet fastener of FIG. 16*d*.
Figure 16A:
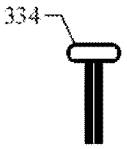
FIG. 16*a* depicts a side view of a split pin fastener with the leaves together.
Figure 16B:
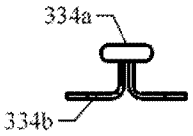
FIG. 16*b* depicts a side view of the split pin fastener of FIG. 16*a* with the leaves apart.
Figure 16C:
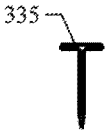
FIG. 16*c* depicts a side view of a pin fastener.

Other fasteners may be used in place of the split pin fastener 334 such as staples 332, push pin fasteners 335, push rivet fasteners 336, clips, tape, and adhesive. Exemplary fasteners are shown in FIGS. 16*a* through 16*e*. As shown in FIGS. 16*a* and 16*b*, a split pin fastener 334 comprises a pair of leaves 334*b* extending from a head 334*a*. The leaves 334*b* may be pressed together to insert the fastener 334 through an opening. Once inserted, the leaves 334*b* may be spread apart such that the leaves 334*b* press against one surface (such as the brim 312) while the head 334*a* presses against another surface (such as a support member 322) to hold the surfaces together. As shown in FIG. 16*c*, a push pin fastener 334 may be inserted through materials to secure them together. As shown FIGS. 16*d* and 16*e*, a push rivet fastener 336 comprises a head 336*a* separated from a tail 336*c* by a narrow body 336*b*. The body 336*b* may be flexible and comprise a slit that continues through the tail 336*c*, such that the sides of the tail 336*c* may be temporarily pressed together to reduce the circumference of the tail 336*c*, allowing it to be inserted through an opening. Once inserted, the tail 336*c* flexes apart, thereby trapping material between the head 336*a* and the tail 336*c*.

Figure 21:
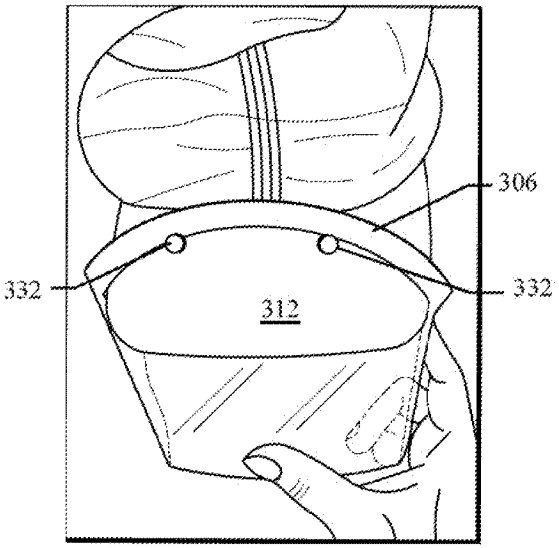
FIG. 21 depicts a method of attaching an embodiment of a face shield to a hat using fasteners through the brim and the support members, with the support members below the brim.
Figure 18:
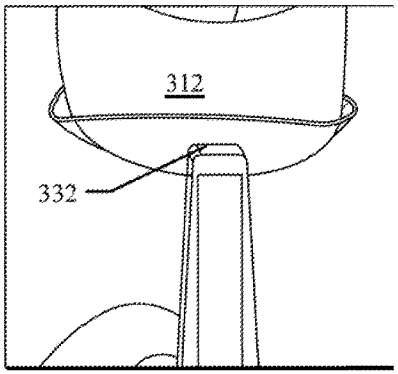
FIG. 18 depicts a method of placing a staple through a brim in front of an embodiment of a face shield to secure the face shield to the brim.
Figure 20:
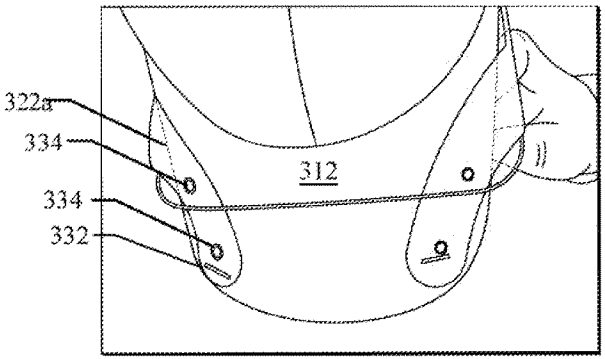
FIG. 20 depicts a method of attaching an embodiment of a face shield to a hat using multiple fasteners of different types through the brim and the support members, with the support members above the brim.
Figure 17:
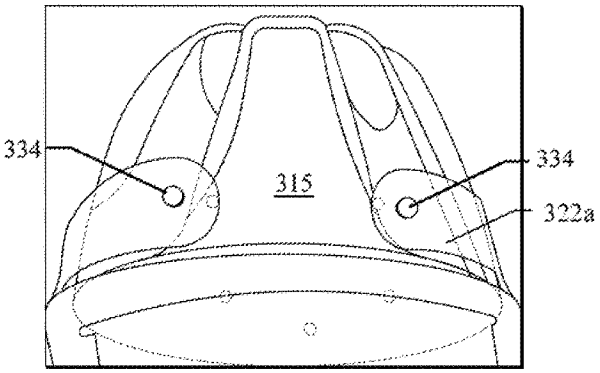
FIG. 17 depicts a front view of an embodiment of a face shield supported by a brim with fasteners through the support members and the front panel of the hat.
Figure 19:
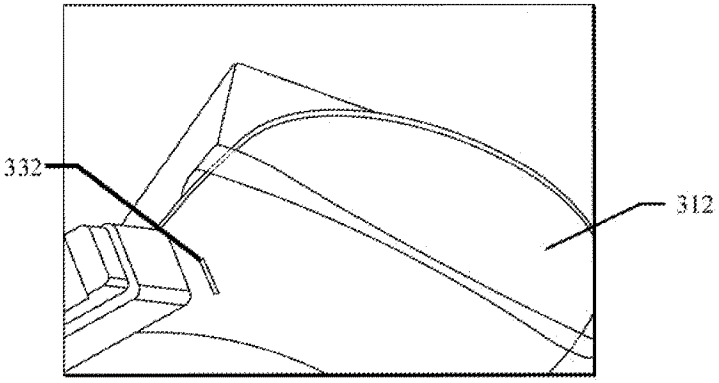
FIG. 19 depicts a method of placing a staple through a brim and support members of an embodiment of a face shield to secure the face shield to the brim, with the support members below the brim.

As shown in FIGS. 17 through 21, fasteners may be used to secure a face shield 300 to a brim 312. FIG. 17 depicts an embodiment of the third style of face shield 300 in which the support members 322*a*, 322*b* are each secured to the front panel 315 of a hat (here, a hard hat) by a fastener 334. FIG. 18 depicts a method for inserting a staple 332 through a brim 312 below a face shield 300 so as to prevent the face shield 300 from being removed from the brim 312. FIG. 19 shows a method for securing a face shield 300 to a brim 312 by inserting a staple 332 through both the brim 312 and one or more of support members 322*a*, 322*b* which are folded below the brim 312. FIG. 20 depicts a method of securing a face shield 300 to a brim 312 by folding support members 322*a*, 322*b* above a brim 312 and through the slot 304 and inserting multiple fasteners 332, 334 through the support members 322*a*, 322*b* and the brim 312. In the embodiment shown, a single staple 332 and two split pin fasteners 334 are inserted through each of support members 322*a*, 322*b*. FIG. 21 depicts a method for securing a face shield 300 to a brim 312 by inserting a plurality of fasteners 334 through the brim 312 in front of the upper portion 306. In an embodiment, the fasteners 334 further extend through the support members 322*a*, 322*b*, which are folded below the brim 312 and inserted through the slot 304 such that they extend in front of the upper portion 306 along the brim 312.

Figure 22:
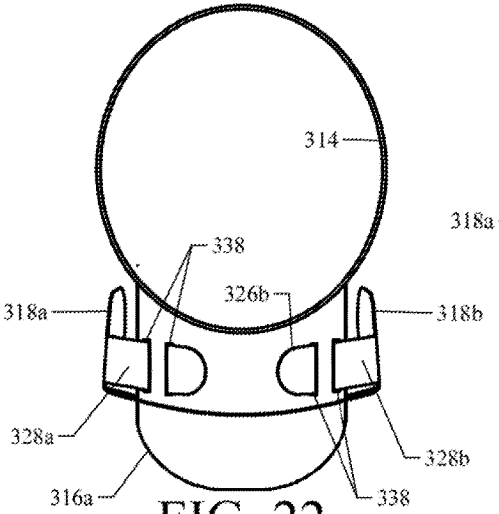
FIG. 22 depicts a top view of a fourth embodiment of the third style of face shield in a folded configuration supported by a brim of a visor with the support members passing through slits in the brim in accordance with the present disclosure.

FIG. 22 depicts an embodiment of the third style of face shield 300 in which the support members 322*a*, 322*b* are inserted through slits 338 in the brim 312. A shown, the support members 322*a*, 322*b* are each inserted from above the brim 312 through a first slit 338 before being inserted from below the brim 312 through a second slit 338. Alternative configurations are also contemplated, such as wherein one or more slits 338 are used and the support members 322*a*, 322*b* are first inserted from below the brim 312 to above the brim 312 before being inserted from above the brim 312 to below the brim, wherein each support member 322*a*, 322*b* passes through a single slit, and wherein each of the support members 322*a*, 322*b* passes through three or more slits 338.

Figure 24:
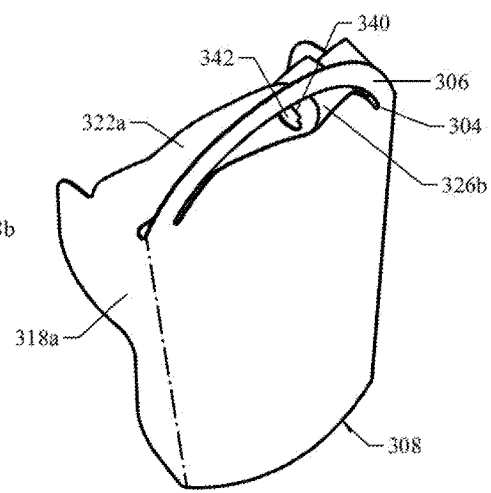
FIG. 24 depicts a perspective view of the embodiment of FIG. 23 in a folded configuration with the support members inserted through the slot and secured together.
Figure 23:
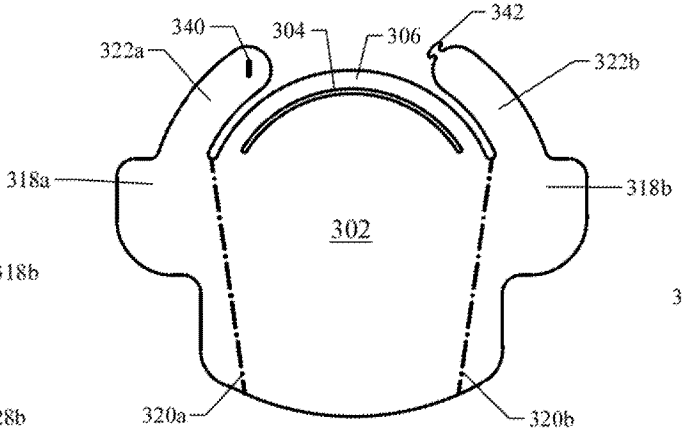
FIG. 23 depicts a front view of a fifth embodiment of the third style of face shield in an unfolded configuration in accordance with the present disclosure with a tab at the end of one support member and a slit formed in another support member.

FIGS. 23 and 24 depict an embodiment of the third style of face shield 300 in which a tab 342 extends from the end 326*b* of support member 322*b*. A corresponding slit 340 is located on the end 326*a* of support member 322*a* and is configured to receive and retain the tab 342. As shown, the slit 340 is sized such that the tab 342 may be inserted through the slit 340 once the tab 342 is properly aligned therewith; once inserted, the tab 342 is retained until and unless it is properly realigned with the slit 340. As shown in FIG. 24, in the folded configuration the ends 326*a*, 326*b* are secured together and may be folded through the slot 304 either over or under a brim (not shown).

Figure 26:
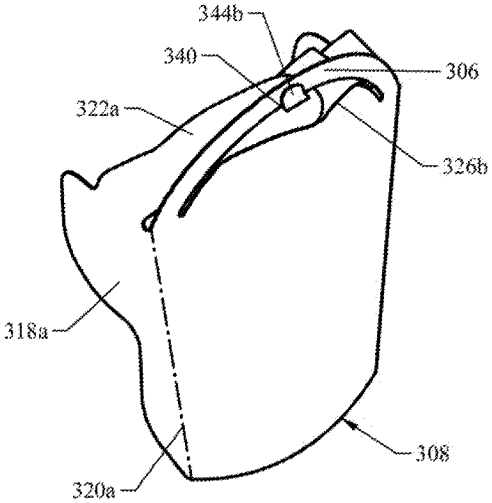
FIG. 26 depicts a perspective view of the embodiment of FIG. 25 in a folded configuration with the support members inserted through the slot and secured to each other and the upper portion.
Figure 25:
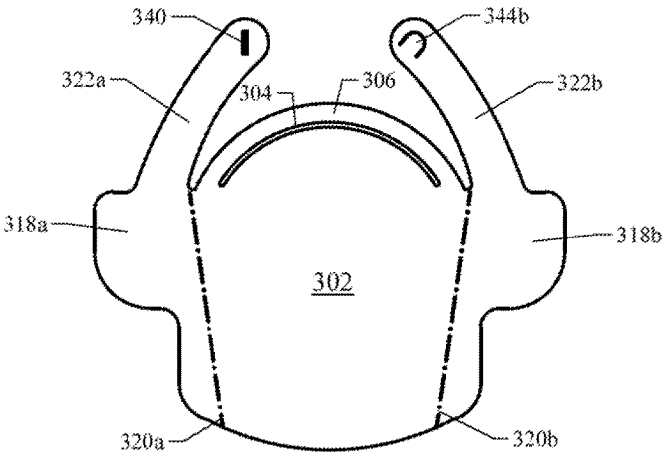
FIG. 25 depicts a front view of a sixth embodiment of the third style of face shield in an unfolded configuration in accordance with the present disclosure with a tab formed in one support member and a slit formed in another support member.

FIGS. 25 through 26 depict an embodiment of the third style of face shield 300 in which a tab 344*b* is formed within the end 326*b* of support member 322*b*. The tab 344*b* may be formed after the support member 322*b* (e.g., by cutting the end 326*b* to form the tab 344*b*) or may be integrally formed with the support member 322*b* (e.g., by molding or thermoforming the support member 322*b* with the tab 344*b* in situ). Corresponding slit 340 is located on the end 326*a* of support member 322*a* and is configured to receive and retain the tab 344*b*. As shown, the slit 340 is sized such that the tab 344*b* may be inserted through the slit 340 and at least partially overlaps end 326*a*. To secure the ends 326*a*, 326*b* together, end 326*b* is folded such that the tab 344*b* is aligned with the slit 340 before the tab 344*b* is inserted into the slit 340. As shown in FIGS. 26 and 27, in the folded configuration the ends 326*a*, 326*b* are secured together and may be folded through the slot 304 either over or under a brim (not shown).

Figure 27A:
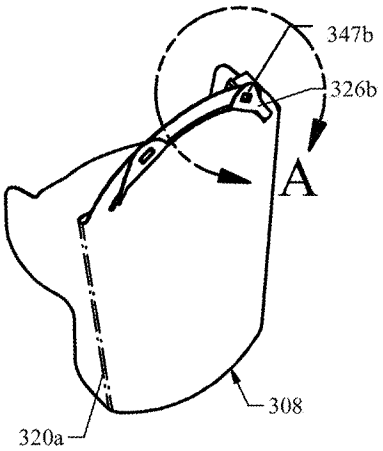
FIG. 27*a* depicts a perspective view of a seventh embodiment of the third style of face shield in a folded configuration in accordance with the present disclosure with male press fit elements formed in the support members and female press fit elements formed in the upper portion.
Figure 27B:
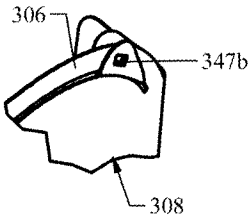
FIG. 27*b* depicts a perspective view of an enlargement of area A of FIG. 27*a* with the male press fit element engaged with the female press fit element.
Figure 27C:
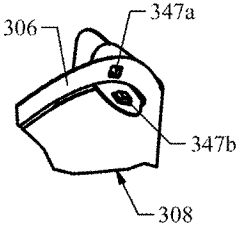
FIG. 27*c* depicts a perspective view of an enlargement of area A of FIG. 27*a* with the male press fit element disengaged from the female press fit element.

FIGS. 27*a* through 27*c* depict an embodiment of the third style of face shield 300 wherein male press fit elements 347*a* are formed on the ends 326*a*, 326*b* of the support members support members 322*a*, 322*b* and corresponding female press fit elements 347*b* are formed in the upper portion 306. In the folded configuration, the ends 326*a*, 326*b* are inserted through the slot 304 and folded about the upper portion 306. The additional thickness in the slot 304 increases the pressure between the central panel 302 and the brim 312 and the upper portion 306 and the brim 312. The press fit elements 347*a*, 347*b* are locked together in an interference fit to retain the support members 322*a*, 322*b* in place.

Figure 28:
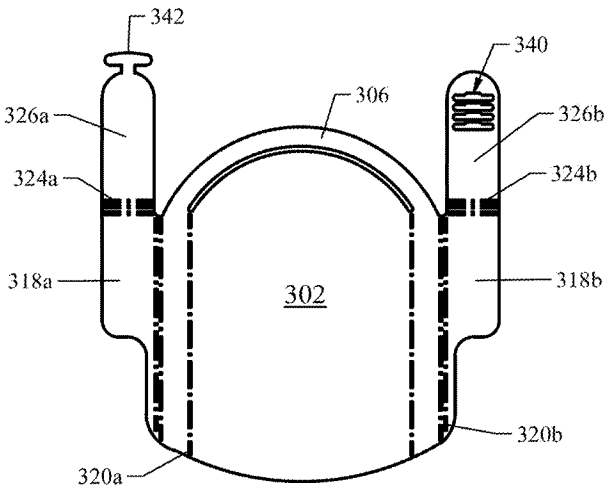
FIG. 28 depicts a front view of an eighth embodiment of the third style of face shield in an unfolded configuration in accordance with the present disclosure with fold lines in the support members and a tab on one support member and a plurality of slots formed in another support member.

FIG. 28 depicts an embodiment of the third style of face shield 300 in which a plurality of fold lines 320*a*, 320*b* separate side panels 318*a*, 318*b* from the central panel and a plurality of fold lines 324*a*, 324*b* are formed on the support members. Support member 322*a* comprises a tab 342 extending from ends 326*a* and support member 322*b* comprises a plurality of slits 340 configured to receive tab 342.

Figure 29:
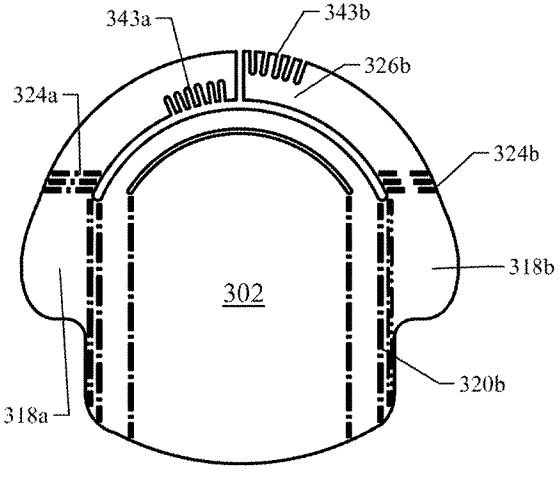
FIG. 29 depicts a front view of a ninth embodiment of the third style of face shield in an unfolded configuration in accordance with the present disclosure with fold lines in the support members, a plurality of notches formed in the lower edge of one support member a corresponding plurality of notches formed in the upper edge of another support member.
Figure 30:
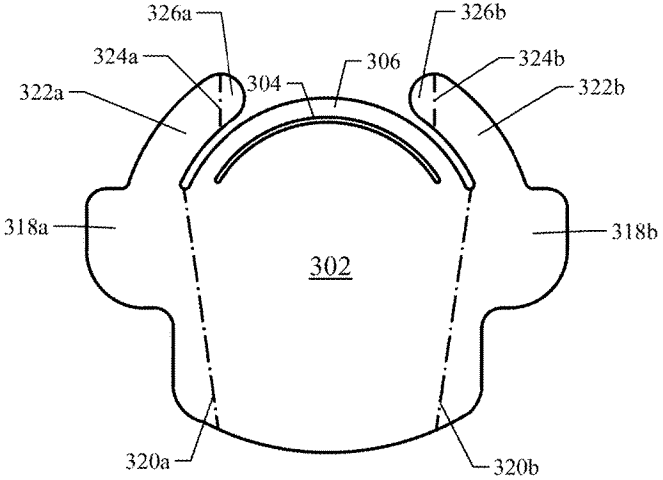
FIG. 30 depicts a front view of a tenth embodiment of the third style of face shield in an unfolded configuration in accordance with the present disclosure with curved support members and fold lines proximate the ends of the support members.

FIG. 29 depicts an embodiment of the third style of face shield 300 in which a plurality of fold lines 320*a*, 320*b* separate the side panels 318*a*, 318*b* from the central panel and a plurality of fold lines 324*a*, 324*b* are formed on the support members. Support member 322*a* comprises a plurality of inward facing notches 343*a* while support member 322*b* comprises a plurality of outward facing notches 343*b*. In a folded configuration (not shown), the ends 326*a*, 326*b* overlap and one or more of the inward facing notches 343*a* are interlocked with outward facing notches 343*b* so as to secure the support members 322*a*, 322*b* together.

Figure 31:
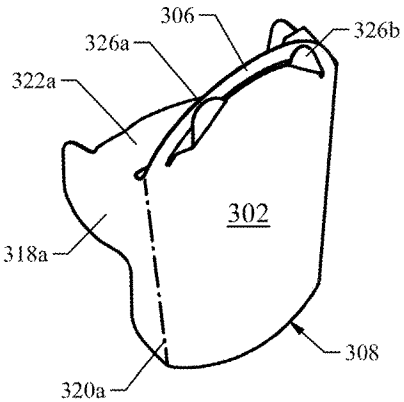
FIG. 31 depicts a perspective view of the embodiment of FIG. 30 in a folded configuration with the support members inserted through the slot and folded against the upper portion.
Figure 33B:
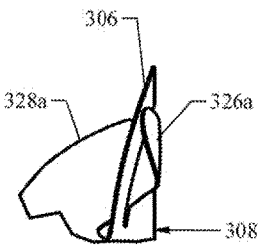
FIG. 33*b* depicts an enlargement of area B of FIG. 33*a*.
Figure 33A:
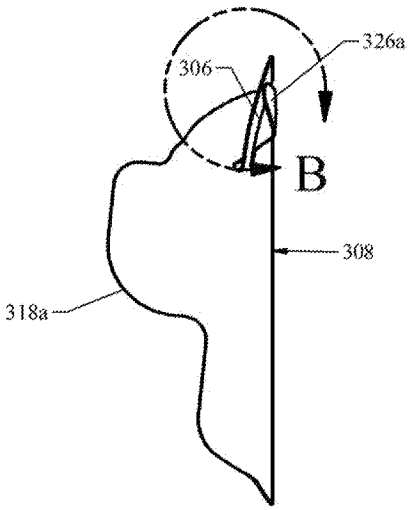
FIG. 33*a* depicts a side view of the configuration depicted in FIG. 31.
Figure 35:
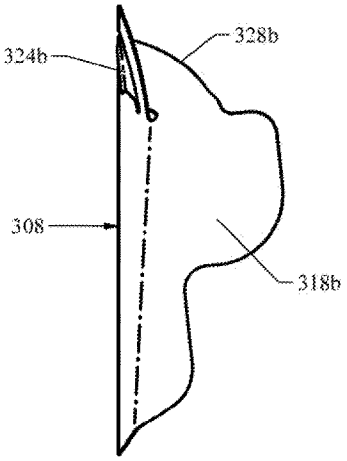
FIG. 35 depicts a side view of the configuration depicted in FIG. 34.
Figure 32:
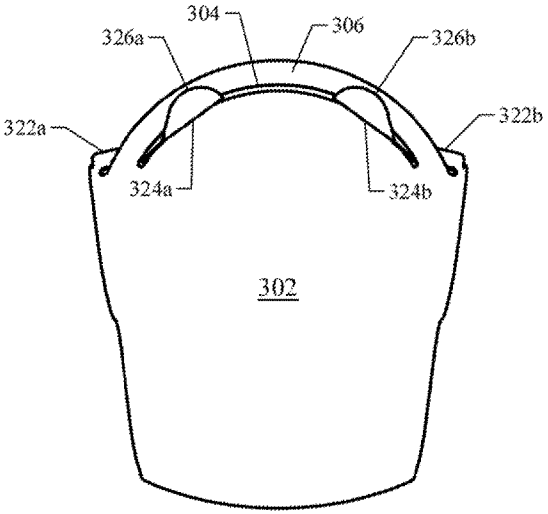
FIG. 32 depicts a front view of the configuration depicted in FIG. 31.
Figure 34:
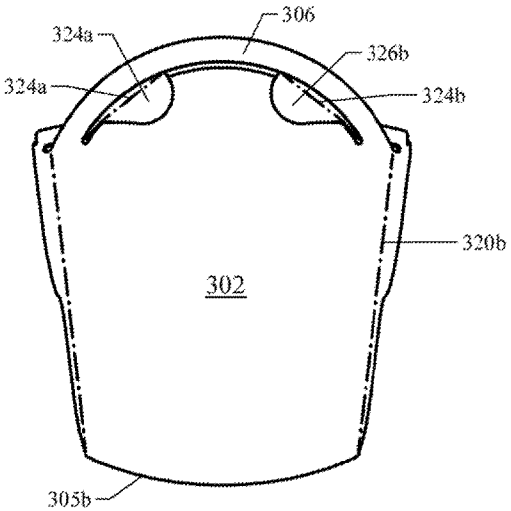
FIG. 34 depicts a front view of the embodiment of FIG. 30 in a folded configuration with the support member inserted through the slot and folded against the central panel below the slot.
Figure 37:
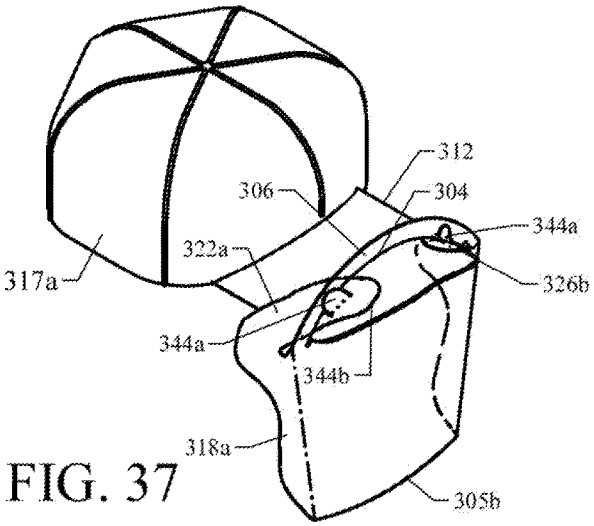
FIG. 37 depicts a perspective view of the embodiment of FIG. 36 in a folded configuration supported by the brim of a hat with the support member inserted through the slot and the tabs folded up against the upper portion.
Figure 39:
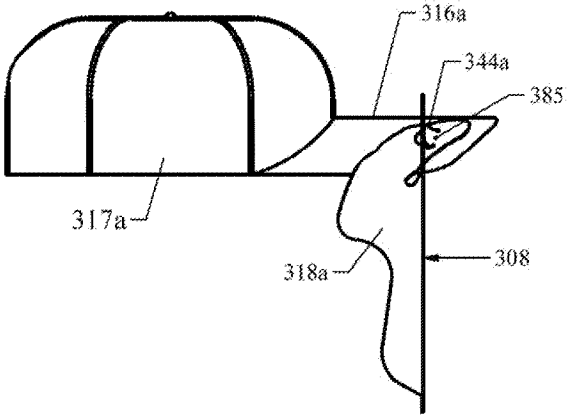
FIG. 39 depicts a side view of the configuration shown in FIG. 37.
Figure 36:
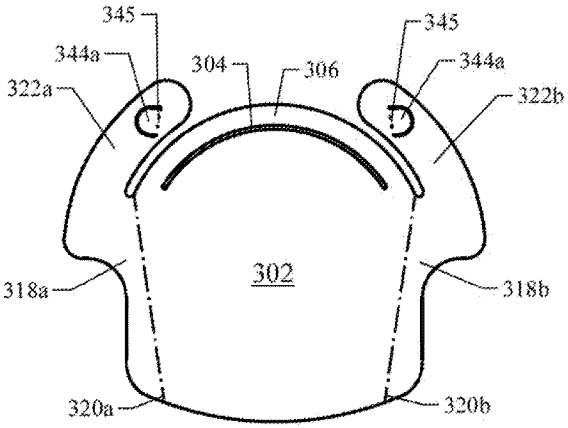
FIG. 36 depicts a front view of an eleventh embodiment of the third style of face shield in an unfolded configuration accordance with the present disclosure with an outward facing tab formed on each of the support members.
Figure 38:
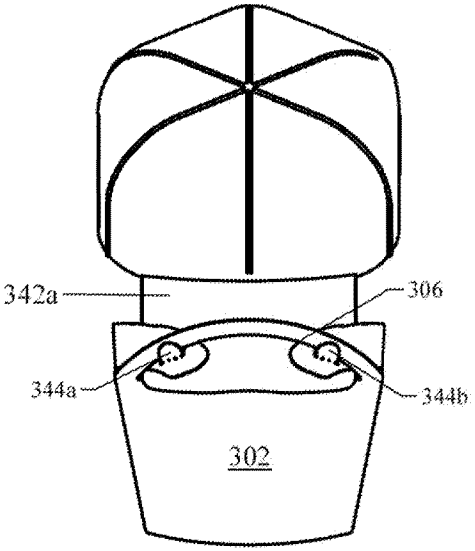
FIG. 38 depicts a front perspective view of the configuration shown in FIG. 37.
Figure 41:
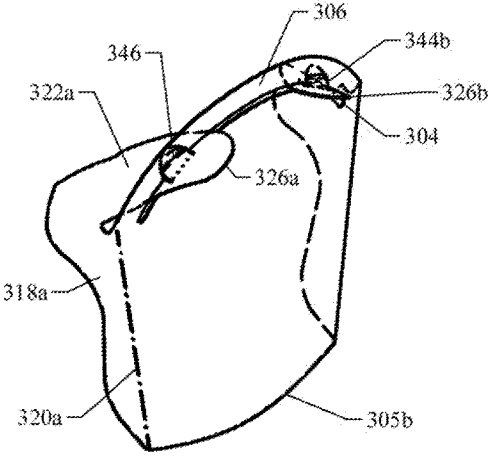
FIG. 41 depicts a perspective view of the embodiment of FIG. 40 in a folded configuration with the support members inserted through the slot and the tabs folded upwards and inserted through the slits.
Figure 43:
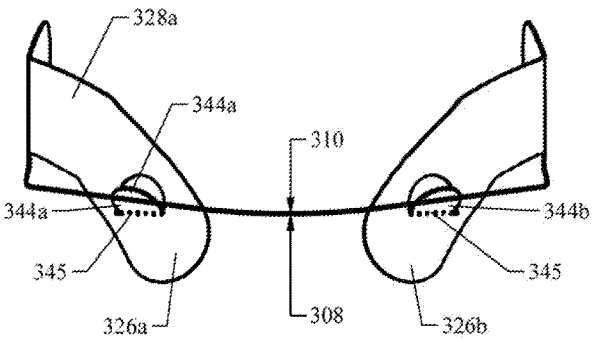
FIG. 43 depicts a top view of the configuration shown in FIG. 41.
Figure 40:
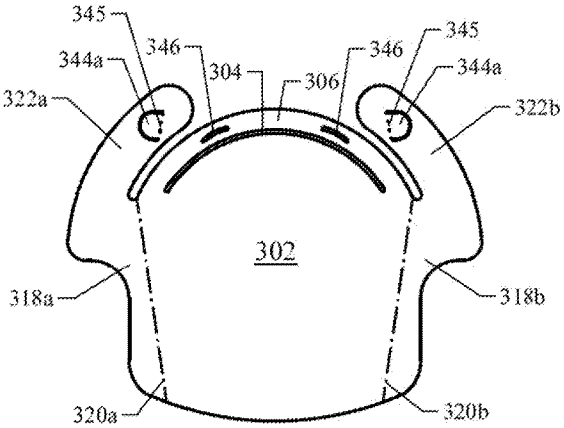
FIG. 40 depicts a front view of a twelfth embodiment of the third style of face shield in an unfolded configuration in accordance with the present disclosure with an outward facing tab formed on each of the support members and corresponding slits formed in the upper portion.
Figure 42:
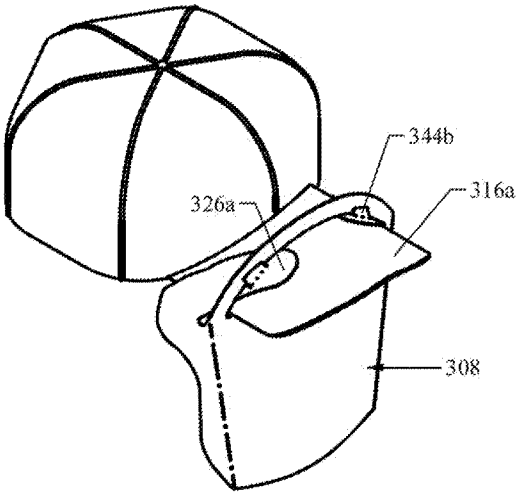
FIG. 42 depicts a perspective view of the configuration of FIG. 41 supported by the brim of a hat, with the brim inserted through the slot below the support members.

FIGS. 30 through 35 depict an embodiment of the third style of face shield 300 in which fold lines 324*a*, 324*b* proximate the ends, 326*a* 326*b* of support members 322*a*, 322*b*. Once the ends 326*a* 326*b* are inserted through the slot 304, the ends, 326*a* 326*b* are either bent upwards such that the ends 326*a* 326*b* contact the upper portion 306 (as shown in FIGS. 31 through 33) or downward such that the ends 326*a* 326*b* contact the central panel 302 (as shown in FIGS. 34 and 35). In the embodiments shown, the fold lines 324*a*, 324*b* are not resilient such that once folded, the ends 326*a* 326*b* will remain in place. In other embodiments, the fold lines 324*a*, 324*b* are resilient and are secured to the upper portion 306 and/or central panel 302 using one or more fasteners. In an embodiment, one of the ends 326*a* 326*b* is folded upwards and another of the ends 326*a*, 326*b* is folded downwards. The ends 326*a* 326*b* may be inserted through the slot 304 either above or below a brim (not shown).

FIGS. 36 through 39 depict an embodiment of the third style of face shield 300 in which a left-facing tab 344*a* is formed within the end 326*b* of support member 322*b* and a right-facing tab 344*b* is formed within the end 326*a* of support member 322*a*. As discussed above, the tabs 344*a*, 344*b* may be formed after the support members 312*a*, 312*b* (e.g., by cutting the ends 326*a*, 326*b* to form the tabs 344*a*, 344*b*) or may be integrally formed with the support members 312*a*, 312*b* (e.g., by molding or thermoforming the support members 312*a*, 312*b* with the tabs 344*a*, 344*b* in situ), or by a combination thereof. The brim 312 is inserted through the slot 304 such that the brim 312 is below the support members 322*a*, 322*b*. The brim 312 may be inserted through the slot 304 either before or after the ends 326*a*, 326*b*. The tabs 344*a*, 344*b* are folded up such that they contact upper portion 306 and are retained thereby. In embodiments, tabs 334*a*, 334*b* are formed of a flexible material. In an embodiment, tabs 334*a*, 334*b* are joined to the remainder of the support members 322*a*, 322*b* by fold lines 345 which permit the tabs 334*a*, 334*b* to fold.

FIGS. 40 through 43 depict an embodiment of the third style of face shield 300 in which a left-facing tab 344*a* is formed within the end 326*a* of support member 322*a* and a right-facing tab 344*b* is formed within the end 326*b* of support member 322*b*. As discussed above, the tabs 344*a*, 344*b* may be formed after the support members 312*a*, 312*b* (e.g., by cutting the ends 326*a*, 326*b* to form the tabs 344*a*, 344*b*) or may be integrally formed with the support members 312*a*, 312*b* (e.g., by molding or thermoforming the support members 312*a*, 312*b* with the tabs 344*a*, 344*b* in situ), or by a combination thereof. Slits 346 are located on the upper portion 306 and are configured to receive and retain the tabs 344*a*, 344*b*. As shown, the slits 340 are sized such that the tabs 344*a*, 344*b* may be inserted through the slits 340 once the ends 326*a*, 326*b* are inserted through the slot 304. The brim 312 is inserted through the slot 304 such that the brim 312 is below the support members 322*a*, 322*b*. The brim 312 may be inserted through the slot 304 either before or after the ends 326*a*, 326*b*.

Figure 45:
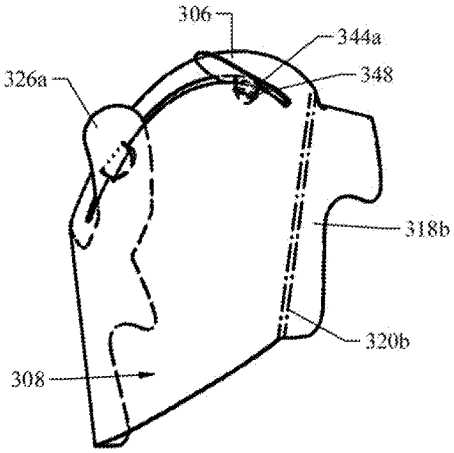
FIG. 45 depicts a perspective view of the embodiment of FIG. 44 in a folded configuration with the support members inserted through the slot and the tabs folded downward and inserted through the slits.
Figure 47:
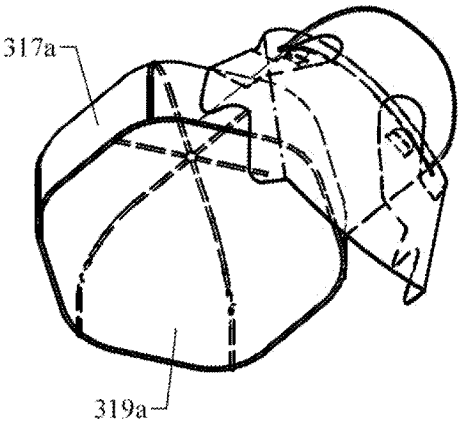
FIG. 47 depicts a lower perspective view of the embodiment of FIG. 46 in a folded configuration supported by the brim of the hat with the support members inserted through the slot below the brim and the tabs folded down against the wearer side of the central panel.
Figure 44:
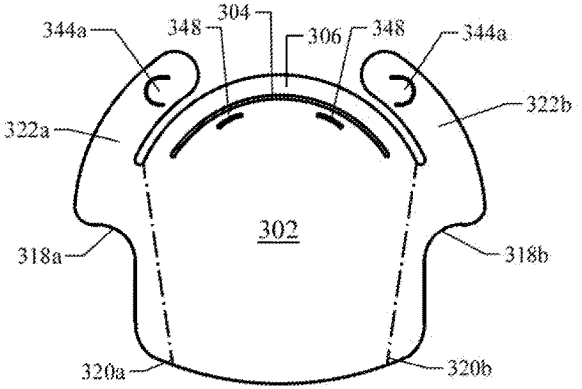
FIG. 44 depicts a front view of a thirteenth embodiment of the third style of face shield in an unfolded configuration in accordance with the present disclosure with an outward facing tab formed on each of the support members and corresponding slits formed in the central panel below the slot.
Figure 46:
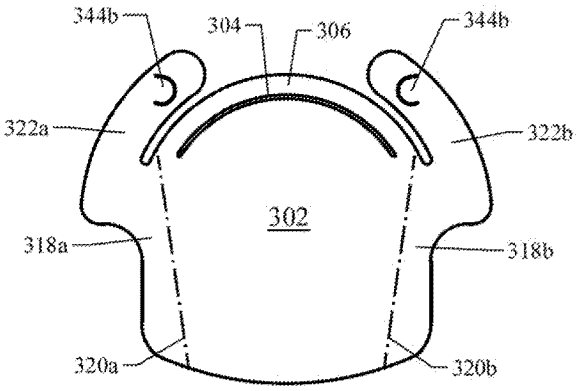
FIG. 46 depicts a front view of a fourteenth embodiment of the third style of face shield in an unfolded configuration accordance with the present disclosure with an inward facing tab formed on each of the support members.
Figure 49:
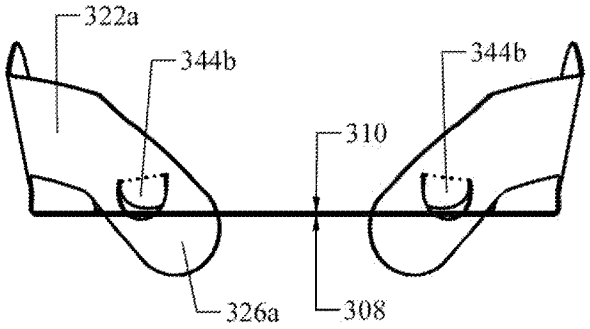
FIG. 49 depicts a top view of the embodiment of FIG. 46 in a folded configuration with the support members inserted through the slot and the tabs folded up against the wearer side of the upper portion.
Figure 51:
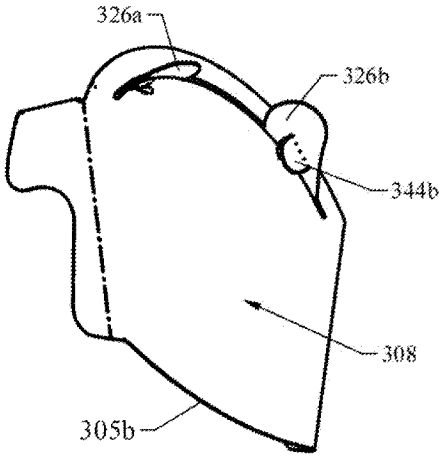
FIG. 51 depicts a front lower perspective view of the embodiment of FIG. 50 in a folded configuration with the support members inserted through the slot, the tab on one supporting member folded against the environment side of the central panel, and the other tab folded against the wearer side of the central panel.
Figure 48:
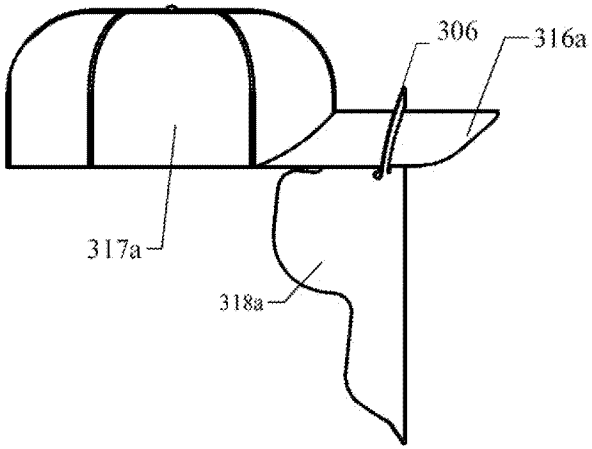
FIG. 48 depicts a side view of the configuration shown in FIG. 47.
Figure 50:
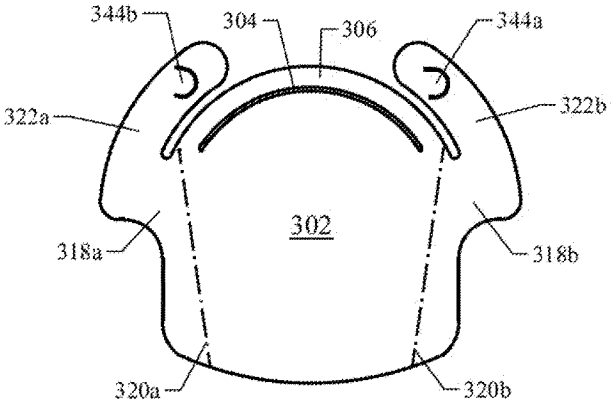
FIG. 50 depicts a front view of a fifteenth embodiment of the third style of face shield in an unfolded configuration accordance with the present disclosure with a right facing tab formed on each of the support members.
Figure 53:
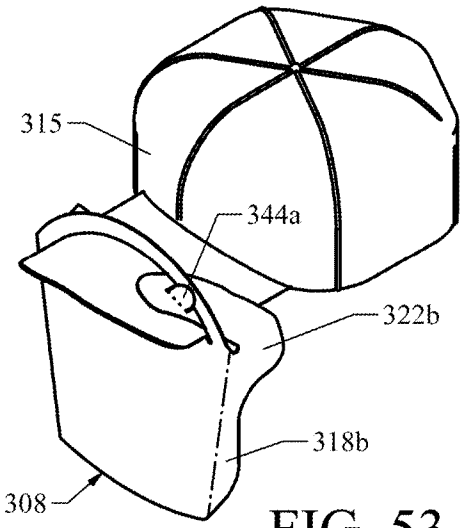
FIG. 53 depicts a perspective view of the embodiment of FIG. 51 in a folded configuration supported by the brim of a hat with the support members inserted through the slot, one support member folded over the brim and the associated tab folded against the environment side of the upper portion, and the other support member folded below the brim with the associated tab folded against the wearer side of the lower panel.
Figure 55:
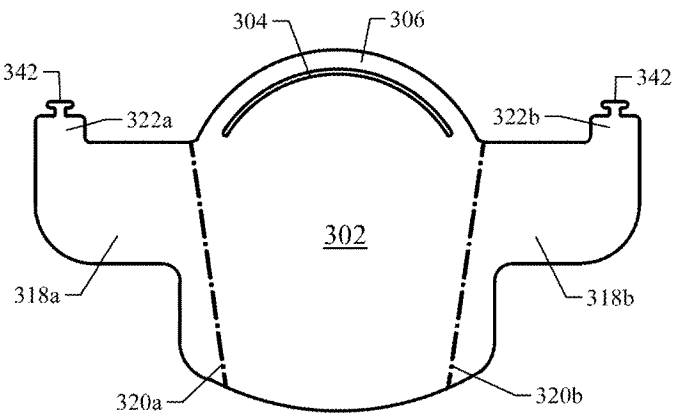
FIG. 55 depicts a front view of an embodiment of a fourth style of face shield in an unfolded configuration in accordance with the present disclosure with tabs configured to engage with headgear located on the ends of the support members.
Figure 52:
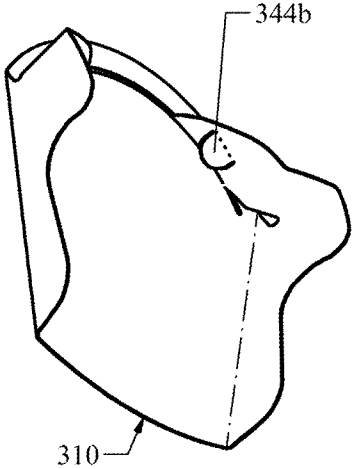
FIG. 52 depicts a rear lower perspective view of the configuration shown in FIG. 51.

FIGS. 44 and 45 depict an embodiment of the third style of face shield 300 in which a left-facing tab 344*a* is formed within the end 326*b* of support member 322*b* and a right-facing tab 344*b* is formed within the end 326*a* of support member 322*a*. As discussed above, the tabs 344*a*, 344*b* may be formed after the support members 312*a*, 312*b* (e.g., by cutting the ends 326*a*, 326*b* to form the tabs 344*a*, 344*b*) or may be integrally formed with the support members 312*a*, 312*b* (e.g., by molding or thermoforming the support members 312*a*, 312*b* with the tabs 344*a*, 344*b* in situ), or by a combination thereof. Slits 346 are located on the central panel 302 below the slot 304 and are configured to receive and retain the tabs 344*a*, 344*b*. As shown, the slits 340 are sized such that the tabs 344*a*, 344*b* may be inserted through the slits 340 as the ends 326*a*, 326*b* are inserted through the slot 304. The brim 312 is inserted through the slot 304 such that the brim 312 is above the support members 322*a*, 322*b*. The brim 312 may be inserted through the slot 304 either before or after the ends 326*a*, 326*b*.

FIGS. 46 through 49 depict an embodiment of the third style of face shield 300 in which a left-facing tab 344*a* is formed within the end 326*b* of support member 322*b* and a right-facing tab 344*b* is formed within the end 326*a* of support member 322*a*. As discussed above, the tabs 344*a*, 344*b* may be formed after the support members 312*a*, 312*b* (e.g., by cutting the ends 326*a*, 326*b* to form the tabs 344*a*, 344*b*) or may be integrally formed with the support members 312*a*, 312*b* (e.g., by molding or thermoforming the support members 312*a*, 312*b* with the tabs 344*a*, 344*b* in situ), or by a combination thereof. The brim 312 is inserted through the slot 304 such that the brim 312 is above the support members 322*a*, 322*b*. The brim 312 may be inserted through the slot 304 either before or after the ends 326*a*, 326*b*. The tabs 344*a*, 344*b* are folded down such that they contact central panel 302 below the slot 304 and are retained thereby.

FIGS. 50 through 53 depict an embodiment of the third style of face shield 300 in which right-facing tabs 344*b* are formed within the ends 326*a*, 326*b* of support members 312*a*, 312*b*. As discussed above, the tabs 344*b* may be formed after the support members 312*a*, 312*b* (e.g., by cutting the ends 326*a*, 326*b* to form the tabs 344*b*) or may be integrally formed with the support members 312*a*, 312*b* (e.g., by molding or thermoforming the support members 312*a*, 312*b* with the tabs 344*b* in sit), or by a combination thereof. In the folded configuration, the tab 344*b* on support member 322*b* is bent downward such that it contacts the central panel 302 below the slot 304 on the environment side 308 and the tab 344*b* on support member 322*a* is bent downward such that it contacts the central panel 302 below the slot 304 on the wearer side 310.

Figure 54:
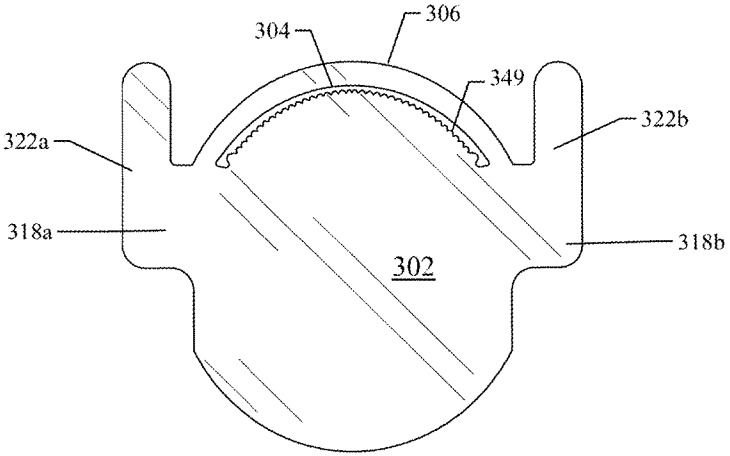
FIG. 54 depicts a front view of a sixteenth embodiment of the third style of face shield in an unfolded configuration accordance with the present disclosure with a plurality of teeth extending into the slot from the central panel.
Figure 59B:
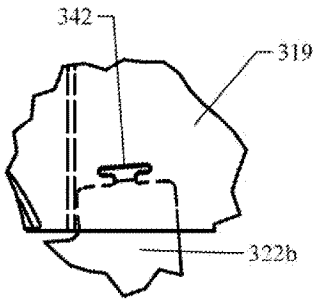
FIG. 59*b* depicts an enlarged view of area D of FIG. 59*a*.
Figure 59A:
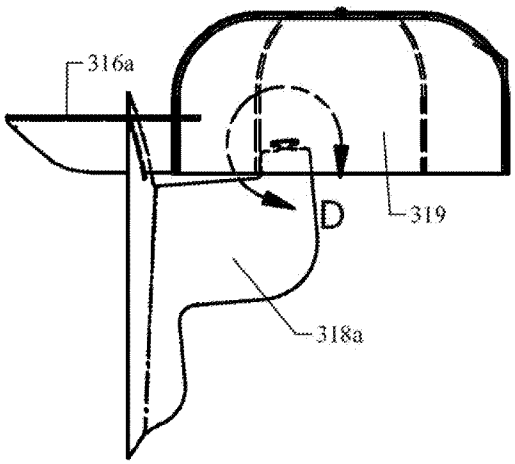
FIG. 59*a* depicts a cross-sectional view taken along line C-C of FIG. 57.
Figure 56:
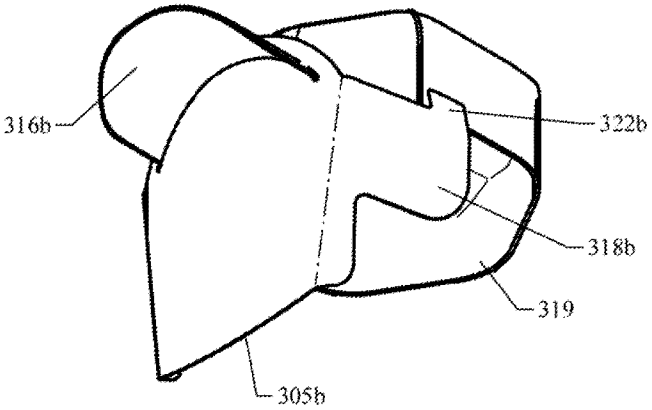
FIG. 56 depicts a lower perspective view of the embodiment of FIG. 55 supported by the brim of a hat with the tabs inserted through slits in the side panels of the hat.
Figure 58:
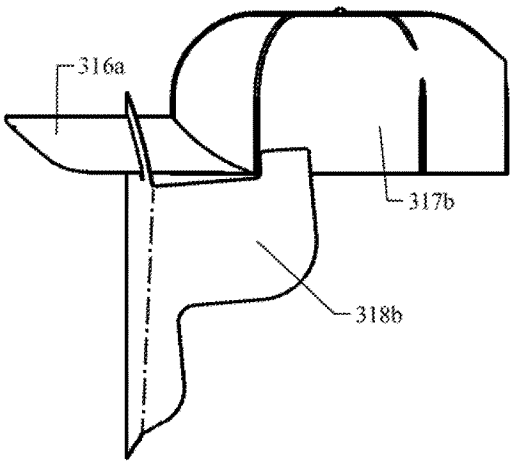
FIG. 58 depicts a side view of the configuration shown in FIG. 56.
Figure 57:
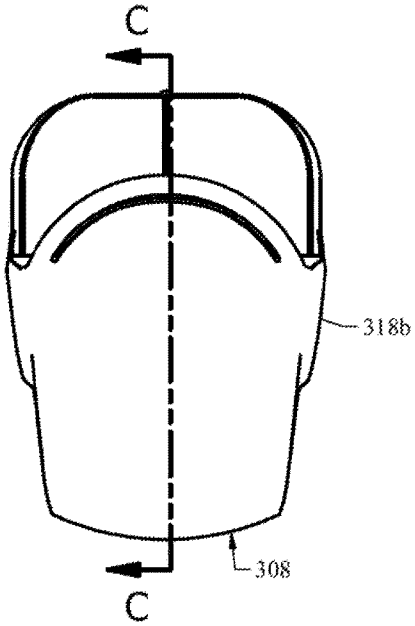
FIG. 57 depicts a front view of the configuration shown in FIG. 56.

FIG. 54 depicts an embodiment of the third style of face shield 300 in which a plurality of teeth 349 protrude from the central panel 302 into the slot 304. In embodiments, teeth 349 protrude from upper portion 306 into slot 304. In embodiments, teeth 349 protrude from both upper portion 306 and central panel 302 into slot 304. In embodiments, teeth 349 protrude from only part of upper portion 306 and/or central panel 302. In embodiments, a single tooth 349 protrudes into slot 304. Teeth 349 serve to increase the friction between the brim 312 and the slot 304, thereby restricting the movement of the brim 312 through the slot 304 to prevent the face shield 300 from being inadvertently removed from the brim 312. For the avoidance of doubt, it is contemplated that teeth may be incorporated into any of the various embodiments of the various styles of face shield discussed herein to increase friction between a slot and a brim.

Fourth Style (Connected to Headgear)

FIGS. 55 through 70 depict embodiments of a fourth style of face shield 400 in accordance with the present disclosure that are generally similar to the third style of face shield 300 except as otherwise noted herein. As shown, the face shield 400 comprises a central panel 402, a slot 404, an upper portion 406, side panels 418*a*, 418*b*, and support members 422*a*, 422*b*.

Support members 422*a*, 422*b* are configured such that they may be secured to side panels 417*a*, 417*b* of headgear 414.

FIGS. 55 through 59 depict an embodiment whereby the ends 426*a*, 426*b* of support members 422*a*, 422*b* comprise tabs 442. Slits 450 are formed in the side panels 417*a*, 417*b* of headgear 414 into which tabs 442 are inserted to secure the ends 426*a*, 426*b* to the headgear 414 in the folded configuration. As shown, the slits 450 are sized such that the tabs 442 may be inserted through the slits 450 once the tabs 442 are properly aligned therewith; once inserted, the tabs 442 are retained until and unless they are properly realigned with the slits 440. In embodiments, one or more fasteners are also used with the support members 422*a*, 422*b* and side panels 417*a*, 417*b* to further secure the support members 422*a*, 422*b* to the headgear 414.

Figure 61:
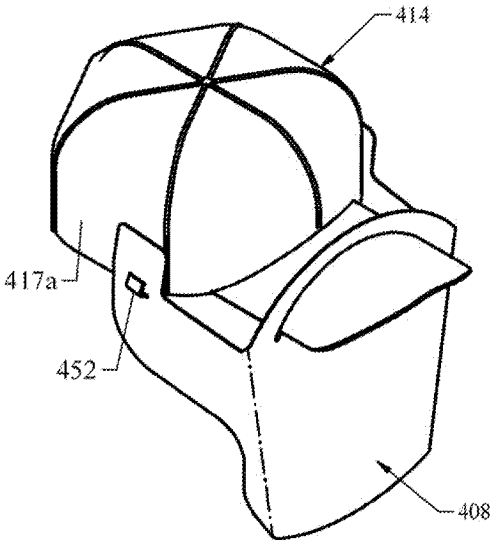
FIG. 61 depicts a perspective view of the embodiment of FIG. 60 supported by the brim of a hat with the support members secured to the lower edge of the hat by clip fastener that pass through the slits.
Figure 62B:
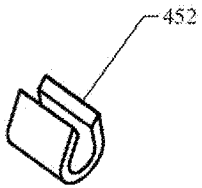
FIG. 62*b* depicts a clip fastener.
Figure 60:
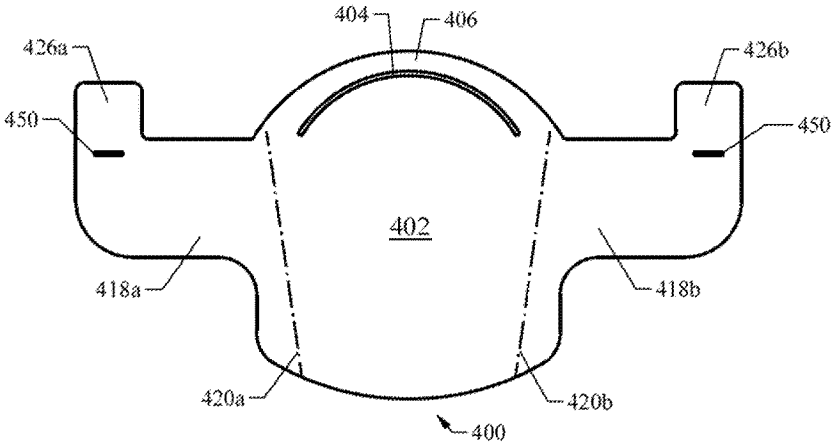
FIG. 60 depicts a front view of a second embodiment of the fourth style of face shield in an unfolded configuration accordance with the present disclosure with a slit formed on each side panel.
Figure 62A:
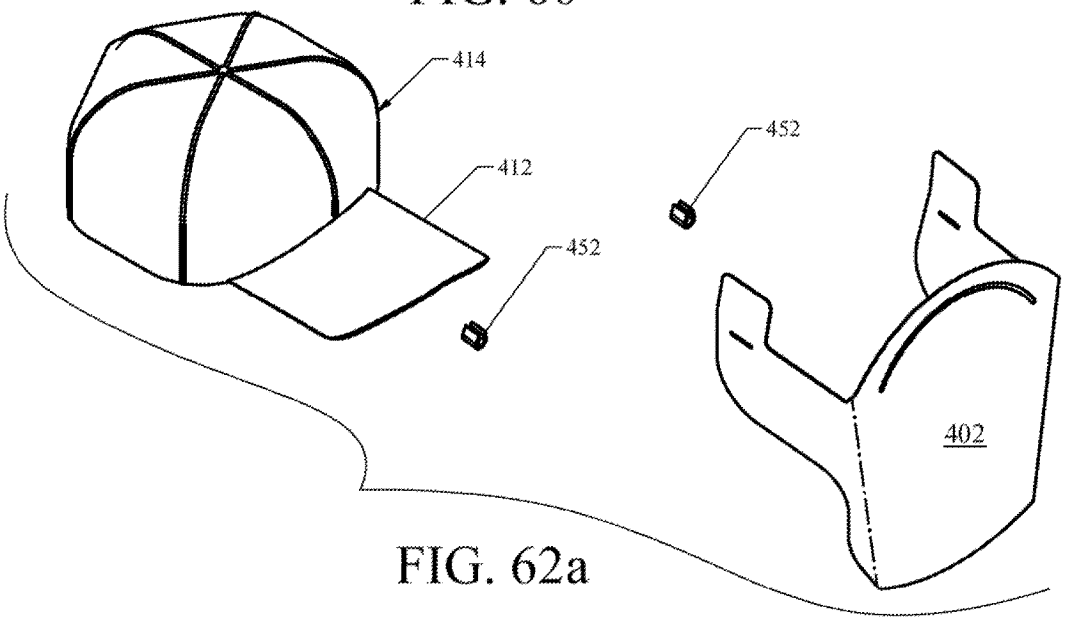
FIG. 62*a* depicts an exploded view of the configuration of FIG. 61.

FIGS. 60 through 62 depict an embodiment whereby the support members 422*a*, 422*b* comprise slits 440. In the folded configuration, slits 440 abut the lower edge of the side panels 417*a*, 417*b*. One or more clips 452 are inserted through the slits 440 and secure the support members 422*a*, 422*b* to the headgear 414.

FIGS. 63 through 65 depict an embodiment whereby the support members 422*a*, 422*b* are held against the side panels 417*a*, 417*b* by one or more fasteners.

As shown in FIGS. 63 and 64, in an embodiment an adhesive such as double-sided tape 454 is placed between the support members 422*a*, 422*b* and the headgear 414. The support members 422*a*, 422*b* may be pressed against either the exterior or the interior of the headgear 414. In other embodiments, adhesives such as glue or single sided tape are be used. In embodiments, additional fasteners are used to hold support members 422*a*, 422*b* against headgear 414.

As shown in FIGS. 65*a* through 65*c*, in an embodiment one or more staples 430 are inserted through headgear 414 and support members 422*a*, 422*b*. The crown 432*a* of each staple 432 presses against one of support members 422*a*, 422*b* and headgear 414, while the prongs 432*b* press against the other of support members 422*a*, 422*b* and headgear 414.

Figure 67:
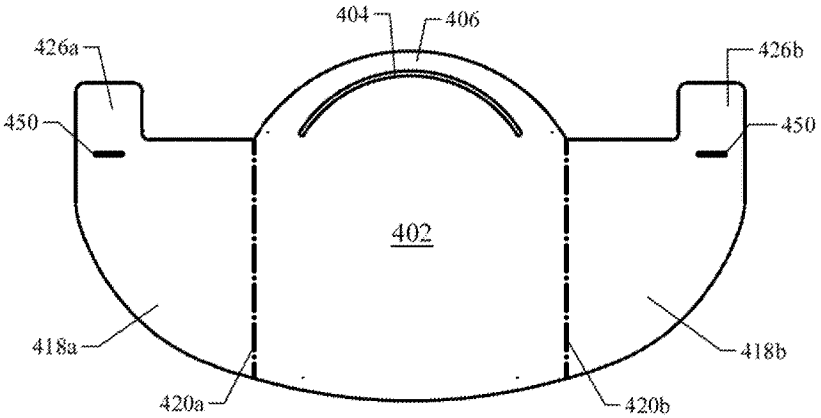
FIG. 67 depicts a front view of a third embodiment of the fourth style of face shield in an unfolded configuration in accordance with the present disclosure with side panels that extend the length of the central panel and slits formed in the side panels.
Figure 66C:
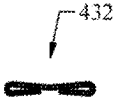
FIG. 66*c* depicts the staple of FIG. 66*b* with its prongs bent against its crown.
Figure 66B:
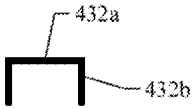
FIG. 66*b* depicts a staple with its prongs extended away from its crown.
Figure 68:
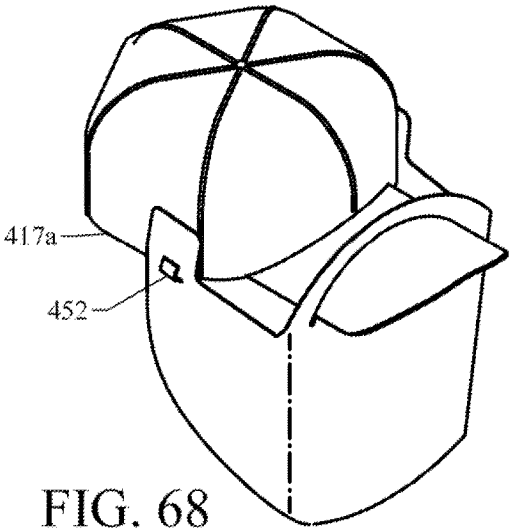
FIG. 68 depicts a perspective view of the embodiment of FIG. 67 in a folded configuration supported by the brim of a hat with the support members secured to the lower edge of the hat by clip fasteners through the slits.

FIGS. 67 and 68 depict an embodiment whereby side panels 418*a*, 418*b* are joined to central panel 402 by fold lines 420*a*, 420*b*. Side panels 418*a*, 418*b* share a curved profile with the lower edge 405*b* and comprise slits 440 on support members 422*a*, 422*b*. In the folded configuration, fold lines 420*a*, 420*b* are flexed such that side panels 418*a*, 418*b* extend away from the plane of central panel 402 and support members 422*a*, 422*b* proximate the headgear 414. Clips 452 are inserted through slits 440 and secure support members 422*a*, 422*b* against headgear 414.

Figure 69:
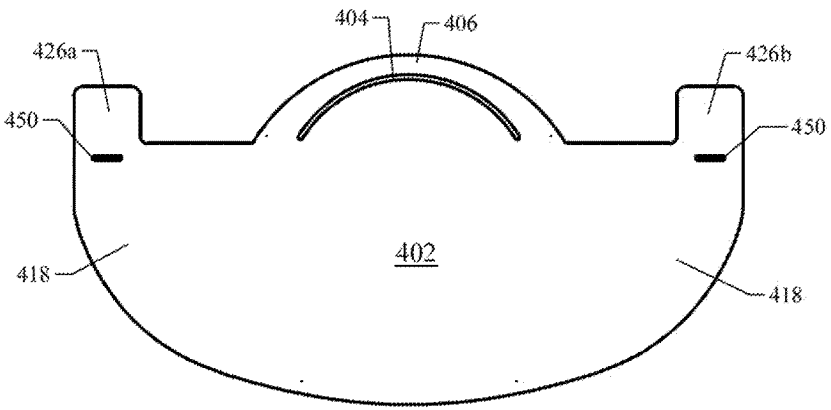
FIG. 69 depicts a front view of a fourth embodiment of the fourth style of face shield in an unfolded configuration in accordance with the present disclosure with side panels formed of a flexible material that extend the length of the central panel, slits formed in the support members, and no fold lines separating the side panels from the central panel.
Figure 66A:
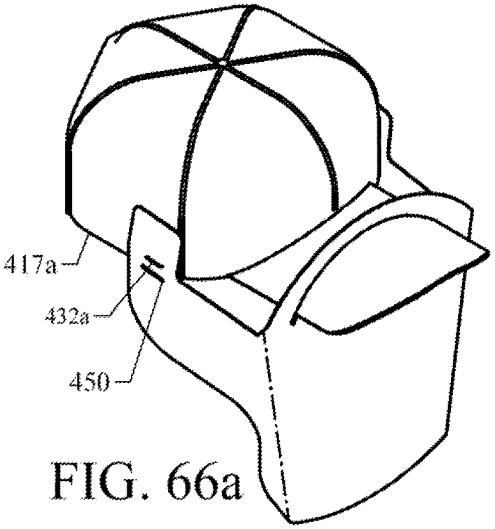
FIG. 66*a* depicts a perspective view of the embodiment of FIG. 60 in a folded configuration supported by the brim of a hat with the supporting members secured to side panels of the hat by staples.
Figure 70:
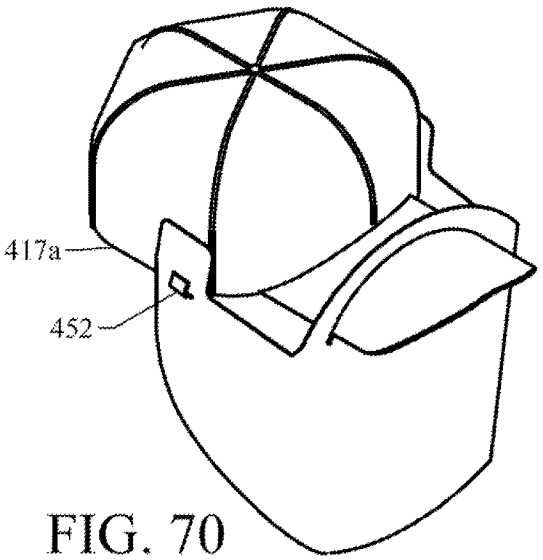
FIG. 70 depicts a perspective view of the embodiment of FIG. 69 in a three-dimensional configuration supported by the brim of a hat with the side panels flexed such that the support members are adjacent to the hat and clip fasteners inserted through the slits to secure the support members to the lower edge of the hat.
Figure 71:
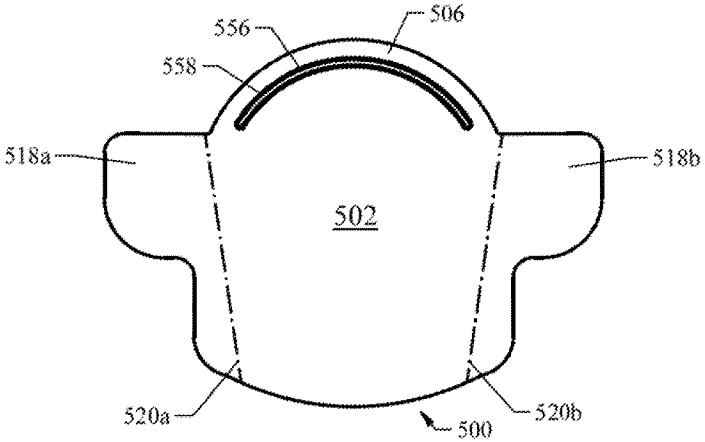
FIG. 71 depicts a front view of an embodiment of a fifth style of face shield in an unfolded configuration in accordance with the present disclosure, with a brim cover extending from the environment side about the slot.
Figure 72:
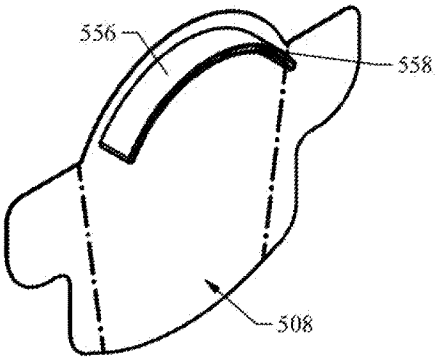
FIG. 72 depicts a perspective view of the configuration shown in FIG. 71.

FIGS. 69 and 70 depict an embodiment that is generally similar to that shown in FIGS. 67 and 68, except that fold lines 420*a*, 420*b* are omitted. As shown, side panels 418*a*, 418*b* are formed of a flexible material such that side panels 418*a*, 418*b* may be bent away from the plane of central panel 402. Side panels comprise slits 450 configured to receive a fastener 452 therethrough.

Fifth Style (Brim Cover)

FIGS. 71 through 83 depict embodiments of a fifth style of face shield 500 in accordance with the present disclosure that are generally similar to the second style of face shield 200 except as otherwise noted herein. As shown, the face shield 500 comprises a central panel 502, a slot 504, an upper portion 506, and side panels 518*a*, 518*b*. The face shield 500 further comprises a brim cover 556 configured to surround at least a portion of brim 512.

Figure 73:
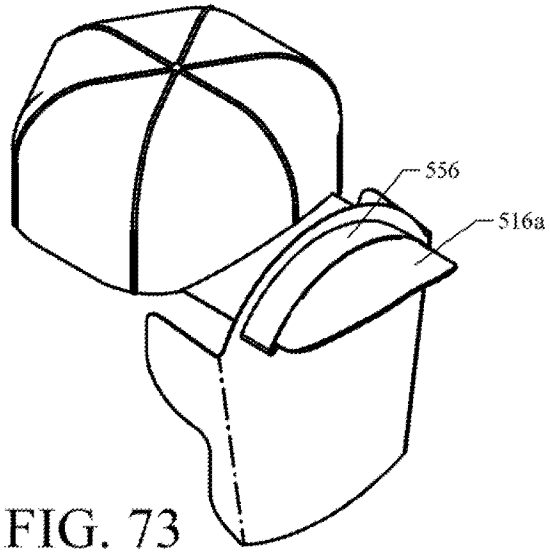
FIG. 73 depicts a perspective view of the embodiment of FIG. 71 in a folded configuration with the brim of a hat inserted through the slot and the brim cover.
Figure 74:
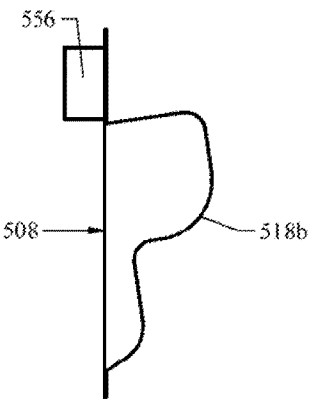
FIG. 74 depicts a side view of the embodiment of FIG. 71 in a folded configuration.
Figure 75:
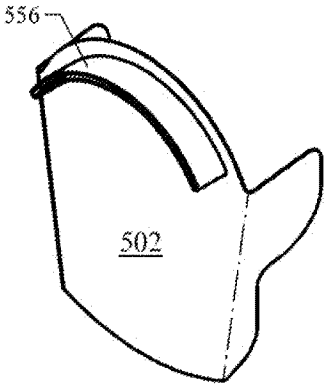
FIG. 75 depicts a perspective view of the configuration shown in FIG. 74.

As shown in FIGS. 71 through 75, in an embodiment the brim cover 556 is connected to the central panel 502 and extends from the environment side 108. Slot 504 in the central panel is joined to slot 558 in the brim cover 556, such that a passageway extends from the wearer side 110 of central panel 502 through the brim cover 556 and brim cover 556 is substantially hollow. As shown in FIG. 73, a brim 512 may be inserted through the slot 504 in the central panel 502 and the slot 504 in the brim cover 556 such that the brim extends from the wearer side 510 of the central panel and protrudes from the environment side of the brim cover 556. The placement of the face shield 500 may be adjusted by sliding the brim 512 in the brim cover 556, such that the face shield 500 is closer or further from a wearer's face, as desired.

In embodiments, the brim cover 556 is integrally formed with central panel 502 (e.g., by molding or thermoforming the brim cover 556 with the central panel 502 in si). In embodiments, the brim cover 556 is formed separately from central panel 502 before being joined to central panel 502 (such as by using a fastener, including but not limited to thermal welding).

Figure 76:
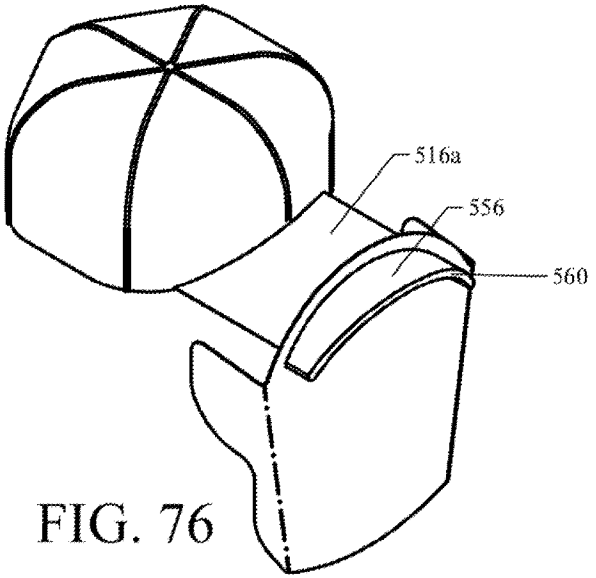
FIG. 76 depicts a perspective view of a second embodiment of the fifth style of face shield in a folded configuration in accordance with the present disclosure, with a brim cover having a closed end extending from the environment side about the slot in the central panel and the brim of a hat inserted in the slot and the brim cover.
Figure 77:
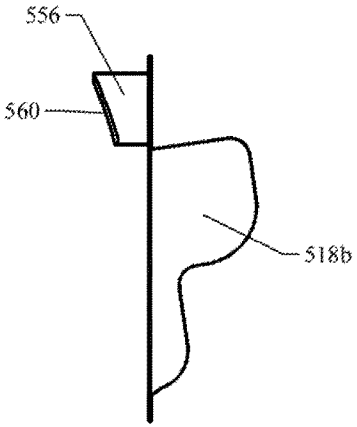
FIG. 77 depicts a side view of the embodiment of FIG. 76 in a folded configuration without the hat.
Figure 78:
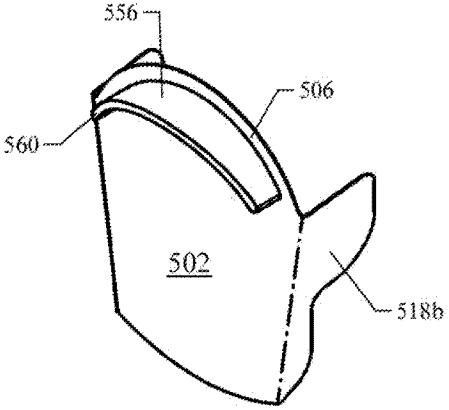
FIG. 78 depicts a perspective view of the configuration shown in FIG. 77.

As shown in FIGS. 76 through 78, in an embodiment the brim cover slot 558 has a closed end 560. Brim 512 may be inserted into slot 504 and slot 558, but cannot extend past closed end 560. Such configuration provides greater protection, as the brim 512 may be substantially covered by brim cover 556 without having an uncovered portion that extends past the face shield 300.

Figure 79:
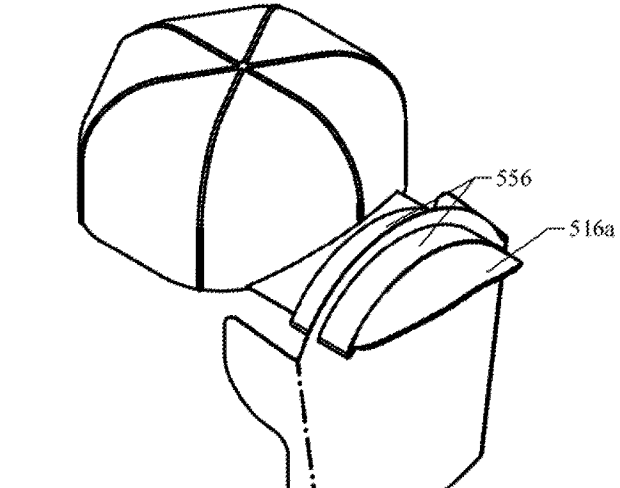
FIG. 79 depicts a perspective view of a third embodiment of the fifth style of face shield in a folded configuration in accordance with the present disclosure, with a brim cover extending from both the wearer side and the environment side about the slot and the brim of a hat inserted through the slot and brim cover.
Figure 80:
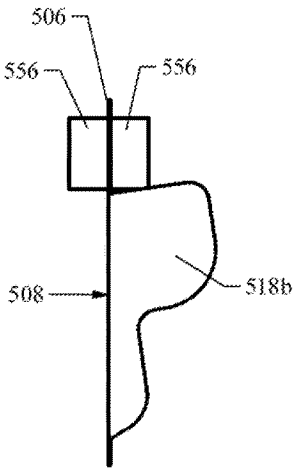
FIG. 80 depicts a side view of the embodiment of FIG. 79 in a folded configuration without the hat.
Figure 81:
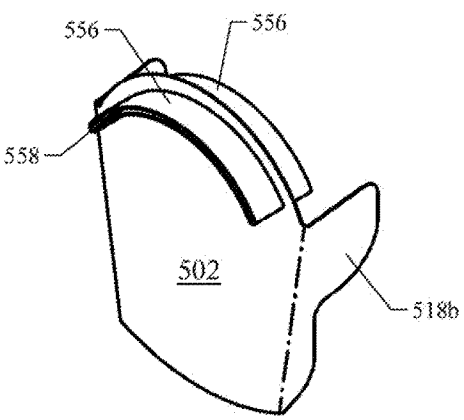
FIG. 81 depicts a perspective view of the configuration of FIG. 80.

As shown in FIGS. 79 through 81, in an embodiment brim cover 556 extends from both the wearer side 510 of the central panel 502 and the environment side 508 of central panel 502. Such configuration may cover a greater portion of the brim 512 while still allowing the position of face shield 500 on the brim 512 to be adjusted by sliding the face shield 500 along the brim 512.

Figure 83A:
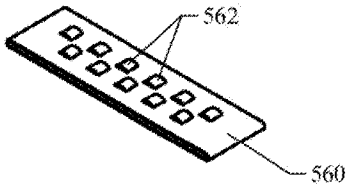
FIG. 83*a* depicts the removable bill cover of FIG. 82 in a flat configuration.
Figure 83C:
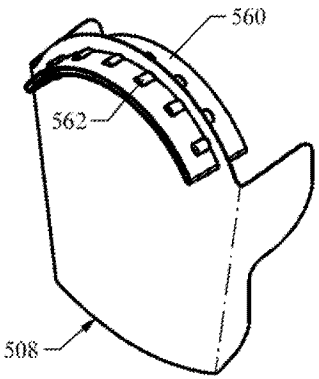
FIG. 83*c* depicts a perspective view of the configuration of FIG. 82 without the hat.
Figure 82:
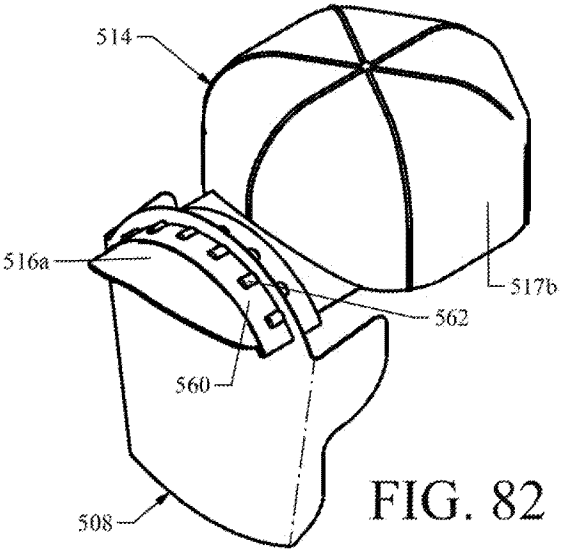
FIG. 82 depicts a perspective view of a fourth embodiment of the fifth style of face shield in a folded configuration in accordance with the present disclosure, with a removable bill cover inserted through the slot and secured to the slot by ridges on the brim cover and the brim of a hat inserted through the brim cover.
Figure 83B:
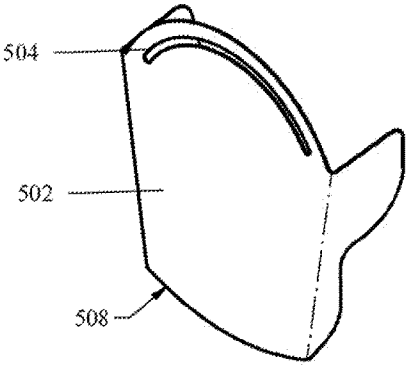
FIG. 83*b* depicts a perspective view of the face shield of FIG. 82 with the brim cover removed.
Figure 84D:
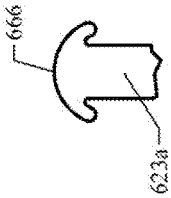
FIG. 84*d* depicts an enlarged view of area G showing a second alternative embodiment of the tabs on the outer support members of FIG. 84*a*.
Figure 84C:
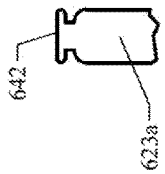
FIG. 84*c* depicts an enlarged view of area G showing a first alternative embodiment of the tabs on the outer support members of FIG. 84*a*.
Figure 84B:
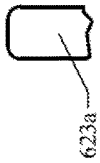
FIG. 84*b* depicts an enlarged view of area G showing a tab on the outer support member of FIG. 84*a*.
Figure 84A:
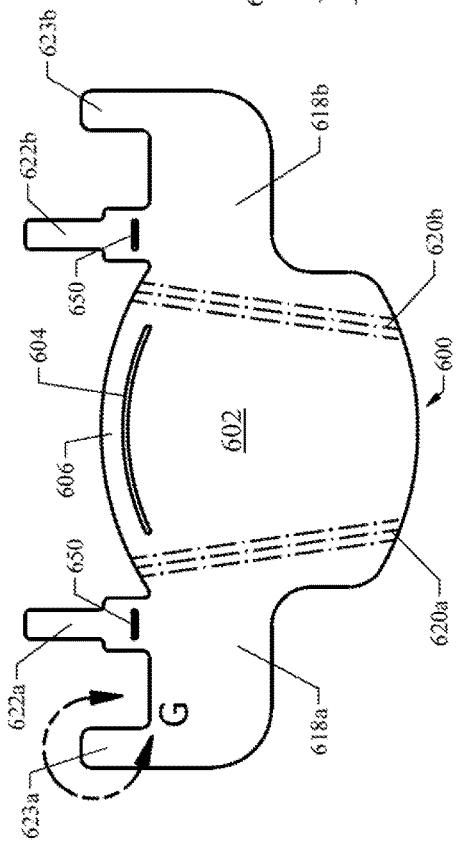
FIG. 84*a* depicts a front view of an embodiment of a sixth style of face shield in an unfolded configuration in accordance with the present disclosure with two of the four support members having slits formed thereon and tabs extending therefrom.

As shown in FIGS. 82 through 83, in an embodiment, brim cover 556 is formed separately from central panel 502 and is removable from central panel 502. As shown, brim cover 556 comprises a plurality of offset ridges 562 arranged and spaced apart such that the upper portion 506 and/or central panel 502 can be retained therebetween. In the embodiment shown, a first plurality of ridges 562 are formed in a line that extends in front of central panel 502 and a second plurality of ridges 562 are formed in a line that extends behind central panel 502. A portion of the brim cover without ridges 562 is located therebetween. In use, brim cover 556 is inserted into slot 504 such that the first plurality of ridges is on the environment side 508 of the central panel 502 and upper portion 506 and the second plurality of ridges is on the wearer side 510 thereof. The brim cover 556 is flexed to match the profile of the slot 504. Once in place, brim 512 is inserted through slot 558 in the brim cover 556. In an alternative embodiment, brim cover 556 is first secured to brim 512 before being inserted into slot 504.

Sixth Style (Adapted for Hard Hats)

FIGS. 84 through 92 depict embodiments of a sixth style of face shield 600 in accordance with the present disclosure that are generally similar to the fourth style of face shield 400 except as otherwise noted herein. As shown, the face shield 600 comprises a central panel 602, a slot 604, an upper portion 606, side panels 618*a*, 618*b*, and support members 622*a*, 622*b*. The face shield 600 is adapted for use with a four-point hard hat and/or a six-point hard hat.

Figure 86:
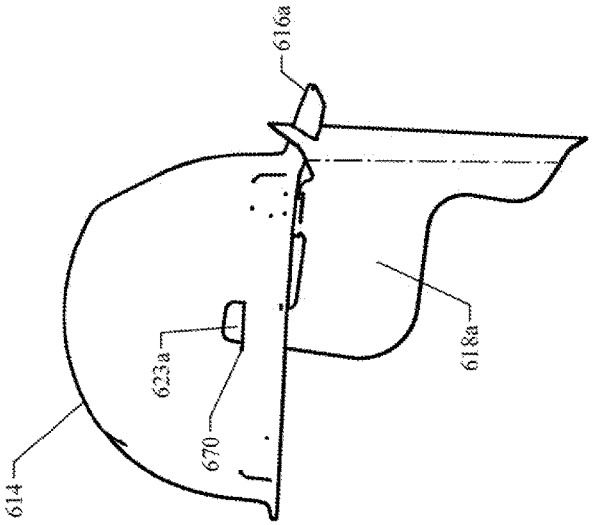
FIG. 86 depicts a side view of the configuration of FIG. 85.
Figure 85:
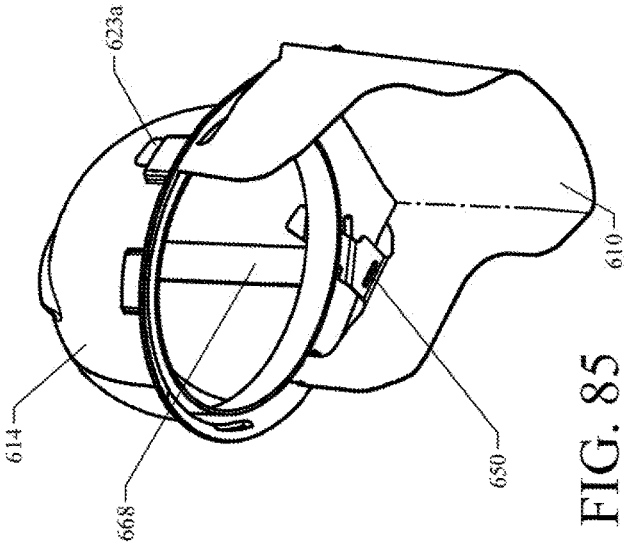
FIG. 85 depicts a lower perspective view of the embodiment of FIG. 84*a* in a folded configuration with the support members secured to a six point hard hat.

As shown in FIGS. 84 through 86, in an embodiment face shield 600 comprises outer support members 623*a*, 623*b* extending from side panel 618*a* and support members 622*a*, 622*bb* extending from side panel 618*b*. Outer support members 623*a*, 623*b* are generally similar to support members 422*a*, 422*b* and are configured to be inserted into slits 650 in a six-point hard hat. Inner support members 622*a*, 622*b* are configured to be inserted between a suspension 668 and hard hat 614. As shown in FIGS. 84*a* and 84*b*, the inner support members 622*a*, 622*b* may be tapered to better fit between the suspension 668 and hard hat 614 in an interference fit, thereby fastening the face shield 600 to the hard hat 614. In the embodiment shown in FIG. 84*c*, tabs 642 are formed on the inner support members 622*a*, 622*b* to better secure the tabs 642 to the suspension 668. In the embodiment shown in FIG. 84*d*, hammerhead tabs 666 protrude laterally from the inner support members to further secure the support members to the suspension 668.

Figure 88B:
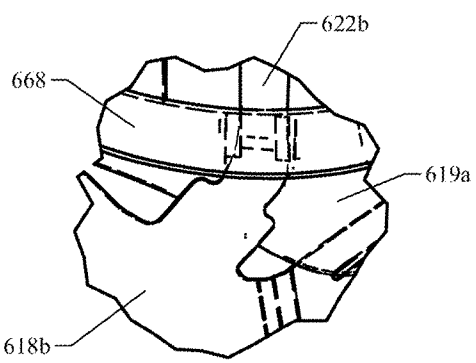
FIG. 88*b* depicts an enlarged view of area H of FIG. 88*a*.
Figure 88A:
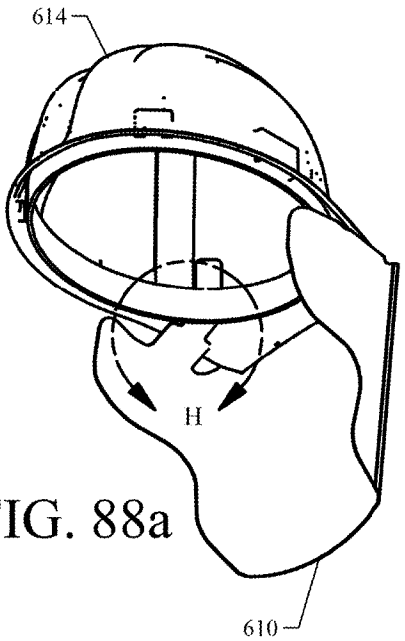
FIG. 88*a* depicts a lower perspective view of the embodiment of FIG. 87 in a folded configuration with the support members secured to a four point hard hat.
Figure 87:
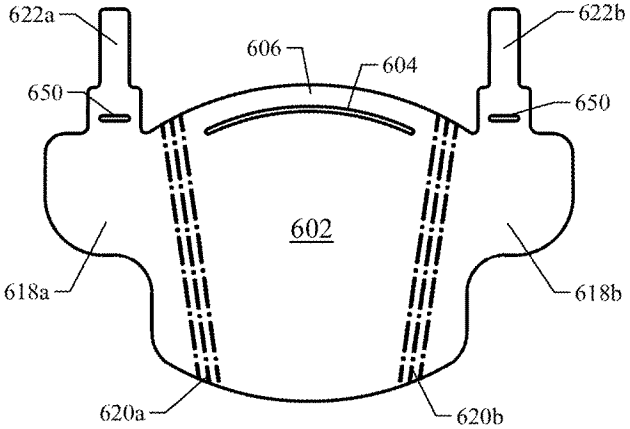
FIG. 87 depicts a front view of a second embodiment of the sixth style of face shield in an unfolded configuration in accordance with the present disclosure with the two support members having slits formed thereon and tabs extending therefrom.
Figure 89:
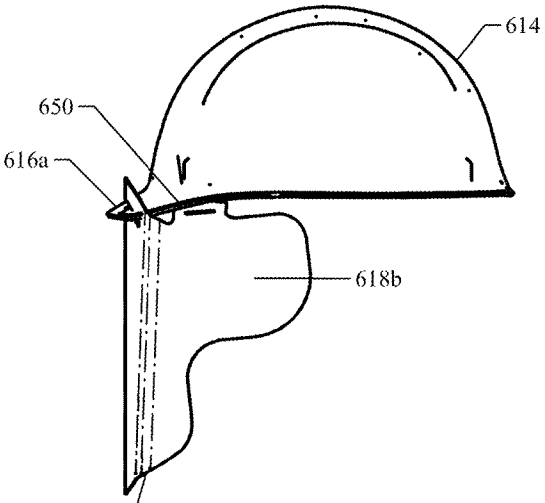
FIG. 89 depicts a side view of the configuration of FIG. 88*a*.

FIGS. 87 through 89 depict an embodiment adapted for use with a four-point hard hat. This embodiment may be formed by removing outer support members 622*a*, 622*b* from the embodiment shown in FIG. 84*a* (allowing a user to purchase a face shield 600 configured for use with a six-point hard hat and convert it for use with a four-point hard hat). Alternatively, the embodiment may be ready made for use with a four-point hard hat. Slits 878*a*, 878*b* may be formed in support members to enable a protrusion (not shown) on the hard hat to be inserted therethrough.

Figure 90:
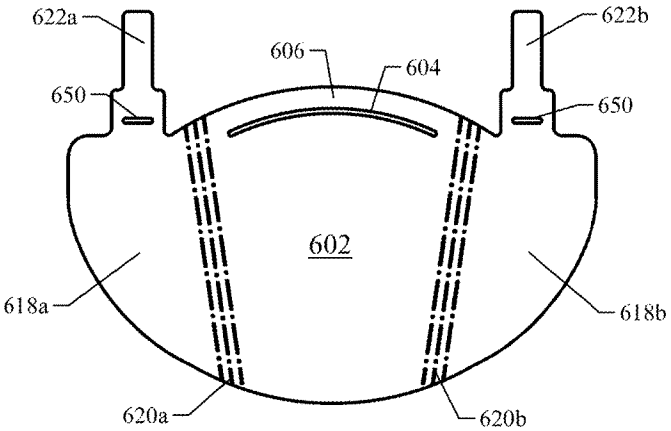
FIG. 90 depicts a front view of a third embodiment of the sixth style of face shield in an unfolded configuration in accordance with the present disclosure with side panels having a curved profile.

FIG. 90 depicts an embodiments adapted for use with a four-point hard hat. As shown, side panels 618*a*, 618*b* share a curved profile with the lower edge 605*b*. Slits 878*a*, 878*b* are formed on support members 622*a*, 622*b*. A plurality of fold lines 620*a*, 620*b* join the side panels 618*a*, 618*b* to the central panel 602. The pluralities of fold lines form a plurality of discrete creases or bends. In an embodiment, the plurality of fold lines instead comprises a discrete fold area that permits bending through the area.

Figure 92:
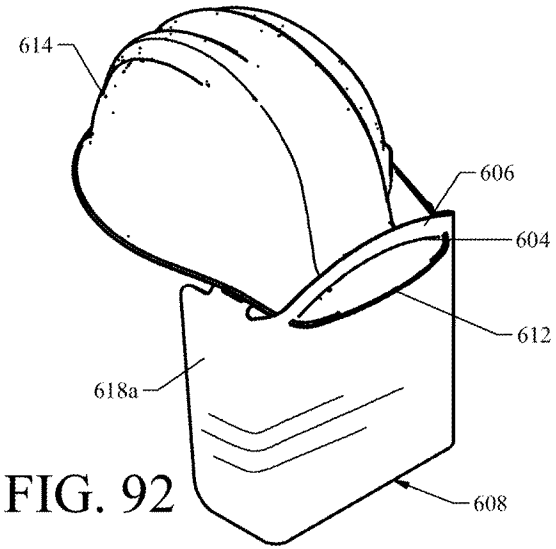
FIG. 92 depicts a perspective view of the embodiment of FIG. 91 in a three-dimensional configuration secured to a four point hard hat with the side panel flexed and the support members are secured side the hard hat.
Figure 91:
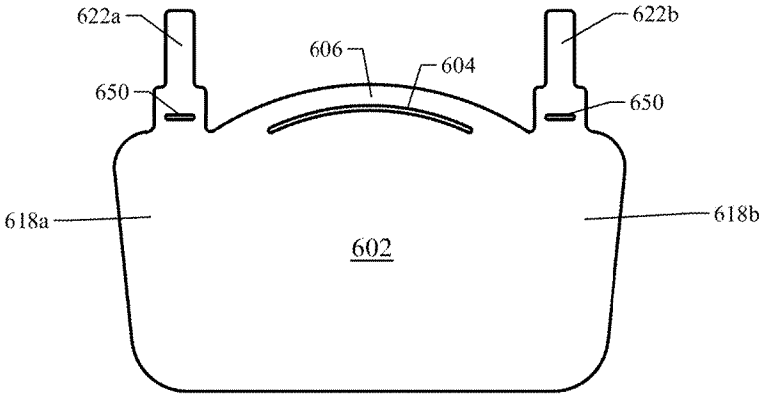
FIG. 91 depicts a front view of a fourth embodiment of the sixth style of face shield in an unfolded configuration in accordance with the present disclosure, wherein the side panels are not separated from the central panel by fold lines.

FIGS. 91 and 92 depict an embodiments adapted for use with a four-point hard hat. As shown, fold lines 620*a*, 620*b* are omitted and the side panels 618*a*, 618*b* are formed from a flexible material. In the folded or three-dimensional configuration, side panels 618*a*, 618*b* are curved towards the wearer side 110 rather than being folded about fold lines so as to move support members 622*a*, 622*b* proximate the hard hat 614.

Seventh Style (Tabbed Upper Portion)

Figure 93:
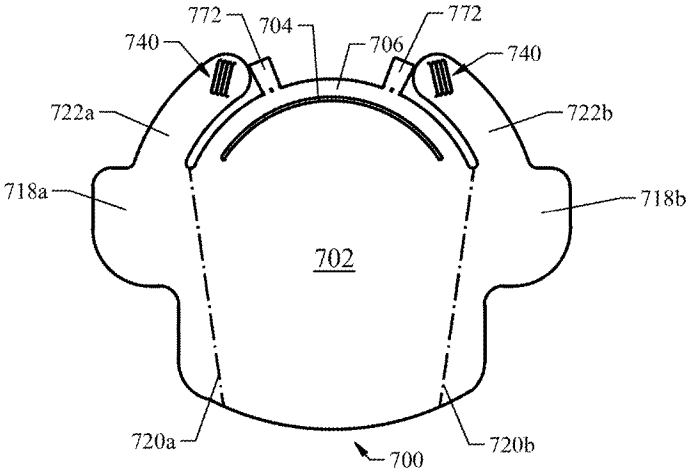
FIG. 93 depicts a front view of an embodiment of a seventh style of face shield in an unfolded configuration in accordance with the present disclosure, with tabs extending from the upper portion and a plurality of slits formed on the support members.

FIGS. 93 through 95 depict an embodiment of a seventh style of face shield 700 in accordance with the present disclosure that are generally similar to the third style of face shield 300 except as otherwise noted herein. As shown, the face shield 700 comprises a central panel 702, a slot 704, an upper portion 706, side panels 718*a*, 718*b*, and support members 722*a*, 722*b*.

Figure 94B:
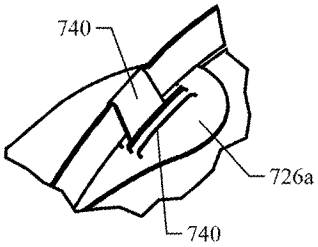
FIG. 94*b* depicts an enlarged perspective view of area I of FIG. 94*a*.
Figure 94A:
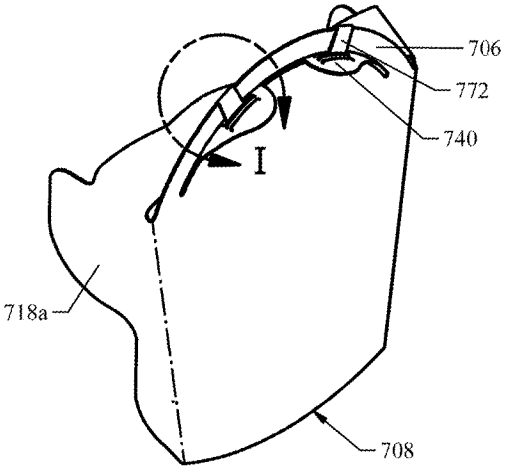
FIG. 94*a* depicts a perspective view of the embodiment of FIG. 93 in a folded configuration with the tabs inserted through respective slits on the support members.

Two tabs 772 extend from the top edge 705*a* of the central panel 702. Slits 740 on the ends 726*a*, 726*b* of support members 722*a*, 722*b* are configured to receive the tabs 772 therein. As shown in FIGS. 94*a* and 94*b*, in a folded configuration, the support members 722*a*, 722*b* are folded through the slot 704. Tabs 772 are folded down and inserted through respective slits 740. The length of tabs 772 is such that, when folded, tabs 772 extend across upper portion 706 and slot 704, thereby preventing the ends 726*a*, 726*b* from being pulled back through the slot 704 so long as the tabs 772 are in place in slits 740.

Figure 95C:
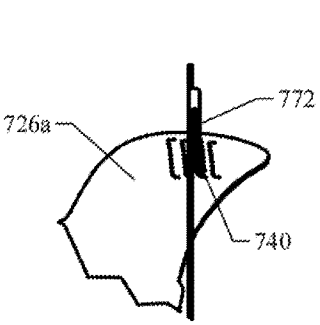
FIG. 95*c* depicts a side view of area I with the tabs flexed forward against the environment side and inserted through the slits in the support members.
Figure 95B:
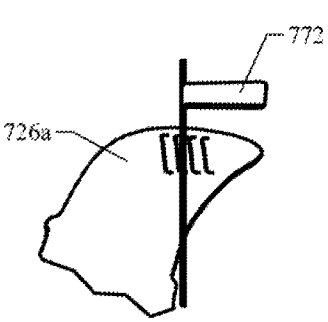
FIG. 95*b* depicts a side view of area I with the tabs partially flexed towards the environment side.
Figure 95A:
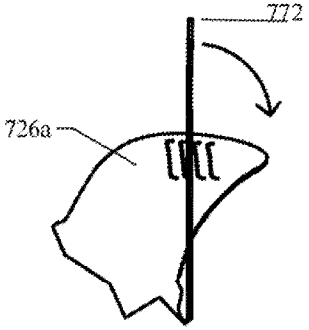
FIG. 95*a* depicts a side view of area I with the tabs fully extended.

As shown in FIGS. 95*a* through 95*c*, tabs 772 may be folded forward against the environment side 708. In embodiments (not shown), tabs 772 may be folded back against wearer side 710. In embodiments, a tab 772 is of sufficient length to be folded against environment side 708 and inserted through a slit 740 in front of face shield 700. Tab 772 may then be folded backwards and inserted through slot 704 before being folded upward against wearer side 710 and inserted through a second slit 740 behind face shield 700.

Eighth Style (Face Access)

FIGS. 96 through 100 depict embodiments of an eighth style of face shield 800 in accordance with the present disclosure that are generally similar to the third style of face shield 300 except as otherwise noted herein. As shown, the face shield 800 comprises a central panel 802, a slot 804, an upper portion 806, side panels 818*a*, 818*b*, and support members 822*a*, 822*b*.

As shown in FIGS. 96 through 97, in an embodiment, face shield 800 comprises a fold line 875 extending laterally across central panel 802. Fold line 875 enables a lower portion 874 of the central panel 802 to be bent or folded upwards towards the environment side 810 of the face shield 800 to permit access to the lower portion of a face of a wearer 876 without removing the face shield. Advantageously, as shown in FIG. 97*c*, this configuration permits a wearer to eat or drink (such as using cup 877*a*) without needing to entirely remove the face shield 800. The wearer 876 is thus afforded some protection, including to the wearer's eyes, even while accessing the lower portion of the wearer's face. In the embodiment shown, lower portion 874 is formed integrally with central panel 802.

In the embodiment shown in FIG. 98, lower portion 874 is formed separately from central panel 802 and is flexibly joined to central panel 802 by single-sided tape 854. As shown, the tape 854 is transparent to visible light. In other embodiments, the tape 854 is translucent or at least partially opaque. In embodiments, other materials are used to join central panel 802 and lower portion 874. In embodiments, lower portion 874 is formed from a different material than central panel 802. In an embodiment, lower portion 874 is formed from a filter material that is at least semi-permeable to air while central panel 802 is formed from a material that is substantially impermeable.

FIGS. 99 and 100 depict an embodiment wherein central panel 802 covers only the upper portion of the face of a wearer 876. Such configuration may be preferable, for example, when a wearer is using a separate mask 877*b* about the mouth and nose of the wearer 876. As such, face shield 800 provides protection to the eyes while not obstructing access to the mask 877*b*.

Ninth Style (Split Support Member)

FIGS. 101 through 106 depict embodiments of a ninth style of face shield 900 in accordance with the present disclosure that are generally similar to the third style of face shield 300 except as otherwise noted herein. As shown, the face shield 900 comprises a central panel 902, a slot 904, an upper portion 906, and support members 922*a*, 922*b*.

Support members 922*a*, 922*b* each comprise a top portion 980*a* separated from a bottom portion 980*b* by a slit 978*a*, 978*b*. In a folded configuration, the support members 922*a*, 922*b* are flexed back against wearer side 910. Slits 978*a*, 978*b* are configured to receive and retain a brim 912 therebetween. Slits 978*a*, 978*b* further increase the friction between the brim 912 and the face shield 900, thereby improving retention of the face shield 900 on the brim 912.

As shown in FIGS. 101 through 103, in an embodiment support members 922*a*, 922*b* are directly connected to central panel 902 by fold lines 920*a*, 920*b*. Although a plurality of fold lines are shown to permit support members 922*a*, 922*b* to fold flush against wearer side 910 of central panel 902, in other embodiments a single fold line or a fold area is used.

As shown in FIGS. 104 and 105, in an embodiment support members 922*a*, 922*b* are connected to side panels 918*a*, 918*b* by fold lines 920*a*, 920*b*. Side panels 918*a*, 918*b* are in turn connected to central panel 902 by fold lines 920*a*, 920*b*. As shown in FIG. 105, in the folded configuration the support members 922*a*, 922*b* are thus spaced apart from the central panel 902 when the brim 912 is inserted through slits 978*a*, 978*b* and slot 904.

FIG. 106 depicts an embodiment that is generally similar to that shown in FIGS. 101 through 103, except that central panel 902 further comprises a plurality of teeth 949 which protrude from the central panel 902 into the slot 904. As discussed above, other configurations of teeth are contemplated in other embodiments.

Tenth Style (Respirator)

FIGS. 107 through 111 depict an embodiments of a tenth style of face shield 1000 in accordance with the present disclosure that are generally similar to the third style of face shield 300 except as otherwise noted herein. As shown, the face shield 1000 comprises a central panel 1002, a slot 1004, an upper portion 1006, side panels 1018*a*, 1018*b*, and support members 1022*a*, 1022*b*.

Face shield 1000 is configured for use with a respirator 1084*a* having a respirator cartridge 1084*b* that protrudes therefrom. As shown, central panel 1002 comprises an opening 1082 sized to accommodate respirator cartridge 1084*b* such that the environment side 1008 of respirator cartridge 1084*b* extends past the face shield 1000. This permits air from the environment side 1008 of the face shield to be drawn in through the respirator cartridge 1084*b* where it can be filtered and inhaled by the wearer 1076. Air can also be expelled through the respirator cartridge 1084*b* to the environment side 1008 of the face shield.

As shown, the central panel 1002 is sandwiched between the respirator 1084*a* and the respirator cartridge 1084*b*. In embodiments, a deformable member (such as an O-ring) is placed between the respirator 1084*a* and the central panel 1002 and/or the respirator cartridge 1084*b* and the central panel 1002 to create an air-tight connection therebetween. Respirator cartridge 1084*b* may be screwed or otherwise locked into respirator 1084*a*, thereby retaining them with the face shield 1000. In an embodiment, once sealed together, the respirator 1084*a* and the respirator cartridge 1084*b* are supported by the face shield 1000 without the need for separate support structures. In embodiments, seals or adhesives may be used to seal respirator 1084*a* against the face of a wearer 1076. In an embodiment, the face shield 1000 presses the respirator 1084*a* against the face of a wearer 1076 with sufficient force to create a seal about the wearer's mouth and nose.

Eleventh Style (Decontamination Curtain)

FIGS. 112 through 121 depict an embodiments of an eleventh style of face shield 1100 in accordance with the present disclosure that are generally similar to the third style of face shield 300 except as otherwise noted herein. As shown, the face shield 1100 comprises a central panel 1102, a slot 1104, an upper portion 1106, side panels 1118*a*, 1118*b*, and support members 1122*a*, 1122*b*. Face shield 1100 incorporates one or more emitters 1191 configured to generate a decontamination curtain 1192 about the face of a wearer 1176. In the embodiment shown in FIGS. 112 through 120, the decontamination curtain 1192 is formed from ultra-violet light. In embodiments, the decontamination curtain 1192 is formed from other decontaminating radiation (which may comprise electromagnetic radiation, chemicals, aerosols, sonic waves, or other decontaminating substance or energy). In embodiments, the decontamination curtain 1192 is formed from decontaminating gas or liquid.

The decontamination curtain 1192 serves to prevent or reduce the amount of contamination that reaches a wearer's face from around the edges of the face shield 1100. Decontamination includes, for example, viruses, bacteria, and other harmful items which a wearer desires to prevent from reaching the wearer's eyes, mouth, and/or nose.

As shown, emitters 1191 are held in an emitter array 1190. As the embodiment show, emitters 1191 are light-emitting diodes (LEDs) configured to emit light in the ultra-violet spectrum which are electrically connected via emitter array 1190. Emitter ray 1190 is retained against face shield 1100 by housing 1186 which comprises a slit 1188 to permit insertion of the emitter array 1190 and the face shield 1100. Housing 1186 is flexible, such that the size of slit 1188 may be increased by bending housing 1186.

When assembled, emitters 1191 are oriented to extend from the wearer side 1110 such that the decontamination curtain 1192 extends from the emitters 1191 to the wearer 1176. The decontamination curtain 1192 covers the area below the brim 1112 around the perimeter of the face shield, such that contaminants cannot reach the wearer's face from around the perimeter of the face shield. A decontamination source 1194 is provided to supply the decontamination curtain 1192. In the embodiment shown, decontamination source 1194 comprises a battery that may be retained beneath brim 1112. In other embodiments, decontamination source 1194 comprises a reservoir of decontaminant that may be ejected by emitters 1191.

In the embodiment shown in FIGS. 112 through 120, emitter array 1190 and housing 1186, and decontamination source 1194 are removable from the face shield 1100. In this manner, face shield 1100 may be provided to a wearer 1176 in a planar configuration, and discussed above. The wearer 1176 may then add emitter array 1190 and housing 1186, and decontamination source 1194 to any compatible face shield as desired and/or remove them for cleaning or maintenance.

FIG. 121 depicts an embodiment wherein emitter array 1190 and housing 1186 are integrated together into a single piece (which may be either formed integrally with face shield 1100 or which may be separable therefrom).

Twelfth Style (Respirator and Decontamination Curtain)

FIGS. 122 and 123 depict an embodiment of a twelfth style of face shield 1200 in accordance with the present disclosure that is generally similar to the tenth style of face shield 1000 except as otherwise noted herein. As shown, the face shield 1200 comprises a central panel 1202, a slot 1204, an upper portion 1206, side panels 1218*a*, 1218*b*, and support members 1222*a*, 1222*b*.

Face shield 1200 is configured for both use with a respirator 1284*a* having a respirator cartridge 1284*b* that protrudes therefrom and use with an emitter array 1290, housing 1286, and decontamination source 1294. As shown, central panel 1202 comprises an opening 1282 sized to accommodate respirator cartridge 1284*b* such that the environment side 1208 of respirator cartridge 12846*b* extends past the face shield 1200.

Methods of Use

FIGS. 124 through 126 illustrate methods of using a face shield. As shown in FIG. 124, the face shield 1300 may be provided in an unfolded or planar configuration with a strip of material 1395 in the slot 1304. Upon receiving the face shield 1300, the strip of material 1395 is removed from the central panel 1302 to form the slot 1304.

Next, as shown in FIG. 125*a*, the side panels 1318*a*, 1318*b* are folded towards the wearer side 1310 of the face shield 1300. As shown in FIG. 125*b*, the side panels 1318*a*, 1318*b* are then folded away from the wearer side 1310. In the embodiment shown, the side panels 1318*a*, 1318*b* are substantially perpendicular from the central panel 1302 once folded.

The face shield 1300 is then secured to a brim 1312 by inserting the brim 1312 through the slot 1304. Support members 1322*a*, 1322*b* are folded below the brim 1312, as shown in FIG. 125*c*. In other embodiments, support members 1322*a*, 1322*b* are folded above the brim 1312 or proximate the headgear 1314.

As shown in FIG. 126, the face shield 1300 is positioned on and secured to the brim 1312 by pressing on the environment side 1308 of the upper portion 1306 and pressing on the wearer side 1310 of the central panel 1302, such as using fingers 1396. This pressure causes the face shield 1300 to flex and increases the pressure between the slot 1304 and the brim 1312.

Figure 127A:
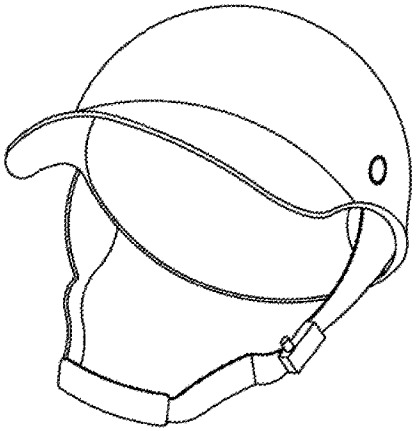
Figure 127B:
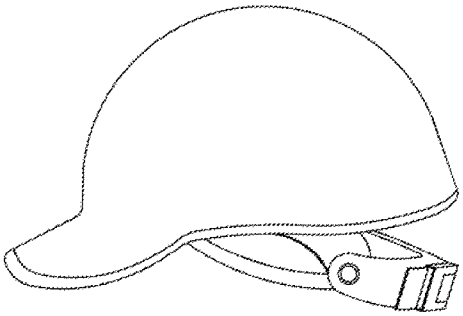
Figure 127C:
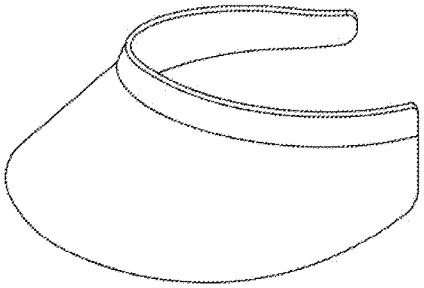
Figure 127D:
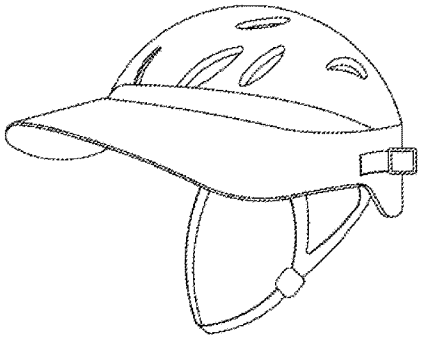
Figure 127E:
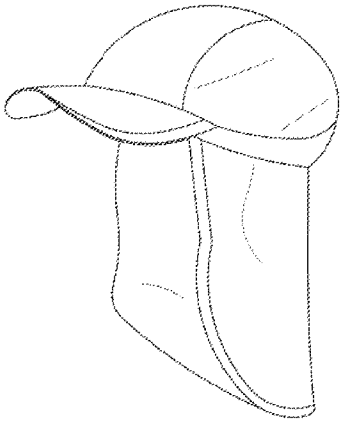
Figure 127F:
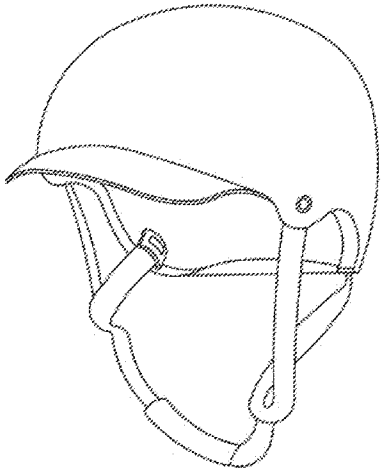
Figure 127I:
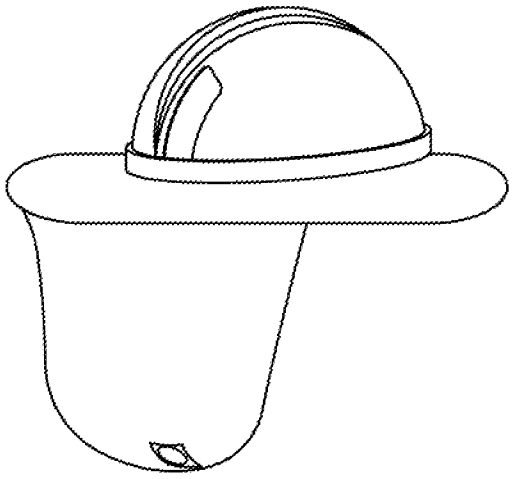
Figure 127G:
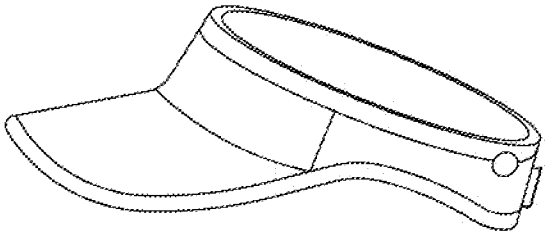
Figure 127H:
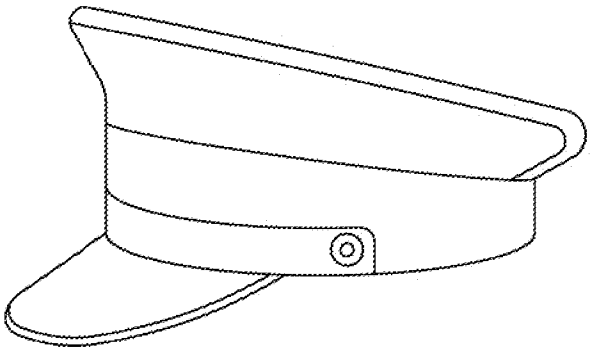

FIGS. 127*a* through 127*i* depict a variety of brimmed headgear (including hats, visors, helmets, and head coverings) with which a face shield in accordance with the present disclosure may be used. For each headgear, the face shield may be configured with a slot adapted to receive a brim of the headgear, thereby supporting the face shield. As shown, FIGS. 127*a* and 127*b* depict scooter helmets, FIG. 127*c* depicts a sports visor, FIG. 127*d* depicts a sun visor with a partial helmet, FIG. 127*e* depicts a hat with netting, FIG. 127*f* depicts an equestrian helmet, FIG. 127*g* depicts a sun visor, FIG. 127*h* depicts a peaked cap (also known as a patrol cap), and FIG. 127*i* depicts a pith helmet with netting.

It is understood that the preceding is merely a detailed description of some examples and embodiments of the present invention and that numerous changes to the disclosed embodiments may be made in accordance with the disclosure made herein without departing from the spirit or scope of the invention. The preceding description, therefore, is not meant to limit the scope of the invention, but rather to provide sufficient disclosure to allow one of ordinary skill in the art to practice the invention without undue burden. It is further understood that the scope of the present invention fully encompasses other embodiments that may become obvious to those of ordinary skill in the art and that the scope of the present invention is accordingly limited by nothing other than the appended claims.

What is claimed is:

1. A method of attaching a face shield with an environment side and a wearer side to a brim, the face shield comprising a central panel, a first side panel, a first support member extending from the first side panel and having a first tab, a second side panel, and a second support member extending from the second side panel and having a second tab wherein the first side panel and the second side panel are co-planar with the central panel, the method comprising:

removing a portion of the central panel to form an opening in the central panel, the opening structured as a slot;

folding the first side panel to form a first reflex angle with the environment side of the central panel;

folding the second side panel to form a second reflex angle with the environment side of the central panel;

inserting the brim through the opening in the central panel;

inserting the first support member through the slot;

inserting the second support member through the slot;

folding the first tab to abut the central panel; and folding the second tab to about the central panel.

2. The method of claim 1, wherein said folding the first side panel comprises folding the first side panel against the wearer side of the central panel and said folding the second side panel comprises folding the second side panel against the wearer side of the central panel.

* * * * *